US007963673B2

(12) United States Patent
Finn

(10) Patent No.: US 7,963,673 B2
(45) Date of Patent: Jun. 21, 2011

(54) VERSATILE ILLUMINATION SYSTEM

(76) Inventor: Bruce L. Finn, Malibu, CA (US)

( * ) Notice: Subject to any disclaimer, the term of this patent is extended or adjusted under 35 U.S.C. 154(b) by 595 days.

(21) Appl. No.: 11/755,731

(22) Filed: May 30, 2007

(65) Prior Publication Data

US 2008/0079906 A1 Apr. 3, 2008

Related U.S. Application Data

(60) Provisional application No. 60/803,385, filed on May 30, 2006.

(51) Int. Cl.
*F21S 4/00* (2006.01)

(52) U.S. Cl. ..... 362/249.03; 362/249.07; 362/249.1; 362/249.11; 362/319; 362/327; 362/413

(58) Field of Classification Search ..... 362/249.03, 362/237, 238, 239, 240, 241, 245, 246, 249.07, 362/249.1, 249.11, 282, 293, 319, 327, 413
See application file for complete search history.

(56) References Cited

U.S. PATENT DOCUMENTS

| | | | | |
|---|---|---|---|---|
| 1,697,216 | A * | 1/1929 | Wuelker | 29/90.01 |
| 1,757,718 | A * | 5/1930 | Kauffmann | 362/126 |
| 1,776,477 | A * | 9/1930 | O'Keefe | 40/361 |
| 1,941,503 | A * | 1/1934 | Villiers | 362/233 |
| 4,843,527 | A * | 6/1989 | Britt | 362/231 |
| 5,034,866 | A * | 7/1991 | Pujol | 362/240 |
| 5,493,170 | A * | 2/1996 | Sheppard et al. | 313/113 |
| 5,685,634 | A * | 11/1997 | Mulligan | 362/237 |
| 6,106,125 | A | 8/2000 | Finn et al. | |
| 6,120,164 | A * | 9/2000 | Libin et al. | 362/269 |
| 6,588,912 | B1 | 7/2003 | Finn et al. | |
| 6,719,434 | B1 | 4/2004 | Finn et al. | |
| 7,204,617 | B1 | 4/2007 | Finn | |
| 7,434,966 | B2 | 10/2008 | Finn | |
| 2006/0023453 | A1 * | 2/2006 | Lee et al. | 362/253 |
| 2008/0079906 | A1 | 4/2008 | Finn | |
| 2008/0198578 | A1 | 8/2008 | Finn | |
| 2009/0297874 | A1 | 12/2009 | Finn | |

* cited by examiner

*Primary Examiner* — Sharon E Payne
(74) *Attorney, Agent, or Firm* — Irell & Manella LLP

(57) ABSTRACT

A lightweight, modular expandable multiple par lamp fixture configurable to form various sizes and intensities of high output area lighting or projected soft light. A high efficiency par lamp includes a high output globe and lightweight reflector, optional collar, and lens. Individual modular fixtures comprising high efficiency par lamps may be stacked to create larger units. The par lamps may be arranged in pods which can be assembled into larger units. A diffusion frame and fabric cover can be attached to the fixture in front of the par lamps to create a soft, deeply projected light. The diffusion frame may have an internal semi-translucent baffle to spread light through diffusive sidewalls.

22 Claims, 33 Drawing Sheets

FIG. 22A
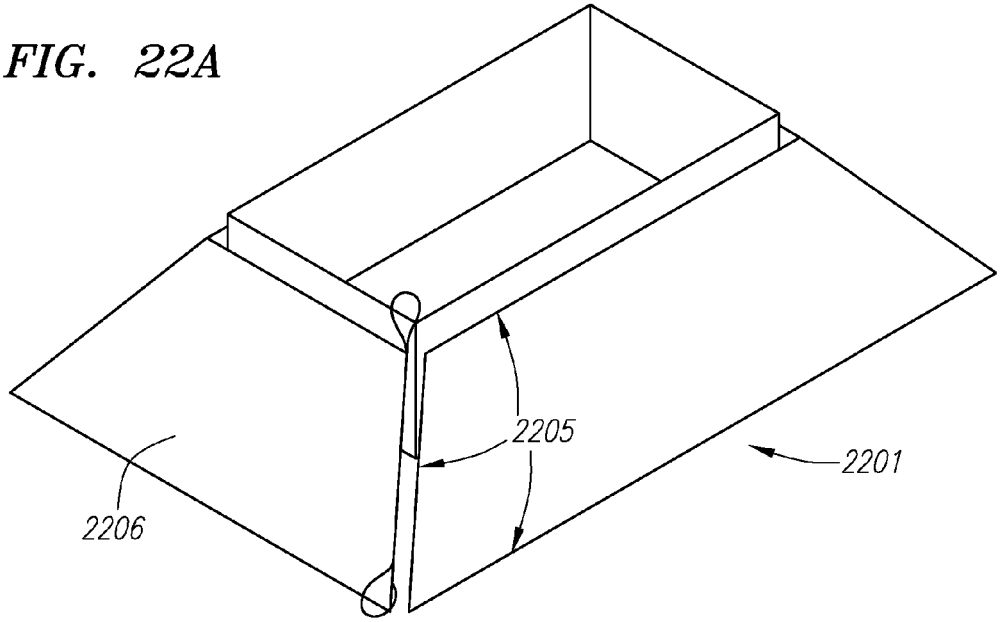
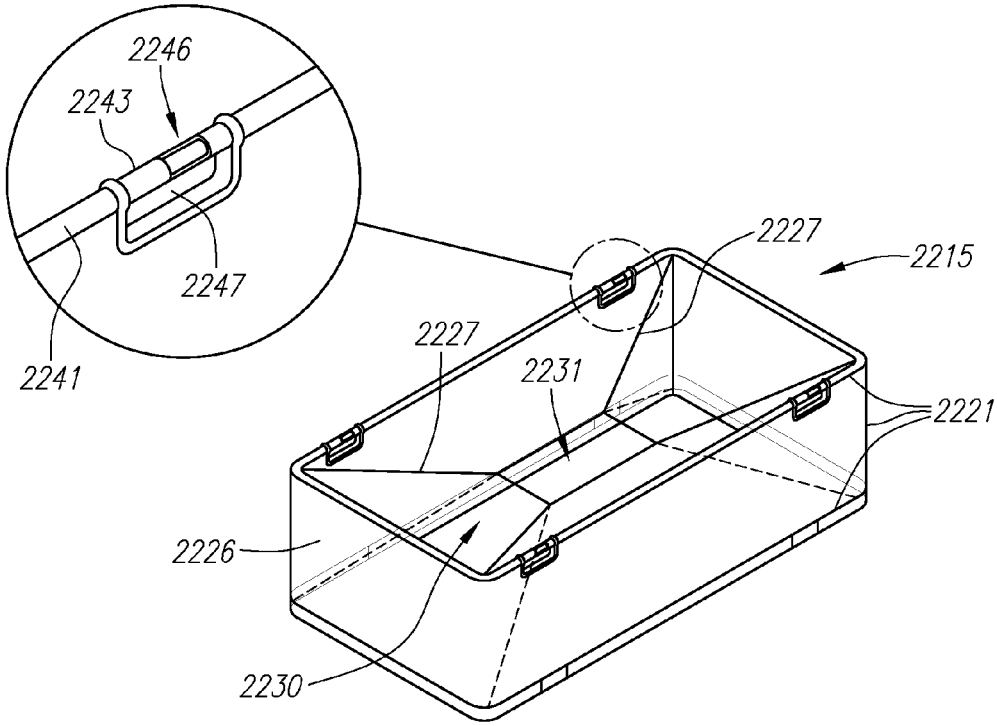
FIG. 22B

VERSATILE ILLUMINATION SYSTEM

RELATED APPLICATION INFORMATION

This application is a utility application claiming the benefit of U.S. Provisional Application Ser. No. 60/803,385, filed on May 30, 2006, which is hereby incorporated by reference as if set forth fully herein.

BACKGROUND OF THE INVENTION

1. Field of the Invention

The field of the present invention relates to lighting fixtures and associated systems, and more particularly to high efficiency lighting fixtures and associated systems and methods of lighting as may be useful, for example, for motion pictures, television, video, digital image capture, theatre, and the like.

2. Description of the Related Art

Specialized lighting fixtures are often needed in the entertainment industry (including motion pictures, television and theatrical arts, as well as in the photographic industry), as well as in other fields, or in certain commercial, industrial, or consumer settings. In the entertainment industry it is necessary to light a set, stage or other area. To provide highly focused projected light for this purpose, par lamps have occasionally been used. A representative example of such a par lamp is known as the ProCan™ available from TMB of Pacoima, Calif. These par lamps come in several different sizes, such as Par 64 (8"), Par 56 (7"), and Par 46 (5¾"), and typically have, among other things, a standard par light socket, an elongate canister, and a sealed-beam par globe disposed within the canister. These so-called "sealed beam" par lamps (or "cans") are constructed such that the par globe with its parabolic aluminized reflector, filament and lens are contained in, and operate as, an integrated single unit or lighting fixture. The ProCan par lamp referred to above has a swinging yoke or handle from which it can be hung, for example or mounted on a stand along with a locking assembly. Other models of par lamps used for theatrical lighting and other purposes are made by Altman Stage Lighting Co., Inc. of Yonkers, N.Y. In addition, various companies make smaller par lamps. One such brand sold by TMB Co. is called the ProCan "mini-par" which is, as the name implies, generally a smaller sized version of a larger par lamp.

Attempts have been made to combine par lamps into arrays for the purpose of making lighting units with increased illumination output. One example is the 6×4 Moleeno™ Molepar made by Mole-Richardson Co. of Hollywood, Calif., which uses 24 par-64 (8") globes. The Moleeno Mole-Par is also made available in other sizes, such as in 6-light, 12-light, 24-light, and 36-light sizes, and is generally constructed of several multi-light sub-assemblies which are combined into a frame to form a larger lighting array.

One drawback of conventional par lamps is that they can use a great deal of power, especially when combined in an array of many lamps. For example, the Molepar mentioned above uses 24,000 Watts at full power which requires 200 Amps. An improved par lamp has become available which offers the potential for increased power efficiency. The basic principles of operation of this improved par lamp are described in U.S. Pat. No. 5,628,213 to Cunningham, hereby incorporated by reference as if set forth fully herein. A commercial version of this par lamp uses HPL lamp elements (as made by General Electric Corporation, for example), and an example is known as the Source Four® par lamp available from Electronic Theatre Controls, Inc. ("ETC") headquartered in Middleton, Wis. This type of par lamp generally has a concave parabolic reflector configured to be symmetrical about a longitudinal axis, and an incandescent lamp globe or bulb including a plurality of linear helically-wound filaments arranged with their longitudinal axes substantially parallel with, and spaced symmetrically around, the longitudinal axis of the concave reflector. The Source Four type par lamp offers somewhere around a 40% improvement in power efficiency over standard par lamps. However, they are generally quite expensive, heavy, and bulky in nature. A Source Four par lamp has, for example, a sealed reflector housing and numerous heat sink fins cast into the housing. The housing is constructed of rugged, die cast aluminum. The unit contains ten baffles to eliminate beam scattering and spill light. It also has a rugged steel yoke. The size of the unit is 11" long by 10" wide, and it weighs approximately eight pounds.

Despite the size and bulk of Source Four par lamps, some recent attempts have been made to combine Source 4 HPL par lamps into larger units. These larger units tend to be heavy and rather expensive. The advertised weight of Source Four par lamps is approximately eight pounds, and thus combining many lamps into large units would result if rather heavy lighting appliances. This can be problematic for use in the entertainment field, where portability and maneuverability are significant concerns.

Another attempt to build a multi-lamp unit based on retrofitted par-type lamp designs has been made, for example, by Bardwell & McAlister Lighting and Grip Inc. of Sun Valley, Calif. These multi-lamp units use part(s) of the ETC Source Four Par lamp (e.g., the Source Four socket retrofitted in a traditional-style Par 64 type multi-par fixture, and the par lamp component(s) are combined with an 8" reflector and 8" lens. These retrofitted multi-par fixtures have similar size and, to some extent, weight issues as conventional 8" (Par 64 style) multi-lamp par fixtures. Although use of a lighter weight aluminum reflector and replacement of some steel parts with aluminum does help to reduce the overall weight somewhat, these lights have other drawbacks. For example, they do not have optimal light output because the HPL components do not match up with the non-HPL components, such as the reflector and lens which are 8" (Par 64) in diameter, while the HPL bulb is optimized for a 7" diameter (Par 56) size. Also, these units do not allow convenient replacement of globes. A technician must remove a hot lens (if the lamp has been operating) and attempt to replace the globe from the front, which may require that the technician wait for the lamp to cool down or else expose the technician to some risk of injury, for example.

Par lamps have been used to provide soft, projected diffuse light, as opposed to direct or hard key lighting. A diffusion lighting source can be very useful. Often, particularly for an indoor set in the motion picture and television industries, the key (i.e., primary) lighting is provided at the back corners of the set (opposite where the camera and audience, if any, will be) to avoid boom (sound equipment) shadows and a fill light from the front in accordance with a theory known as back cross key lighting. While back cross key lighting is used, for example, in almost all sitcoms, there are some inherent drawbacks to the approach. One problem is that the "key" or strongest, and often hardest, light comes from the top/back (upstage) portion of the set, so there are invariably shadows thrown from the people and objects on the set onto each other. Also, in many cases there are shadows from a person's facial features that fall upon that person's face, such as nose shadows. The strong ("hard") light coming from the back also creates hot rims around people and is especially objectionable on bald or light-haired individuals. This hard light, which has been traditionally used, can also create unwanted microphone boom shadows. These back cross key lights traditionally used are Fresnels, which are "hard" lights. Because of the inherent inefficiency in the design of the reflector and Fresnel lens, the output of these instruments if softened substantially with one or more moderate or heavy diffusion filters placed in front of the light results in very poor output versus amperage drawn.

Conventional wisdom is that the lights are mounted on a stand, on a pipe, or on typical set scaffolding known as a green bed. As there are numerous lights on a set, and as providing a diffusion screen on each light is cumbersome, and as it is further cumbersome to change such screens and to align such lights to properly cooperate, the use of individually mounted diffusion devices is not practical or economical for some set lighting especially sitcoms. Examples of individually mounted diffusion gel supporting members are shown in U.S. Pat. No. 5,651,602 to Joseph N. Tawil, issued Jul. 29, 1997, and U.S. Pat. No. 4,446,506 to Raymond G. Larson issued May 1, 1984. These require special brackets or rings to mount to the lighting instrument, and are often dependent on the type of light.

A diffusion device has been known to be used with multiple lights, such as in U.S. Pat. No. 4,855,874 to Thomas A. Waltz issued Aug. 8, 1989. The Waltz patent discloses a light modifier which is inflatable and surrounds multiple lights attached to a stand or to other support rods which are not part of the inflatable device. The device itself which provides light diffusion must be entirely changed to change the light diffusion effect, and it has limited ability to control and direct light. It is therefore impractical to use for set lighting. Moreover, it requires a pump to maintain the inflatable device, which can be noisy and thus could interfere with shooting television or motion pictures.

Even when diffusion is used, often expensive Fresnel lights are used with it. These lights are generally focusable between "spot" and "flood" conditions, and provide a useful light source because one can adjust the pattern and intensity of the light when it is not heavily diffused, allowing for a tight "spot" of hot light, a wide flood of lesser intensity, or a selectable middle ground. It is interesting to note that when projected through heavy diffusion, this function is neutralized. Fresnel lights also have other drawbacks; for example, they are generally expensive, inefficient, heavy and cumbersome.

One of the needs in the industry is for a versatile, lightweight and compact lighting apparatus which can diffuse and control light from multiple lights in such a way that the lights are stable, while preferably avoiding the need for expensive lighting instruments such as Fresnel (focusable) lights, and provide a soft, even diffused light for purposes such as key or primary lighting for a stage or set. What is also needed is a device that can project soft light in a controllable way deep into the set evenly from front to back and side to side while having a compact profile to allow for, e.g., cameras underneath and viewers behind. The light could be made to be parallel to and under the microphone booms thus eliminating boom shadows. The light could also be made to come from a similar angle as the cameras eliminating or "burying" shadows behind the objects themselves.

Certain light fixtures have been made for overhead lighting, i.e., above a set or other item needing light. However, many such fixtures generally do not provide an efficient soft projected and consistent light. For example, one configuration known as the "chicken coop" has six 1000-watt bulbs shaped much like household bulbs. These contraptions were originally designed with silver tip bulbs which are opaque on half the round portion of the globe, so that when illuminated in a downwards position the light energy would be directed at the interior roof of the "coop" thus creating a bounced light that is quite inefficient versus amperage drawn. When used with more standard globes (such as 1000 Watt mogul base bulbs without the "silver tip"), the light is unevenly pushed through the lamps themselves and bounced off the light shell, resulting in a very mixed source with limited projection. The color temperature of the bulbs is not ideal for motion picture and other photographic purposes; thus, the interior of the chicken coop unit which acts as the reflector is commonly painted a light blue to "cool off" the warm bulbs. This not only reduces reflection efficiency, but it also causes a different color temperature light to be emitted from the unit, since the reflected light is colder than the direct light when using non silvertip globes. Even if a diffusion screen is used, the light is inconsistent and the bulbs cannot be individually controlled in a traditional chicken coop configuration. Also, sound can be an issue, as dimming of these lamps often results in creation of a hum or noise which is unsuitable for filming with synchronized (live capture) sound.

Sometimes, a long cylindrical fabric sheath with a roughly 30-inch diameter opening is placed around some open globes in a wheel-type configuration known as a "space light." The sides of the sheath can be blackened. One problem with the space light as an overhead light source is that it uses quite a bit of energy for relatively little output. Much of the light is absorbed in the black sheaths and thus does not get transmitted from the opening at the bottom of the sheath. The internal source, being merely globes (and a very narrow strip flat reflector), is not internally or externally focused to project very well through the exit port in the space light. Even when used without the black sheaths, the light output and range of projection is still unimpressive in view of the amount of amperage drawn. The quality of the space light (in terms of softness/color) cannot be easily customized; moreover, multiple shadows are typically created from the space light, and the lamp life is short.

Light diffusion contraptions have been constructed of cardboard or other consumables in a jury-rigged fashion for a long time. Also, a company known as Chimera Lighting of Boulder, Colo., markets among other things cone-shaped soft tent-like members for attachment in front of a lighting source, typically a single Fresnel light.

Recently, a multi-par "soft light cannon" for projecting diffused light has been the subject of patents including U.S. Pat. Nos. 6,106,125, 6,588,912, and 6,719,434. A commercial embodiment thereof, known as the Toplight™ lighting fixture manufactured by FinnLight, Inc. of Malibu, Calif., includes a housing and a fixture that can contain six 1000-Watt Par 64 lamps directed at one or more diffusion element(s) for providing a deeply projected soft light. Another product by FinnLight is the TopBox™ lighting fixture, which is a foldable box with a diffusion element. Up to ten large standard (i.e., Par-64) par lamp cans may be incorporated therein for creating a deeply projected soft light. A lightweight version of the TopBox™ lighting fixture, with an aluminum frame and up to ten standard par lamp cans, is also commercially available. The Maxilight™ 4 k lighting fixture is a four par lamp version designed to incorporate the characteristics of four 1000 w Par 64 lamps while built into a lightweight and well ventilated aluminum housing. A detachable aluminized Nomex™ housing (soft box) with multiple spaced diffusion frames allows for precise control and variable quality of deeply projected and tightly controlled softlight. Soft or hard grids can be utilized on the exit port of this light to further tighten the beam angle of this Soft, projected light source. While the TopLight™, TopBox™ and Maxilight™ 4 k represent significant improvements over the state of the art, it would be advantageous to provide variations thereof that are specifically adapted for particular environments or contexts. For example, high definition television (HDTV) is a relatively new medium that presents challenges because the picture quality is much sharper than conventional television. Some surprised HDTV consumers have tuned in their favorite newscaster only to see less than flattering features due to inappropriate conventional lighting on this sharper display medium. Hence what would be useful for HDTV settings is a softer, more deeply projected and controllable light. In other contexts as well it would be desirable to have soft, projected light created quickly, safely and efficiently to address the evolving needs of new capture and display mediums such as HDTV.

In addition, the amount of lighting, including soft illumination, needed during a film or television shoot varies depending upon the requirements of particular scenes and various factors such as the location, size of the set or stage, available natural lighting, and so forth. At the same time, the amount of room available for lighting may be limited. Such constraints may exist both with diffusion and non-diffusion lighting sources. It would therefore be advantageous to provide an integrated, lightweight lighting apparatus that is flexible, allowing for a variety of options including, e.g., a more precise and controllable light characteristic, which can provide varying degrees of illumination, in a cost effective manner, with a high efficacy (output per watt) and be as compact as possible both in use and for shipping/storage.

SUMMARY OF THE INVENTION

Embodiments of the invention relate, in one aspect, to a versatile lighting fixture which may take the form of a unique multi-component par-type lamp, and to a lightweight, modular unit with multiple par-type lamps of that type.

In certain embodiments, a lightweight modular expandable system of multiple par-type lamps may be configured to form various sizes and intensities of high output area lighting or projected soft light, to be used, for example, on sets for motion picture and television. The lighting apparatus may include a lightweight "stackable" multi-par lamp module, having a lightweight frame and an electrical connector for the par lamps, and an optional diffusion element in front of the par lamps to create a soft, deeply projected light. The size and spacing of the par lamps within the lightweight frame may be such that the modular unit can be "stacked" to achieve double or quadruple the instruments and output with no more than modestly increasing the size of the total unit.

In other embodiments, modular units are connectable and can be combined side-by-side and/or top-to-bottom to form a larger and more powerful source.

The lighting apparatus, alone or in stacked or combined multi-unit arrangements, may be attached to a yoke to be used, for example, in on a stand or hung vertically. Also, the par lamps may be pivotable and/or tilting to provide different angles of projected light.

To increase flexibility and versatility, and to reduce power demands, especially with large numbers of par lamps in close proximity, a par lamp having particular qualities such as high output/efficiency, compactness, interchangeable lenses, smoother field of illumination, a lightweight housing/collar/fixture/pod, and/or multiple globe wattage/type choices may be utilized. The ability to change globe wattage/type, reflector types and lenses, coupled with the ability to stack or interconnect modular units, may provide an extremely flexible lighting apparatus for motion picture, television, and other uses. A simplified, lightweight collar or barrel, for example, that accepts and possibly holds in place the reflector on the rearward end and accepts lenses on the forward end with a generally optimal distance maintained between the reflector and the lens may advantageously reduce size and weight over conventional par lamps, including conventional high-efficiency par lamps. It is also possible that a lightweight reflector and lens combination may be used such that a spacer or collar is not necessary, as the lens could be placed proximate to the reflector. In certain embodiments, a burner (e.g., lamp holder or lamp socket) can be attached from the rear of the reflector to allow rapid bulb replacement. These lightweight, high efficiency par lamps may be configured in multi-par "pods" which in turn may be combined in a lighting frame to form a large lighting unit. One or more dimmers may be coupled to the lighting apparatus to provide a selectable range of illumination. The lighting apparatus may further include mounting receptacles or other means to hold diffusion a diffusion element (such as an opaque or light-transmissive fabric box or hood, possibly with multiple integrated or customizable diffusion layers or baffles).

Other embodiments, variations and modifications are also disclosed herein.

BRIEF DESCRIPTION OF THE DRAWINGS

FIGS. 22A, 22B, 22C and 22D are diagrams showing another embodiment of a multi-par lighting unit with an optional removable diffusion frame and fabric cover, having a controllable side-projected light diffusion feature.

DESCRIPTION OF THE PREFERRED EMBODIMENT(S)

Figure 1A:
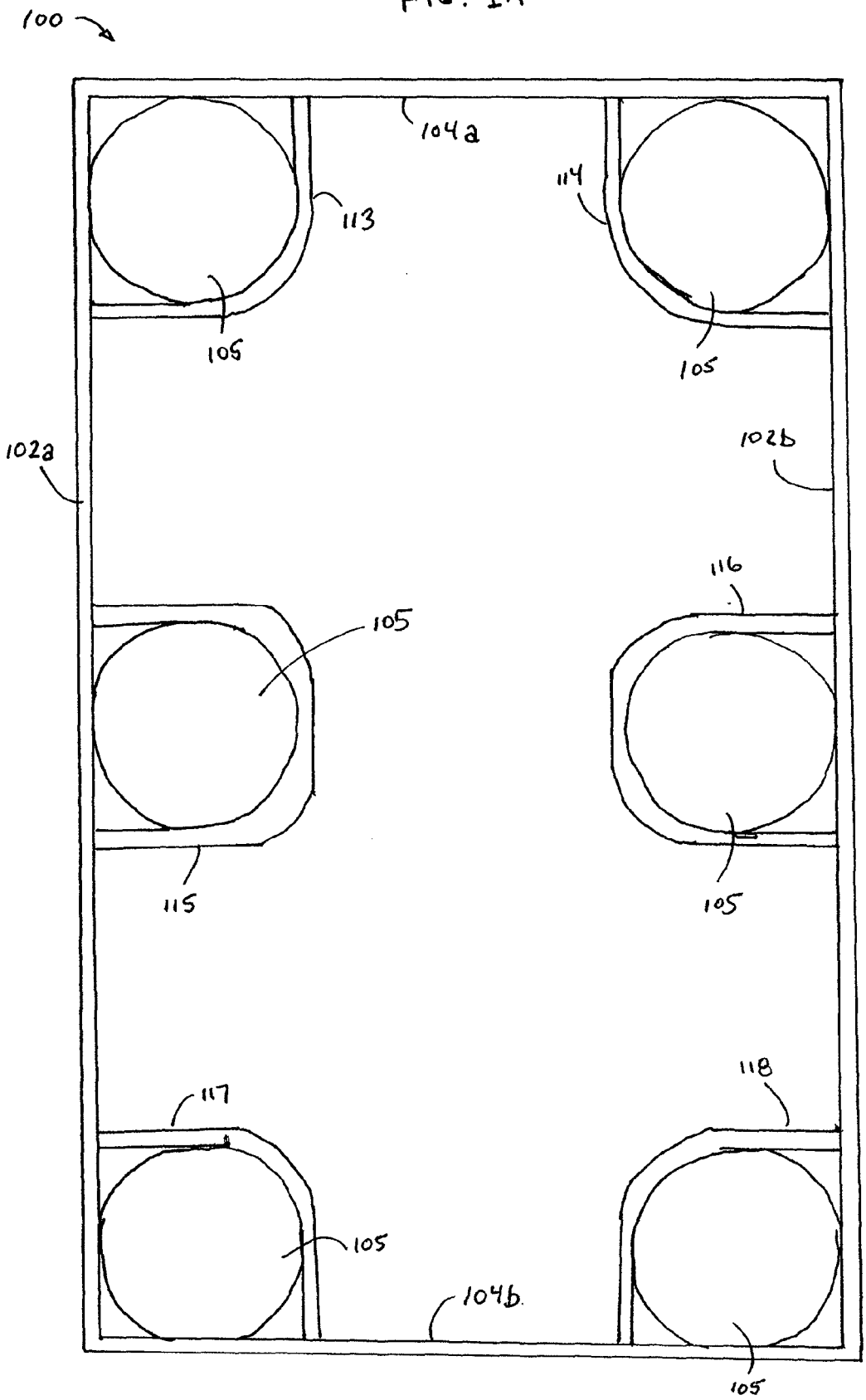
FIG. 1A is a front view diagram of a lightweight modular lighting unit with multiple par lamps, in accordance with one embodiment as disclosed herein.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Various embodiments as disclosed herein pertain to a lightweight modular expandable system of multiple par lamps that can be enclosed in housings to form various sizes and intensities of high output projected softlight, to be used, for example, on sets for motion picture and television. Though not limited to the use of nonfocusable lights, certain embodiments of a novel lighting apparatus as disclosed herein make the use of inexpensive par-type lamps practical. Such lamps generally have an internal parabolic reflector which creates an extremely parallel beam of light. This "punchy" light can be ideal to project through diffusion mediums to soften the resultant light, while retaining much of the deep throw inherent in the lamp. When combining par lamps of various intensities (i.e., wide and medium beams at specific distances through diffusion frames), it is possible to create a light that is more consistent from upstage to downstage than a point source or more traditional lighting instruments, using certain embodiments as disclosed herein.

One preferred lighting apparatus includes a lightweight "stackable" multi-par lamp module, consisting of multiple par-type lamps (e.g., six) and a lightweight aluminum frame containing the wiring for the par lamps with an electrical connector such as a Socopex™ connector box or equivalent, i.e., a multiconnection electrical box connected to the lamps. An apparatus so constructed can perform similarly to a conventional multi-par diffusion box, and can be stacked to achieve double or quadruple the instruments and output with only modestly increasing the size of the total unit. Tremendous versatility can be achievable by having a number of the modular units available, as they can be used in a multitude of ways. For example, as single units with a diffusion element the modular lighting apparatus can function as a conventional multi-par diffusion box, but lighter in weight and less expensive. The modular units can be combined side-by-side to form a larger and more powerful source (e.g., 54"×72" in size). With six par lamps per module, for example, such a side-by-side unit would have 12 par lamps in a desirable size of 4½×6 feet. The ability to join multiple modular units together into larger units (banks of light) can be particularly useful in the motion picture, television and entertainment industries, where different lighting configurations are often needed on the fly.

Likewise, connecting two of the stacked "double units" side by side could result in a 24-light unit of roughly 6×9 feet, made up of four of the modular 6-light components. Using high-efficiency par type lamps/pods of the variety described later herein, with 575 Watt globes, such a combined lighting unit could be powered by a single Socopex™ connector. This same approach can be extrapolated further, so that the 24-light unit can be joined with another like unit to form a 48-light unit having dimensions of 9×12 feet, and again two of these larger units can be joined side by side to form an even larger 96-light unit having dimensions of 12×18 feet. In each of these configurations, the lighting unit would be relatively lightweight as compared to conventional lighting fixtures, yet would be quite powerful with generally evenly spaced lamps that would be most useful in especially large scale motion picture productions. These units may be hung with chain motors to control their positioning. Individual pods of lights as described herein (see, e.g., FIGS. 7A-7C described later) may also be cojoined in lightweight frames—for example, frames made from antenna truss wrapped with diffusion material on the front, and possibly enclosed in the back with an opaque material.

Referring now to the drawings where like numerals of reference designate like elements throughout it will be noted that in FIG. 1A, a front view diagram is illustrated of a lightweight modular lighting unit 100 with multiple par lamps 105, in accordance with one embodiment as disclosed herein. As shown in FIG. 1A, the modular lighting unit 100 comprises a rectangular frame with two frame members 102*a*, 102*b* forming the long sides of the rectangular frame and an additional two frame members 104*a*, 104*b* forming the short sides of the rectangular frame. The frame members 102*a*, 102*b*, 104*a*, and 104*b* may be bolted, riveted, welded or otherwise connected together. In the embodiment illustrated in FIG. 1A, the modular lighting unit 100 has six par-type lamps 105 preferably constructed in accordance with the principles described later herein with respect to FIGS. 2A and/or 2B, although other par-type lamps may also be suitable. The par-type lamps 105 are affixed to the frame by retaining elements 113, 114, 115, 116, 117 and 118, which may also be bolted, riveted, welded or otherwise connected to the frame members 102*a*, 102*b*, 104*a*, and 104*b*.

The various frame members 102*a*, 10*b*, 104*a*, 104*b* and retaining elements 113 through 118 may, for example, comprise rectangular tubing, and are preferably formed of a lightweight but strong material such as aluminum, although in other alternative embodiments they may be formed of different materials as well. For example, the frame members 102*a*, 10*b*, 104*a*, 104*b* and retaining elements 113 through 118 may be constructed of standard 1½" or 1⅝" pipe (e.g., Speed Rail™) or other cross-members on which multiple lights may be mounted. The lighting unit 100 may be provide with an angle (not shown) at its front end for directing light towards a set or stage when the box is elevated with respect thereto. Preferably, the back side of the lighting unit 100 is open which allows for venting of the lamps 105, as well as easily mounting them, disconnecting them, electrical line access, and positioning thereof, although it is also possible ot incorporate a rear cover (ventilated or not) for protection and to control any light spill.

In one or more embodiments, the modular lighting unit 100 is adapted to be used with a diffusion element or cover in order to create a projected soft light. Techniques for attaching or adding a diffusion element to a lighting unit frame are disclosed, for example, in U.S. Pat. Nos. 6,106,125, 6,588,912, 6,719,434 and 7,204,617, all of which are assigned to the assignee of the present invention and hereby incorporated by reference as if set forth fully herein.

Figure 12:
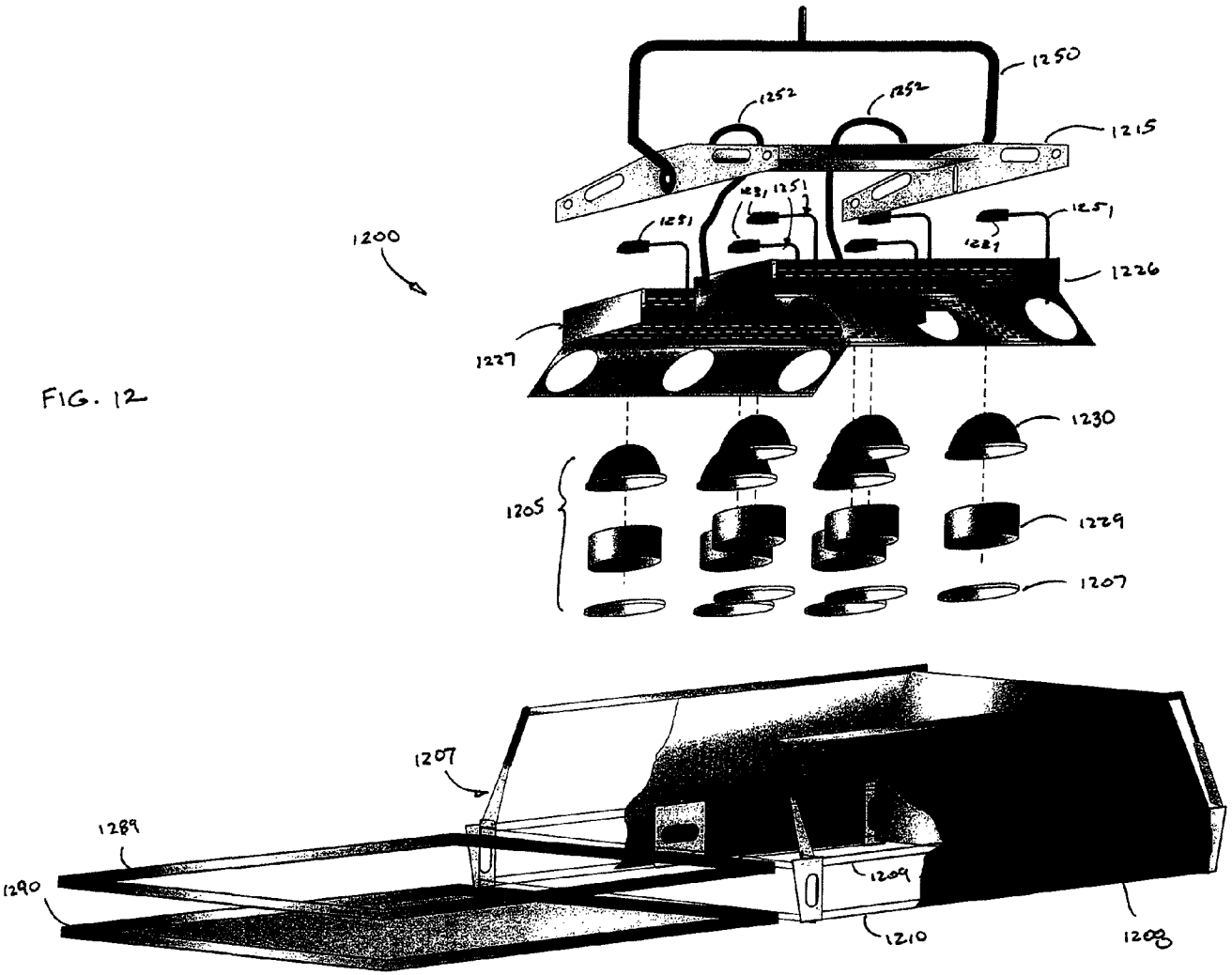
FIG. 12 is an assembly diagram of a multi-par light unit with an optional removable collapsible diffusion frame and fabric cover, in accordance with one embodiment as disclosed herein.

One example of a lighting unit in the form of a versatile lighting box 1200 and including a diffusion element is illustrated in FIG. 12, described in more detail later herein.

Where the modular lighting unit 100 is designed to be used in conjunction with a diffusion element, e.g., a diffusion box, it may be advantageous to configured the dimensions of the modular lighting unit 100 and the lamps 105 so that the diffusion space is as evenly filled as possible. This leads to, among other things, more uniform application of the soft projected output light on the subject to be illuminated. Thus, the dimensions of the lighting unit frame and the lamp spacing preferably take account of the surface area of the lighting output surface of the diffusion element relative to the size and shape of the lighting unit frame. As illustrated now in FIG. 1B, for example, the dimensions of the modular lighting unit 100 in FIG. 1A are preferably arranged so as to disperse light more evenly and uniformly onto a diffusion element or surface. More specifically, the spacing of the lamps 105 is selected so that if the diffusion surface 150 is divided into even sized squares 152, each lamp 105 is substantially centered with respect to one of the squares 152. In the particular example illustrated, with lamps 105 are embodied as 7" par-type lamps, the dimensions of lighting unit frame 100 may be approximately 25"×43" (that is, frame members 102*a*, 102*b* are approximately 43" in length and frame members 104*a*, 104*b* are approximately 25" in length) and the diffusion element 150 may be a standard 36"×54" in size, so that if the surface of diffusion element 150 is divided into substantially even-sized 18" squares 152 then each lamp 105 substantially centered within each square 152. In this example, the center-to-center spacing of lamps 105 is approximately 18" whether considering lamps 105 along the same row or along the same column.

Appropriate selection of frame dimensions and lamp spacing may thus achieve an affect whereby the lamps 105 fill a diffusion frame of a particular size (e.g., 3'×4½') equally and uniformly. The same techniques as described with respect to FIG. 1B can be extrapolated to other size lighting units, with more or fewer lamps, in order to get optimal equal distribution of illumination to the diffusion fill or subject. In general, according to one strategy, the spacing of the lamps may be selected so that if the diffusion surface is divided into even sized squares, each lamp is substantially centered with respect to one of the squares. Another example is illustrated in the 6-light unit of FIG. 12 described later herein, wherein the four corner par-type lamps are positioned to be in the center of each quadrant of the diffusion frame thus allowing for even dispersion using four corner lights or for maximum output with the two center lights added.

Figure 2A:
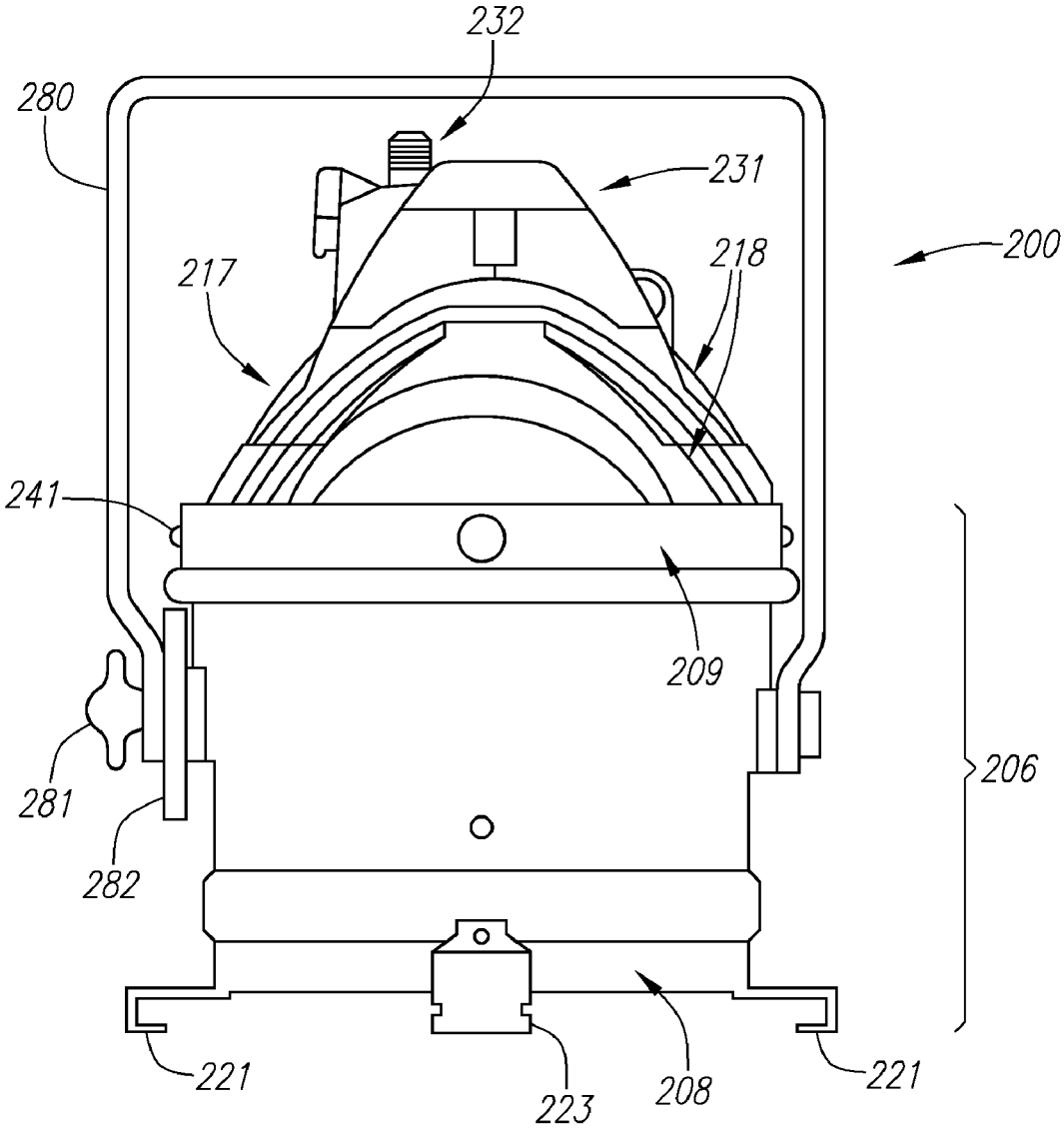
FIG. 2A is a side view diagram of a par-type lamp as may be used, for example, in the lighting unit illustrated in FIG. 1A.

Using Par 56 (7") size par-type lamps in embodiments of the lighting unit 100 of FIG. 1A instead of larger (e.g., Par 64 or 8" wide) par lamps, and particularly 7" high-efficiency par-type lamps (preferably including the combination of globe, reflector, burner etc.) as constructed in accordance with FIGS. 2A and/or 2B, may have various benefits including reduced size and weight, particularly where numerous lamps are required. Even so, the smaller lamps do not necessarily result in a loss of performance, because with high efficiency par-type lamps of the type shown in FIG. 2A or 2B, a comparable lighting output may be achieved when compared to conventional glass sealed beam 8" Par 64 lamps while using significantly less power (e.g., over 40% less power). Preferably, the par-type lamps used in the embodiments described herein are specified for "universal" burn position such that the lighting fixtures may be oriented at various different angles, including hung in a downward-facing position.

Figure 1B:
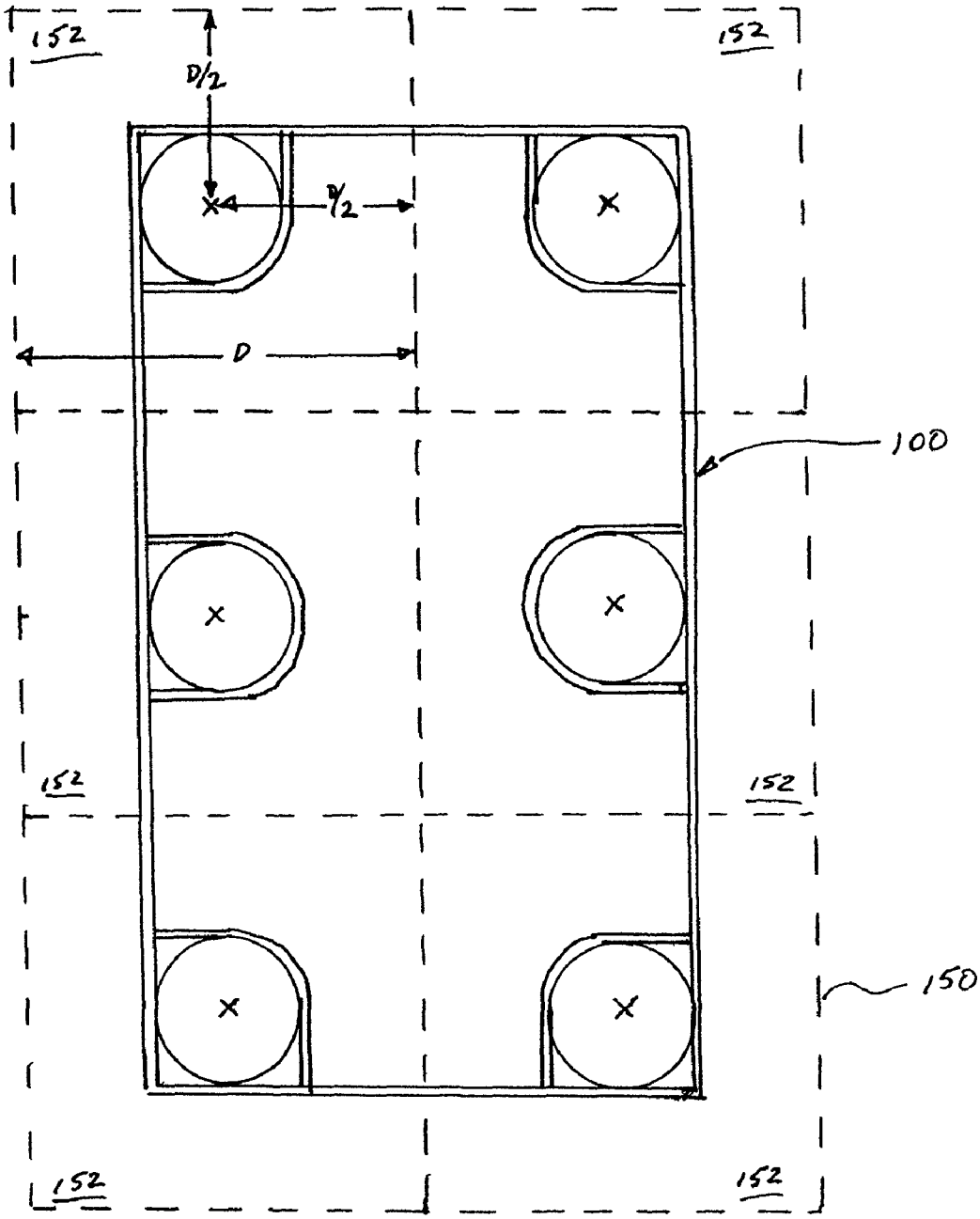
FIG. 1B is a diagram illustrating an example of certain dimensions for the lighting unit of FIG. 1A.

FIG. 2A illustrates a preferred high efficiency par-type lamp and, in particular, is a side view diagram of a high efficiency, multi-component, non-sealed beam par-type lamp 200 as may be used, for example, in the lighting apparatus illustrated in FIGS. 1A-1B and in other embodiments disclosed herein. As illustrated in FIG. 2A, the high efficiency par-type lamp 200 comprises a par-type reflector 217, a lightweight barrel-shaped collar 206, and a high-efficiency burner 231 (such as an HPL, compact-filament or other high-efficiency globe socket/burner), a portion of which is shown protruding from the rear portion of the reflector 217, to which a high-efficiency globe (not shown in FIG. 2A but internal to the lamp 200), such as, e.g., an HPL, HX 600, or HPR globe, can be attached. Although certain examples are described, a high efficiency globe is intended to include HPL type globes as well as other high performance or compact filament globes (such as HPR 575, HPR FLK, and HX 600 types) which achieve a substantial power reduction over traditional par globes for equivalent levels of illumination.

The reflector 217 and collar 206 may be made of a lightweight metal such as aluminum, although it may be made of other materials as well. The collar 206 in particular may be made of spun aluminum (rolled thin gauge as in 0.050 aluminum for example), lightweight carbon fiber, high temperature polymeric (plastic), or other materials that lend themselves to a simple process and result in a lightweight but sturdy, heat-resistant structure. The reflector 217 is preferably concave and generally parabolic in shape, although it may be optimized to reflect maximum illumination for a high-efficiency globe. The reflector 217 may be highly polished with a fluted or slightly grooved or faceted surface, to maximize the reflected light from the internal HPL or other high efficiency globe. In a particular embodiment, the reflector 217 may be of the type provided in the commercial Source Four par lamp made by ETC and described previously herein, or as illustrated and described in U.S. Pat. No. 5,345,371 to Cunningham et al, hereby incorporated by reference as if set forth fully herein. However lightweight spun or stamped aluminum reflectors may be used to decrease the weight significantly over the cast aluminum in the Source Four Par design. The facets or grooves may extend radially from the center base of the reflector (where the globe is positioned), and may be increased in number with increasing distance from the reflector's base, as described for example in U.S. Pat. No. 5,345,371. The reflector 217 may be constructed of a borosilicate glass coated with thin-film layers of a dielectric coating, having a higher reflectance at visible light wavelengths than infrared wavelengths, thereby reducing the amount of projected infrared light and undesired heating of objects within the beam. The reflector 217 may also have one or more fins 218 designed to help dissipate heat. The reflector 217 may also have a protective cover to protect the user from heat. It may be advantageous depending on desired beam spread, heat properties, and so on to make the reflector 217 available in various shapes and sizes, including both Par 56 and Par 64 sizes or other sizes, such that the reflector 217 can be swapped as needed to achieve a desired lighting effect.

In the particular example of FIG. 2A, the lightweight barrel-shaped collar 206 may comprise a lip or section 207 which overlays the reflector 217, to provide a stable means of securing the collar 206 and reflector 217 together. The collar 206 may further have a lens retaining portion 208 which may, for example, including slots or detents 221 for receiving a lens (not shown), and a spring-steel clip 223 for attaching the lens, or a retaining ring as used in certain conventional sealed beam canister-type par lamps. Extension tubes of different lengths, with optional gel frame holders on the end, may be added to the collar 206 as needed to control spill and/or hide the lamp 200 from view. Where used as a standalone light fixture, the high-efficiency par-type lamp 200 may include a handle/yoke 280 for hanging or mounting the fixture. A rotating knob 281, for example, may be used to allow adjustment of the handle.

Figure 2B:
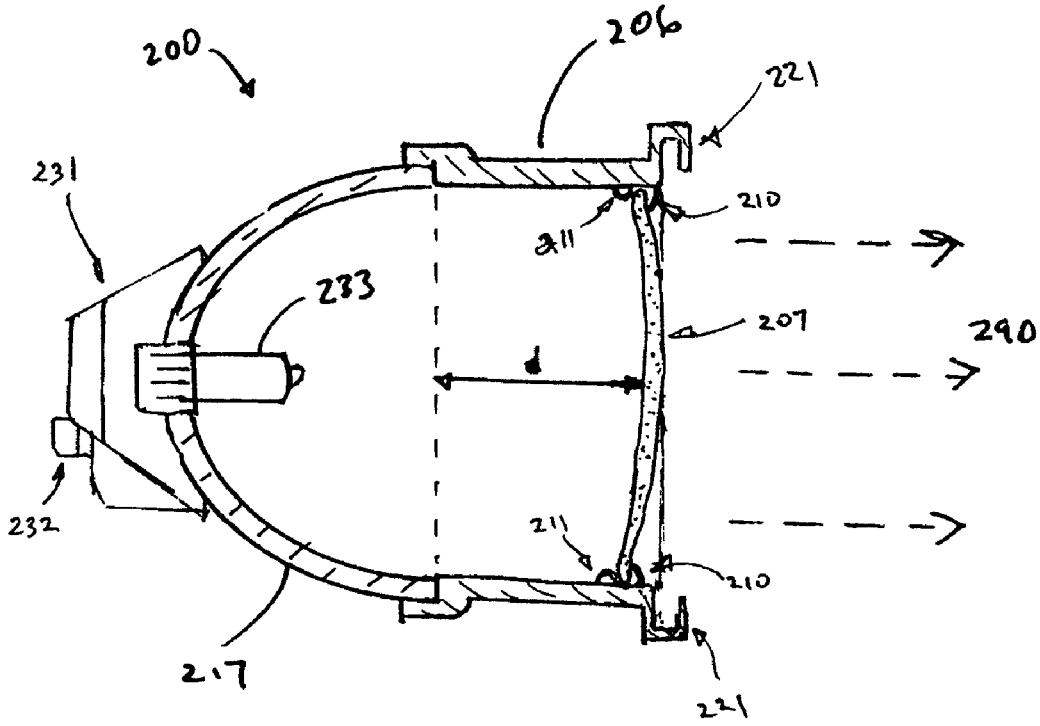
FIG. 2B is a simplified cut-away side view diagram of the par-type lamp of FIG. 2A.

The high-efficiency par-type lamp 200 preferably utilizes a compact HPL or other high efficiency globe as previously described for burner 231, of the type described, for example, in U.S. Pat. No. 5,628,213, previously incorporated by reference as if set forth fully herein, and/or of the type commercially manufactured by General Electric Corporation. FIG. 2B is a simplified cross-sectional illustration of a high-efficiency par-type lamp 200 such as shown in more detail in FIG. 2A, but illustrating placement of the high-efficiency globe 233 and burner unit 231 in the lamp 200. The HPL globe 233 generally may include an incandescent lamp element having a plurality of linear helically-wound filaments arranged with their longitudinal axes substantially parallel with, and spaced symmetrically around, the longitudinal axis of the concave reflector 217, as described in U.S. Pat. No. 5,628,213, or else may take the form of another type of high efficiency par globe (such as the various HPR series globes previously mentioned). The lightweight collar 216 is preferably designed to securably hold a lens 207 an optimal distance from the globe 233. For example, with a par-56 (seven inch) par-type lamp, the lens 207 may be positioned approximately 3.5 inches in front of the reflector 217 (shown as distance "d" in FIG. 2B). In the particular example of FIG. 2B, the lens 207 is held in place by an interior ring 211 within collar 206 and multiple flanges 210 which pin the lens 207 against the ring 211, although other techniques for securing the lens 207 may be used as well. A gel or diffusion element (not shown in FIG. 2B) may be placed in front of the lens 207 and retained in slots 221. The burner 231 may be conveniently removed from the rear of the reflector 230 by, e.g., unscrewing a knurled knob 232, or with any other detachment means provided.

The simplified par-type lamp 200 of FIG. 2A or 2B may be very useful in a lighting unit such as illustrated in FIG. 1A, or in other lighting units as disclosed herein, or as a single standalone lamp/fixture. The simplified construction allows the high-efficiency par-type lamp 200 to be readily assembled from a minimal number of components, and readily disassembled. Optimally, the heat fins 218 can be eliminated from the reflector 217, making it even more lightweight. Rather than using a bulky cast-metal housing with numerous heat-dissipating fins, such as is done in certain conventional designs, the reflector 217 and burner unit 231 can be combined with a simple lightweight collar 216, which is designed to hold the lens 207 an optimal distance from the globe 233. The general need for heat-dissipating fins and the like can be eliminated because, when employed in a lighting unit such as 100 of FIG. 1A the holding ring (e.g., 113 to 118) and frame serve to convey heat away from the lamps 200 and thus help with cooling, although the lamp 200 might still be expected to be hot to the touch. The addition of perforations to aid in convection cooling may also be possible to mitigate the need for heavy cast aluminum heat sinks. The result is a very lightweight, powerful, and energy efficient lamp that can find many useful applications, particularly in multi-lamp lighting units where size, weight, an/or efficiency can be of significant importance.

The manner of affixing the high efficiency par-type lamp 200 to the frame of a multi-par lighting unit (for example, the lighting unit illustrated in FIG. 1) may be accomplished in any of a variety of ways. For example, the high-efficiency part-type lamp 200 may be secured with a retention or holding ring 113 to 118, which may be affixed to the frame members 102*a-b* and/or 104*a-b* by, for example, standard lug nuts at each end of the holding ring or welded to the frame. In some embodiments, the lightweight collar 206 may comprise a lip or other extensions (not shown) which overlay the frame member(s) 102*a-b* and/or 104*a-b* and/or the particular lamp's holding ring 113-118, to provide a stable means of securing the collar 206 to the lighting unit frame. The reflector 217 may likewise have a lip which generally matches the collar lip. The reflector lip and collar lip may have threaded screwholes which align with one another, so that press nuts and bolts (possibly with wing ends) can be used to secure the reflector 217 and collar 206 simultaneously to the frame member(s) and lamp's holding ring 113-118. Alternatively, the collar 206 may be secured by itself to the frame member(s) and/or holding ring 113-118 through, e.g., fastening means such as lug nuts, while the reflector 217 may then be held in place by one or more flanges with snapping clips or wire loops (not shown) which are pivotably attached to the frame member and/or holding ring. In other alternative embodiments, the holding ring 113-118 for a particular lamp may form all or part of collar 206.

In various embodiments, the high-efficiency par-type lamp 200 may provide substantial advantages and benefits over conventional high-efficiency par lamps. With its simpler construction, the high-efficiency par-type lamp 200 may be significantly less in weight yet still retain the approximately 40% improvement in power efficiency over standard sealed beam par lamps of similar output (and light pattern). These benefits are significant and cumulative when the high-efficiency par-type lamp 200 is utilized in a multi-lamp lighting unit such as that of FIG. 1A or other embodiments disclosed herein. In a six-light lighting unit, such as shown in FIG. 1A, the cumulative weight savings is in the area of 24 pounds, which is significant for a lighting unit that is intended to be portable in nature, manually maneuvered, and affixed to yokes and/or hung from ceilings, scaffolding or a green bed, all of which generally involves manual transport of the lighting unit. Likewise, the small footprint (especially when stacked) yields similar benefits. Often, dozens of lighting units are needed for a film set or stage, so having a lightweight and compact lighting unit can provide significant advantages when numerous units are needed. The high efficiency nature of the lamp 200 means that a single lighting unit with multiple lamps is more likely to be useable with a standard wall outlet and yet have the output of a much higher amperage unit. The high-efficiency par-type lamp 200 of FIG. 2A can also be constructed in a more cost efficient manner, and thus a lighting unit utilizing such a lamp 200 can be far less expensive than conventional HPL-based par lamps which are, for example, constructed with a sealed reflector housing, numerous heat sink fins and baffles, and a steel yoke, and which can be time-consuming to disassemble due to their numerous components. The high-efficiency par-type lamp 200 may not only be much lighter and less expensive to make than other high efficiency par-type lamps, but also, because of the nature of its barrel-shaped collar 206, may be outfitted with an adjustable longer barrel to control light or hide the source from view.

Figure 20:
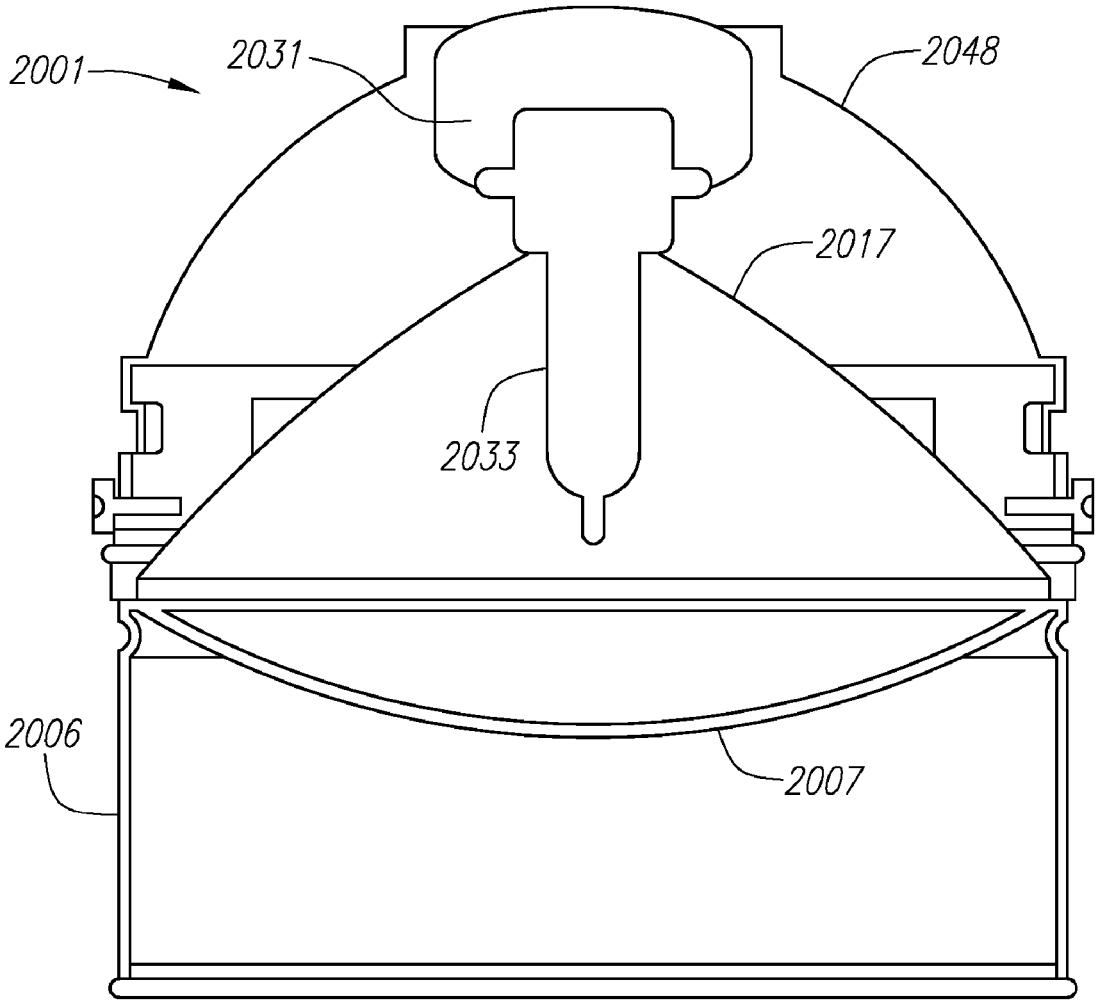
FIG. 20 is a diagram of a high efficiency par lamp with a removable burner as may be used in connection with various multi-par lighting units as disclosed herein.

In alternative embodiments, the par lamps may be constructed without a collar 206, which may be advantageous in certain situations, and may likewise be used in connection with various multi-par lighting units as disclosed herein. An example of such a par lamp 2001 is illustrated in FIG. 20. In this embodiment, a high efficiency par lamp 2001 comprises a par-type reflector 2017, a high-efficiency globe 2033 and associated burner unit 2031 (such as an HPL, compact-filament or other high-efficiency globe socket/burner such as previously described), and a lens 2007. As described before, a high efficiency globe 2033 is intended to include HPL type globes as well as other high performance or compact filament globes (such as HPR 575, HPR FLK, and HX 600 types) which achieve a substantial power reduction over traditional par globes for equivalent levels of illumination. The high efficiency par lamp 2001 is preferably Par 56 in size, which allows for construction of lighting pods and fixtures (as described later herein) with high candlepower output while being significantly lighter than conventional Par 64 based fixtures. In the example shown in FIG. 20, the par lamp 2001 is shown with a protective back cover 2048 which can hold the burner unit 2031, and cylindrical extension 2006 which may further direct the beam in a forwardly direction.

The reflector 2017 is preferably a unitary piece made of a lightweight material that is highly reflective, such as aluminum, although it may be made of other materials as well including composites such as heat-resistant high temperature plastic or lightweight carbon fiber coated with aluminum. The reflector 2017 in particular may be made of spun or pressed aluminum (rolled thin gauge as in 0.050 aluminum for example), lightweight carbon fiber, high temperature polymeric (plastic), or other materials that lend themselves to a simple process and result in a lightweight but sturdy, highly reflective, heat-resistant structure. The reflector 2017 is preferably concave and generally parabolic in shape, although it may be optimized to reflect maximum illumination for a high-efficiency globe. The reflector 2017 may be highly polished with a fluted or slightly grooved or faceted surface, to maximize the reflected light from the internal HPL or other high efficiency globe. In a particular embodiment, the reflector 2017 may take the interior shape of the reflector provided in the commercial Source Four par lamp made by ETC and described previously herein, or as illustrated and described in U.S. Pat. No. 5,345,371 previously incorporated by reference herein. The facets or grooves may extend radially from the center base of the reflector (where the globe is positioned), and may be increased in number with increasing distance from the reflector's base, as described for example in U.S. Pat. No. 5,345,371.

In other embodiments, the reflector 2017 may be shaped according to the techniques described in U.S. Pat. Nos. 7,131,749 or 6,744,187. The reflector 2017 may also include a spherical "bowl-shaped" depression behind the burner 2031 to aid in cooling.

In a preferred embodiment, the burner 2031 may be manually removable from the rear of the par lamp 2001 to facilitate rapid replacement of the globe without, for example, having to remove the lens 2007 or otherwise disassemble the par lamp 2001. The reflector 2017 may have an opening so the bulb can be inserted into the reflector 2017 from the rear. If the par lamp 2001 is disposed in a multi-lamp pod or other similar unit, then the end cap or protective rear cover of the pod may likewise include an access port or other similar means to access the globes from the rear thereof. The burner 2031 may include a "female" portion which can be affixed to the lamp cap or attached (recessed) into (or flush with) the rear cover of the pod with a cutout to allow a "male" portion of the base, which could contain a standard lamp base or could be affixed to a bulb either with protruding contacts that will mate with the female side of the burner assembly to secure the bulb in the proper position and electrify same through the "male" blades and a "female" recepticle that remains positioned at the rear of the reflector 2017 allowing for a fast "bayonet" style globe replacement from the rear of the par lamp or pod 2001.

The burner 2031 also preferably has wing-shaped protrusions which allows it to twist-lock into place, being held by matching receptors in the female side of said lamp base/burner to secure it in the proper position at the entrance port in the back of the reflector 2017. The removable burner design may, for example, be similar to the modular Lok-It! lamp/base system commercially available from OSRAM Sylvania. The burner 2031 may comprise a unitary ceramic lamp base having a broad handle for a secure grip when removing the burner 2031 for globe replacement.

Alternatively, the burner can be connected to the back (or "cap") of the par lamp so the whole cap bayonets in and twist-locks. In other embodiments, the burners in a multi-par pod unit can be attached to the cap or rear cover of the pod so that they can be disconected from the rear and pulled out. As another alternative, the pod may have a cover like a trap door so it can be opened to reveal the burner assembly which can be pulled out with the wires attached to replace the lamp.

Figure 24A:
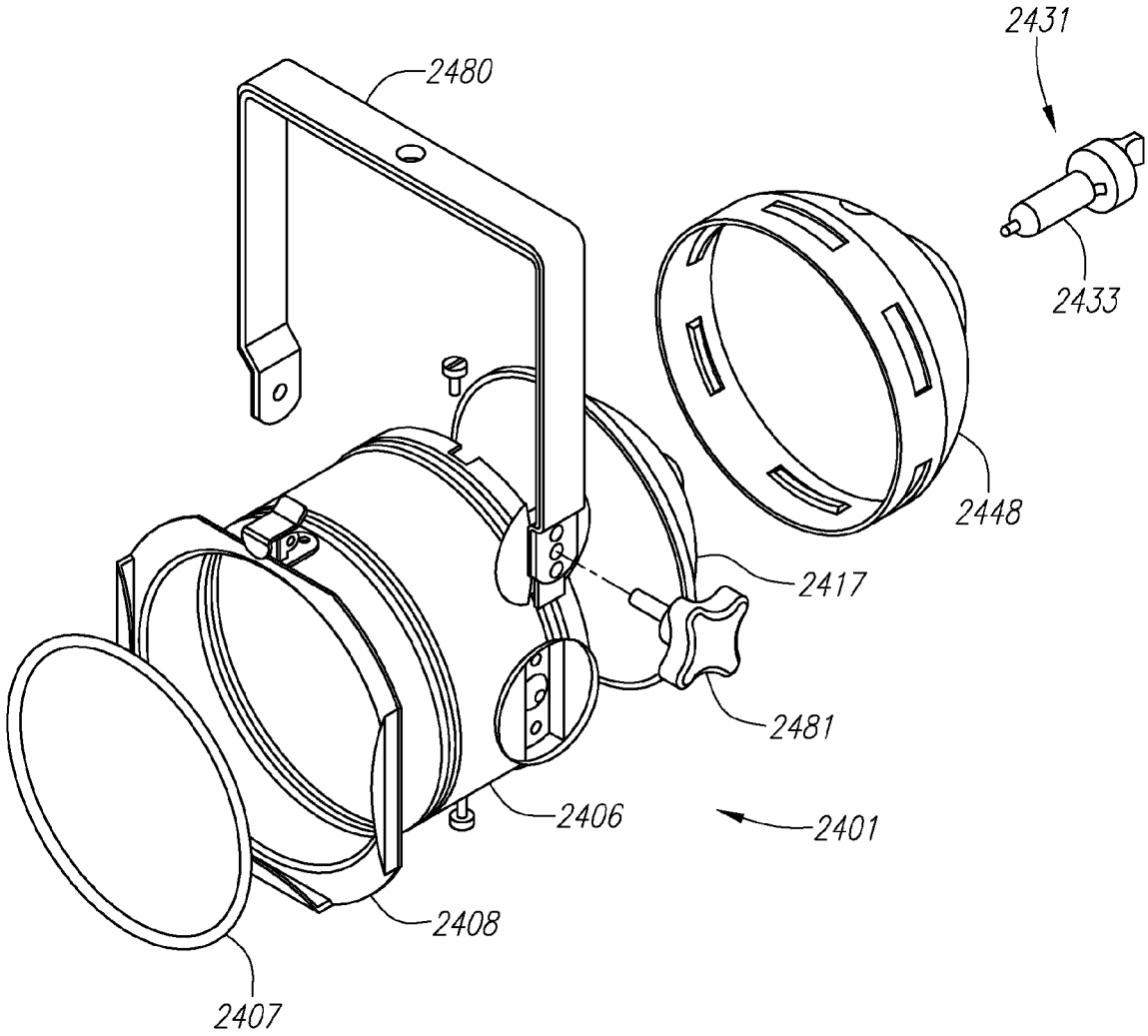
FIGS. 24A, 24B, 24C and 25 are diagrams of alternative embodiments of a high efficiency par lamp with a rear removable burner.

FIGS. 24A, 24B, 24C and 25 are diagrams of alternative embodiments of a high efficiency par lamp with a rear removable burner. FIG. 24A, for example, shows an exploded view diagram of a high efficiency par lamp 2401 having a par-type reflector 2417, a high-efficiency globe 2433 and associated burner unit 2431 (such as an HPL, compact-filament or other high-efficiency globe socket/burner such as previously described), and a drop-in lens 2407, which may be combined in a single-par can or else used in a multi-par fixture. The high efficiency globe 2433 may be any of the types described elsewhere herein. The high efficiency par lamp 2401 is preferably Par 56 in size and, in this example, includes a protective back cover 2448 which holds the burner unit 2431, and cylindrical extension 2406 which may further direct the beam in a forwardly direction. A lens retainer 2408, including slots or detents, may be provided for, e.g., receiving a lens or filter (not shown). The burner unit 2431 may include a twist-lock attachment mechanism as previously described, to facilitate rapid removal of the burner unit 2431 and replacement of the globe 2433.

Figure 24B:
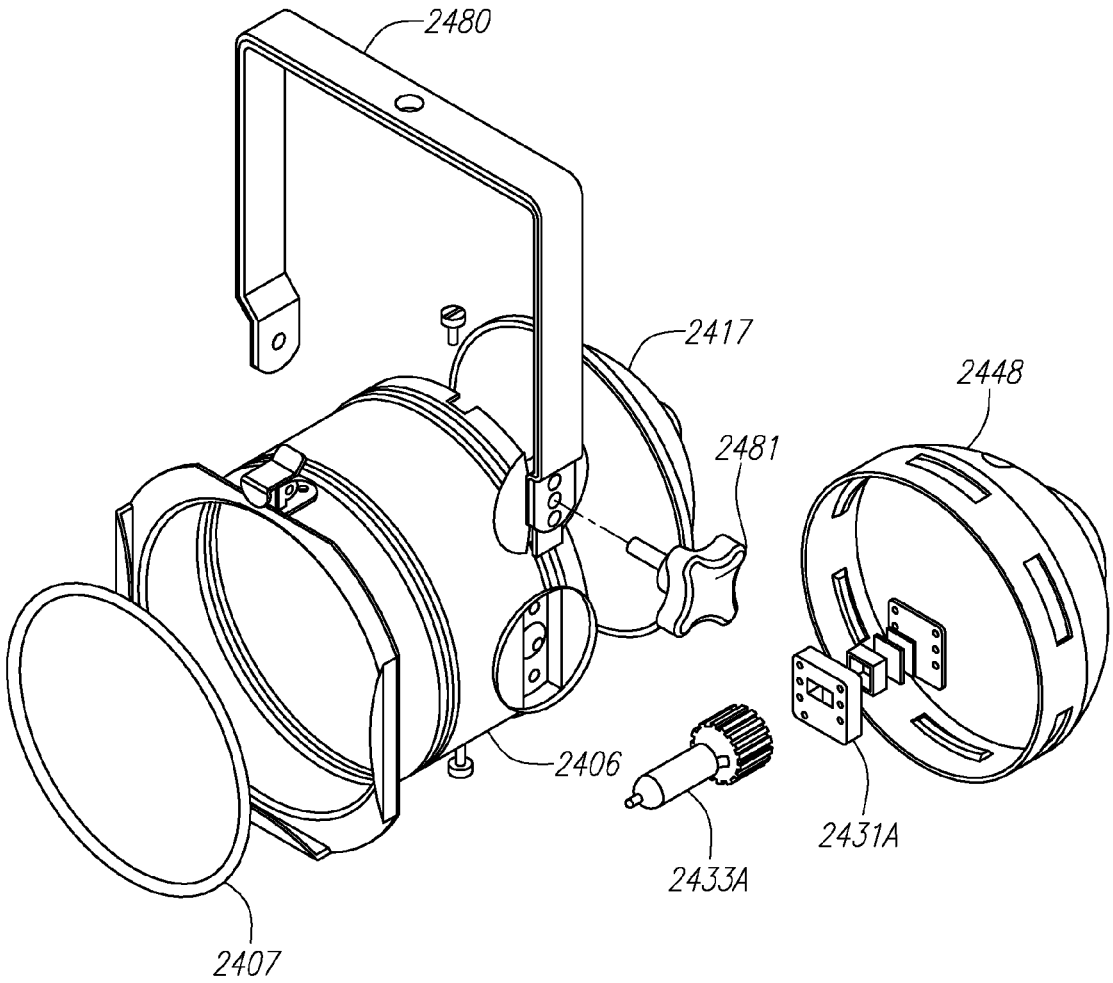
Figure 24C:
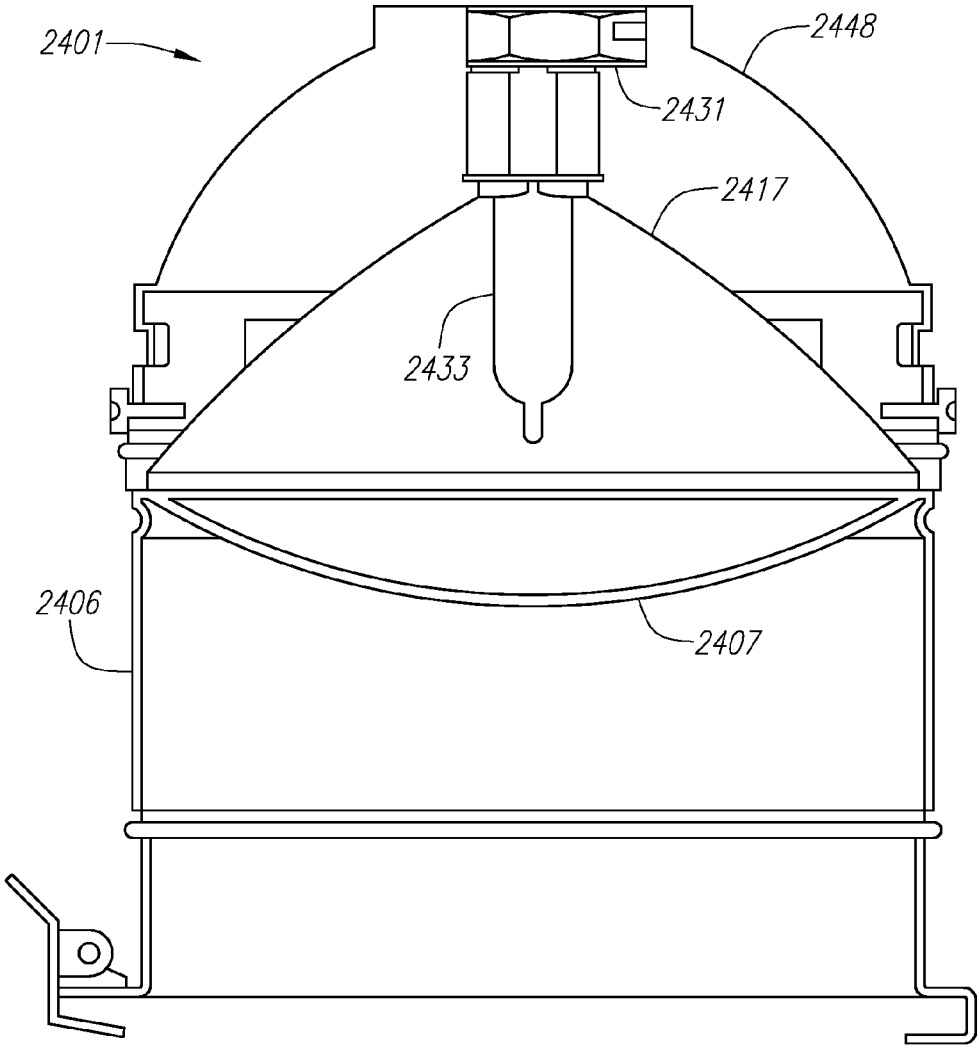

FIG. 24B illustrates a slight variation of the par lamp 2401 in FIG. 24A, having a slightly different burner and globe design. In this example the par lamp has a standard bG 9.5 base which may have an insulator surrounding the base, so that it could be removed from the rear or else possibly affixed to the inside of the par cap which in turn would be bayonet-connected at the mid point. FIG. 24C shows the par lamp of FIG. 24B in assembled form.

Figure 25:
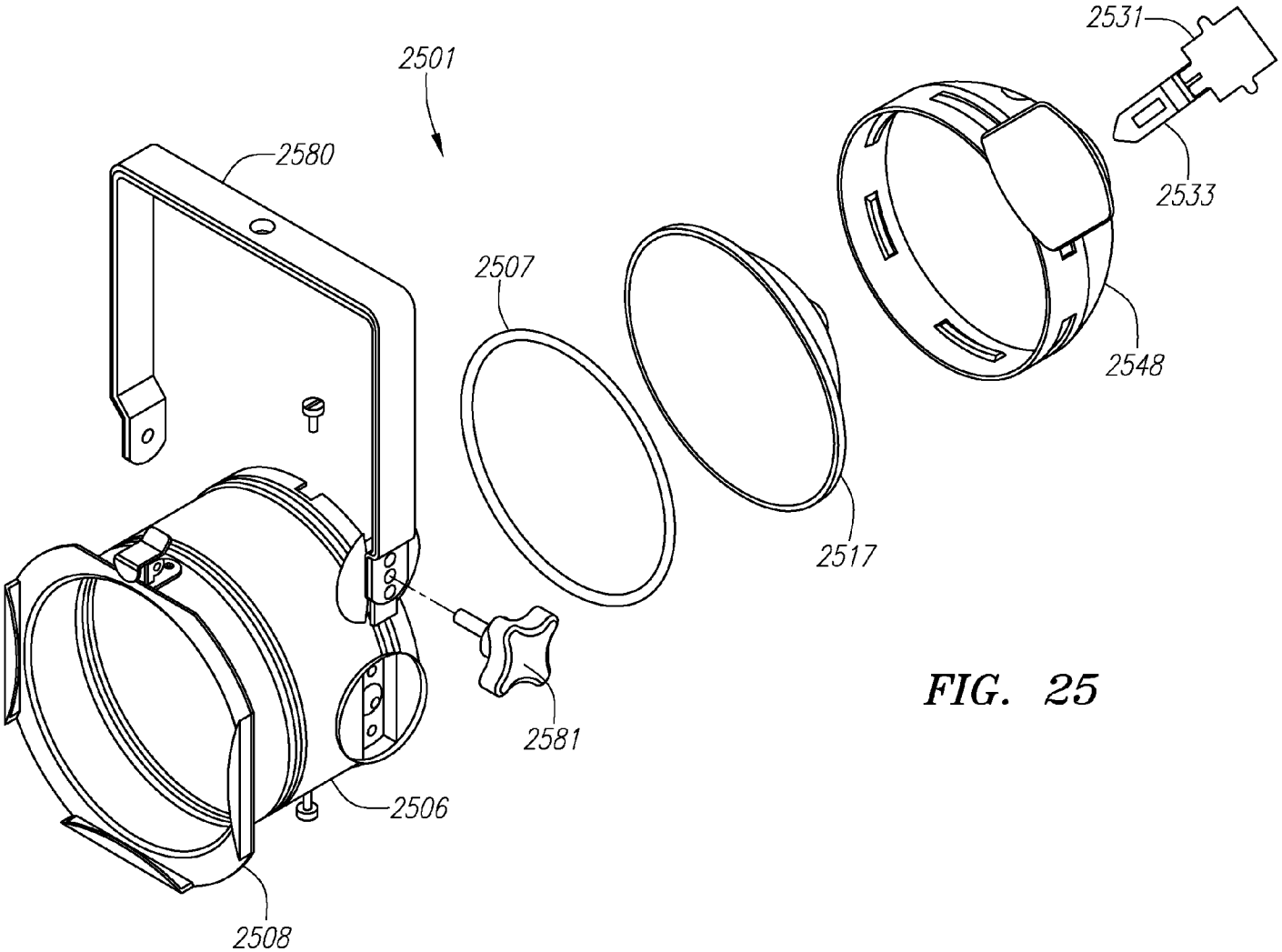

FIG. 25 illustrates another variation of a high efficiency par lamp similar to the par lamp 2401 in FIG. 24A, except having the lens 2507 insertable in the middle as opposed to being a drop-in lens.

In other embodiments, the par lamps may comprise, for example, the OSRAM aluPAR® 56 series of lamps, commercially available from OSRAM Sylvania. These par lamps are estimated to be 66% lighter and 10% brighter than conventional halogen Par 56 lamps. The OSRAM aluPAR includes, among other things, a reflector which is fastened by crimping to the par lamp lens.

Figure 3B:
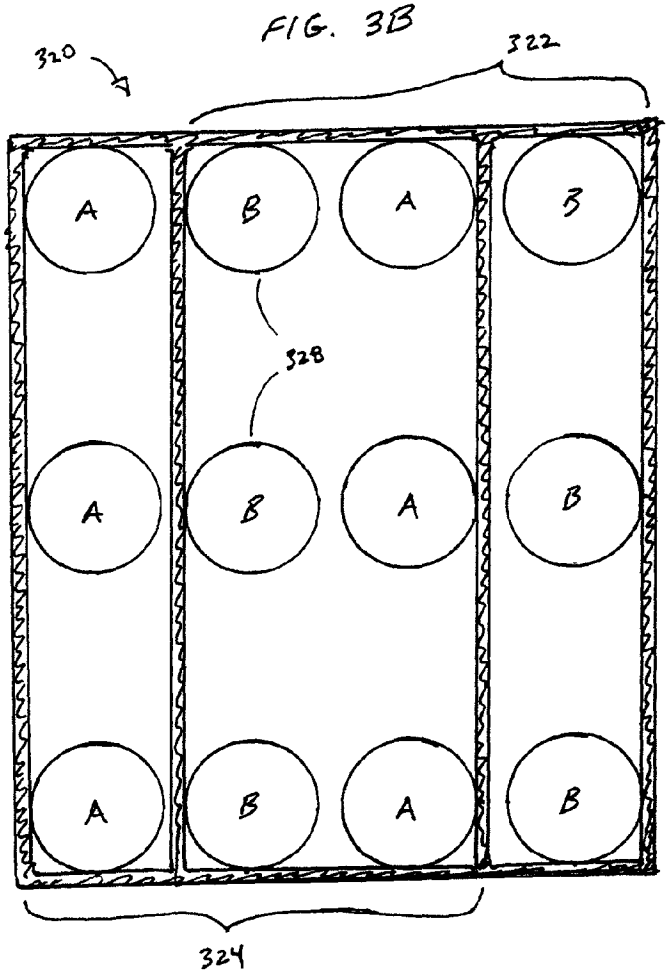
FIGS. 3A, 3B and 3C are diagrams illustrating examples of "stacked" arrangements utilizing multiple lighting units of the type illustrated in FIG. 1A.
Figure 3A:
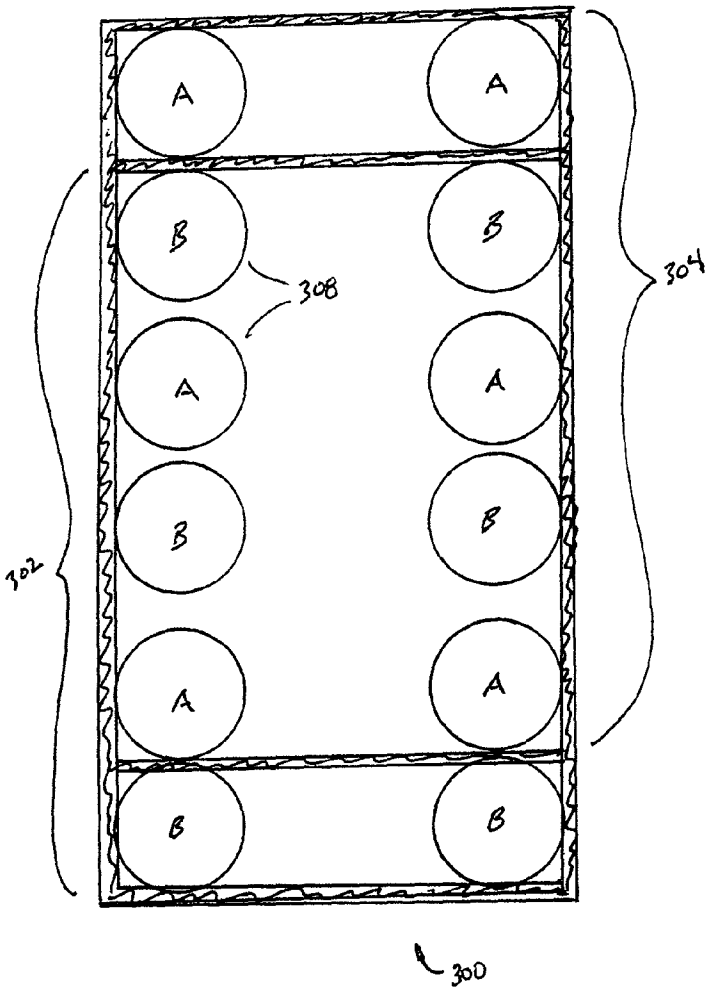
Figure 3C:
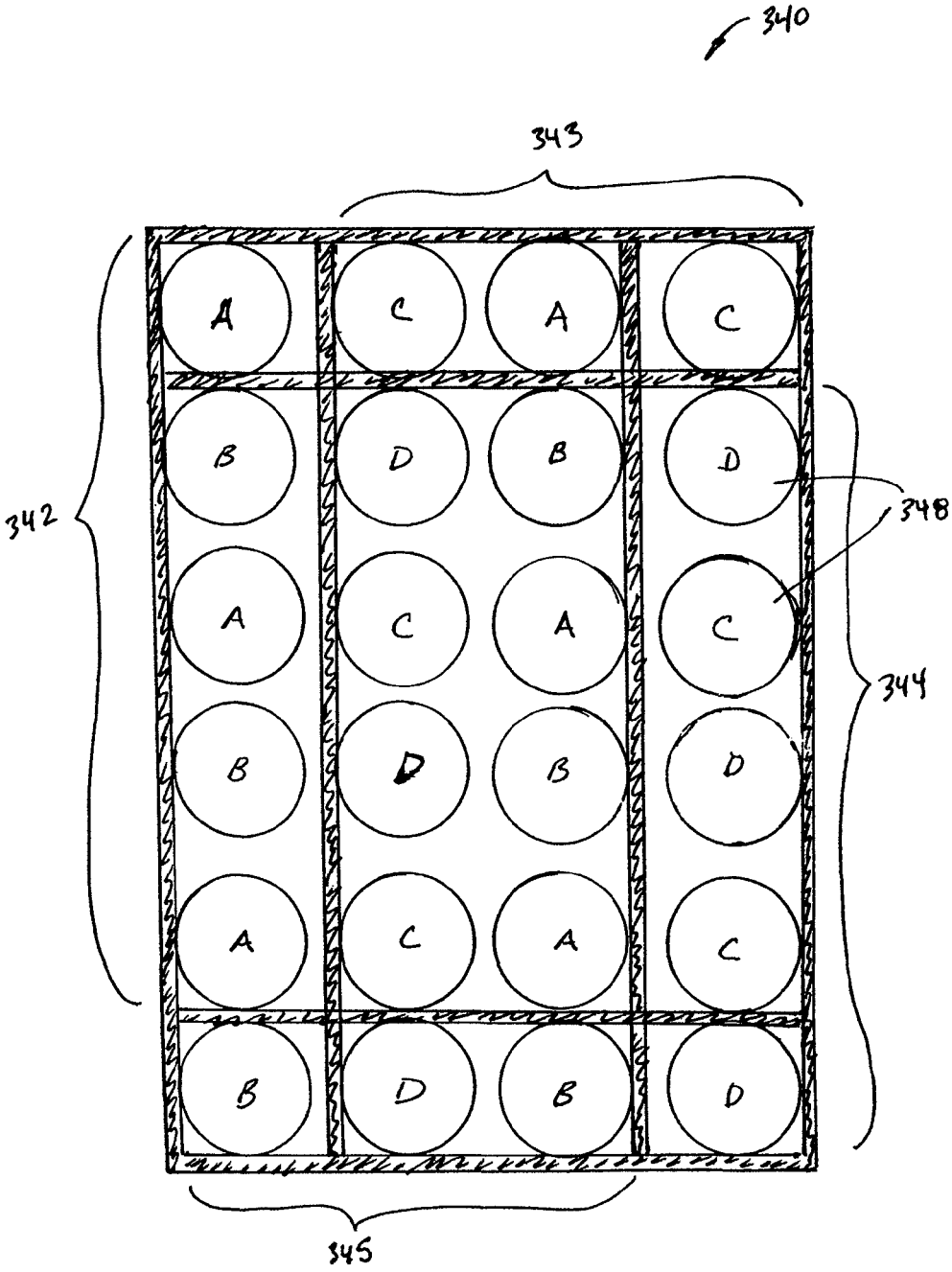

The modular lighting unit 100 of FIG. 1A may, in certain embodiments, be configured to allow the ability to stack multiple lighting units to achieve different overall illumination intensities. Examples of stacked lighting units are illustrated in FIGS. 3A, 3B, and 3C. In FIG. 3A, a first modular lighting unit 302 and a second modular lighting unit 304, both of the type illustrated in FIG. 1A, are stacked to form a combined lighting unit 300 with a total of twelve lamps 308. The lamps 308 designated "A" are associated with the second modular lighting unit 304, while the lamps 308 designated "B" are associated with the first modular lighting unit 302. The spacing and dimensions of the modular lighting unit 100 of FIGS. 1A-1B are such that, when two modular lighting units 302, 304 are stacked as illustrated in FIG. 3A, the lamps 308 form an interlocking pattern. The 12-lamp combined lighting unit 300 in FIG. 3A doubles the amount of light in each column (from three lamps to six lamps 308 in each), while only modestly increasing the size, in terms of length, of the overall lighting unit 300 relative to the six-lamp modular lighting unit 100 of FIG. 1A. The width of the combined lighting unit 300 remains the same as each of the individual modular lighting units 302, 304, while the thickness of the combined lighting unit 300 is slightly greater because of the stacking of the frame rods. The lamps 308 of the first modular lighting unit 302 may be slightly offset from those of the second modular lighting unit 304 as a result of the stacking of the two units, but because this offset is slight compared to the distance of the subject to be illuminated there is little impact.

FIG. 3B illustrates a similar situation, but with two modular lighting units 322, 324 configured to provide an increase in width, and resulting in three rows of four lamps 328 instead of two rows of six lamps, as in FIG. 3A. Thus, the first modular lighting unit 322 and second modular lighting unit 324, again both of the type illustrated in FIG. 1A, are stacked to form a combined lighting unit 320 with a total of twelve lamps 328. The lamps 328 designated "A" are associated with the second modular lighting unit 324, while the lamps 328 designated "B" are associated with the first modular lighting unit 322. The spacing and dimensions of the modular lighting unit 100 of FIG. 1A are again such that, when the two modular lighting units 322, 324 are stacked as illustrated in FIG. 3A, the lamps 328 form an interlocking pattern. The 12-lamp combined lighting unit 320 in FIG. 3B doubles the amount of total light output, while only modestly increasing the size, in terms of width, of the overall lighting unit 320 relative to the six-lamp modular lighting unit 100 of FIG. 1A. The length of the combined lighting unit 320 remains the same as each of the individual modular lighting units 322, 324, while the thickness of the combined lighting unit 320 is again slightly greater because the stacking of the frame rods.

FIG. 3C illustrates, in effect, a combination of the strategies from FIGS. 3A and 3B, whereby four modular lighting units 342, 343, 344 and 345, all of the type illustrated in FIG. 1, are stacked to form a 24-lamp combined lighting unit 340. In FIG. 3C, the first modular lighting unit 342 and second modular lighting unit 343 are stacked side-by-side, and the third modular lighting unit 344 and fourth modular lighting unit 345 are likewise stacked side-by-side. Modular lighting units 342 and 343 are stacked lengthwise with respect to modular lighting units 344 and 345, resulting in a combined lighting unit 340 with a total of 24 lamps 348 arranged in four rows of six lamps 348 each. The lamps 348 designated "A" are associated with modular lighting unit 342; the lamps 348 designated "B" are associated with modular lighting unit 345; the lamps 348 designated "C" are associated with modular lighting unit 343; and the lamps 348 designated "D" are associated with modular lighting unit 344. The spacing and dimensions of the modular lighting unit 100 of FIG. 1A are such that, when the four modular lighting units 342, 343, 344 and 345 are stacked as illustrated in FIG. 3C, the lamps 348 form an interlocking pattern with a relatively even and concentrated spread of light. The 24-lamp combined lighting unit 340 in FIG. 3C quadruples the amount of total light output, while only modestly increasing the size, in terms of both length width, of the overall lighting unit 340 relative to the six-lamp modular lighting unit 100 of FIG. 1A. The thickness of the combined lighting unit 340 is equivalent to approximately four frame rods, leading to some slight but acceptable offset among the lamps 348 on the different modular lighting units 342, 343, 344, and 345.

It can therefore be seen that a single modular lighting unit 100 such as illustrated in FIG. 1A may be used in a variety of different configurations, in combination, to create combined lighting units 300, 320 and 340 having different lighting output intensities, while only modestly increasing the size over a single modular lighting unit 100.

Figure 4:
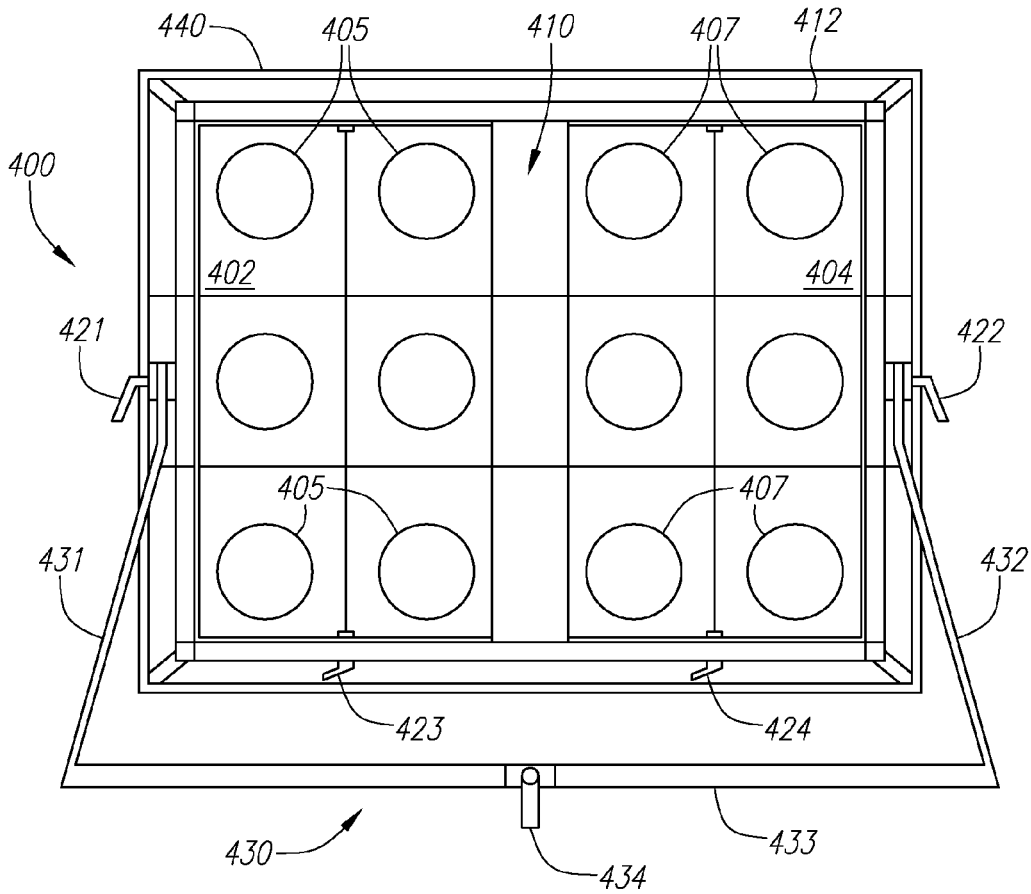
FIG. 4 is a front view diagram of a multi-unit illumination apparatus utilizing multiple lighting units of the type illustrated in FIG. 1A in a side-by-side configuration, mounted on a yoke.

Other embodiments may utilize modular lighting units in a side-by-side or lengthwise arrangement. For example, FIG. 4 is a front view diagram of a modular stand-mounted lighting apparatus 400 utilizing multiple lighting units 402, 404 of the type illustrated in FIG. 1A in a side-by-side configuration. In FIG. 4, a first modular lighting unit 402 and a second modular lighting unit 404 are attached to a rectangular mounting frame 412 of appropriate dimension, resulting in a combined lighting unit 410 having, in this example, a total of twelve lamps 405, 407—thus doubling the total light output over a single modular light unit. The modular lighting units 402, 404 may be attached to the rectangular mounting frame 412 in any suitable manner. For example, the individual frame bars of rectangular mounting frame 412 may have grooves in which the modular lighting units 402, 404 can be slid, and then locked into place using screw-threaded handles 423, 424, respectively. In this example, the combined lighting unit 410 is mounted on a yoke 430. The combined lighting unit 410 may be tilted up and down and locked into place with clamping handles 421, 422 on either side of the forked yoke arms 431, 432. A yoke crossbar 433 is swivably mounted to a rod 434 (partially shown in FIG. 4) which may form part of a base stand (not shown) as is commonly known in the art. The combined lighting unit 410 may thereby not only be tiltable, but also may swivel thus allowing the illumination from the lamps 405, 407 to be directed in virtually any direction.

Figure 5B:
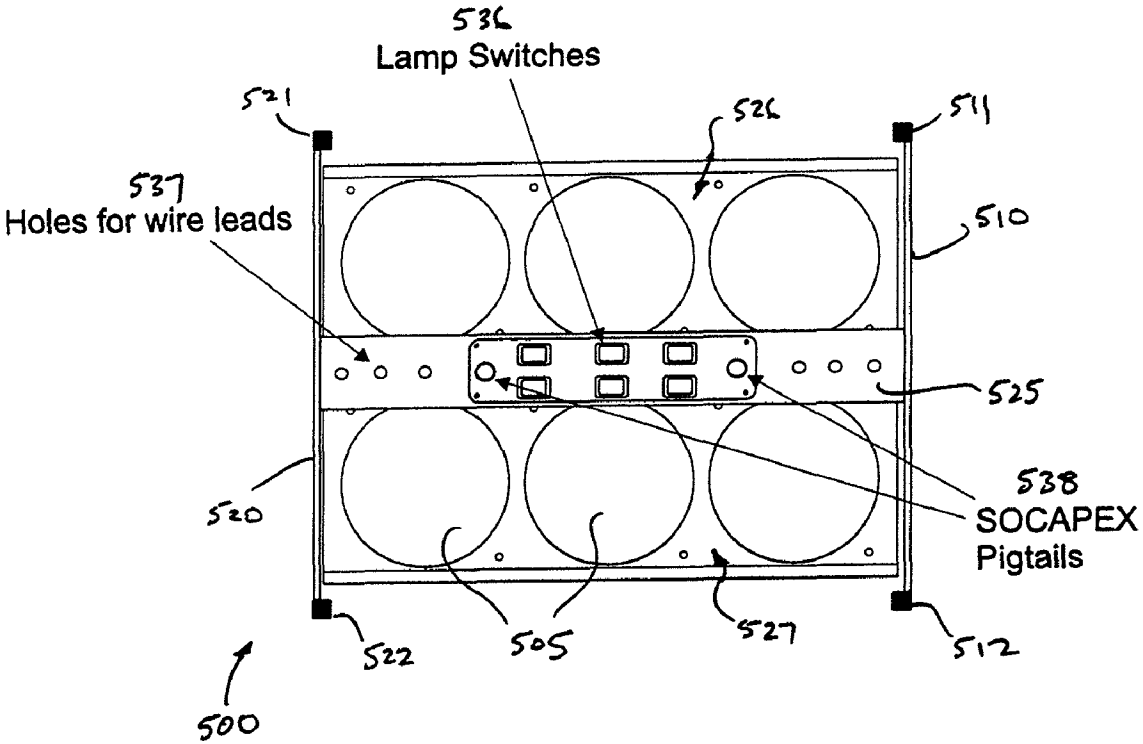
FIGS. 5A and 5B are a side view and back view diagram, respectively, of a lighting unit with multiple par-type lamps, in accordance with another embodiment as disclosed herein.
Figure 5A:
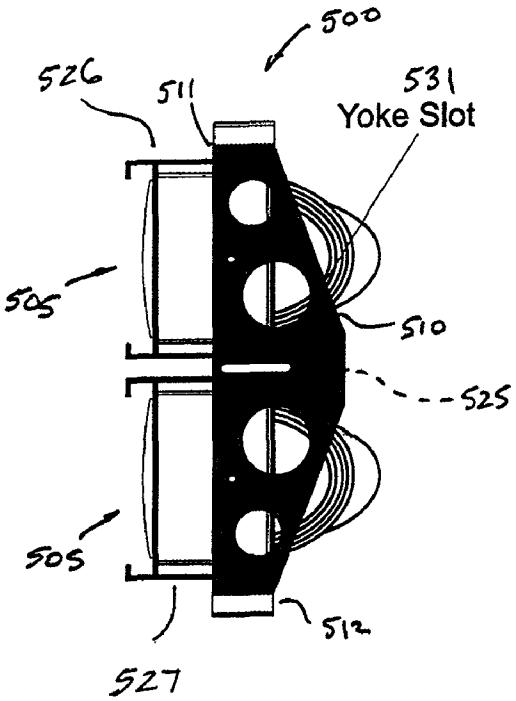

Another embodiment is illustrated from various views in FIGS. 5A-5B and 6A-6B, with details of preferred components thereof illustrated in FIGS. 7A-7C, 8, 9 and 10. FIGS. 5A and 5B illustrate a top view and back view respectively, of a multi-lamp lighting unit 500. With reference first to FIG. 5B, the multi-lamp lighting unit 500 comprises a set of individual lamps 505 which are preferably embodied as high-efficiency par-type lamps constructed in accordance with general principles of FIG. 2A and described in more detail later herein. The lamps 505 of lighting unit 500 are arranged, in this particular embodiment, on two swiveling multi-lamp lighting pods 526, 527, which are illustrated in greater detail from various viewpoints in FIGS. 7A, 7B and 7C. The multi-lamp lighting pods 526, 527 are attached to a lighting frame comprising sides plate 510, 520 connected by a crossbeam 525 (shown also in cross-sectional outline by the dotted lines in FIG. 5A). Side plates 510, 520 and crossbeam 525 are preferably formed of a lightweight material such as aluminum, and side plates 510, 520 may have overhanging receivers 511, 512, 521 and 522 to allow, for example, the unit to be readily hung or mounted, or to provide a slot for allowing a diffusion housing or soft box (not shown) to be frontally attached to the lighting unit 500 to achieve various lighting effects.

Figure 2C:
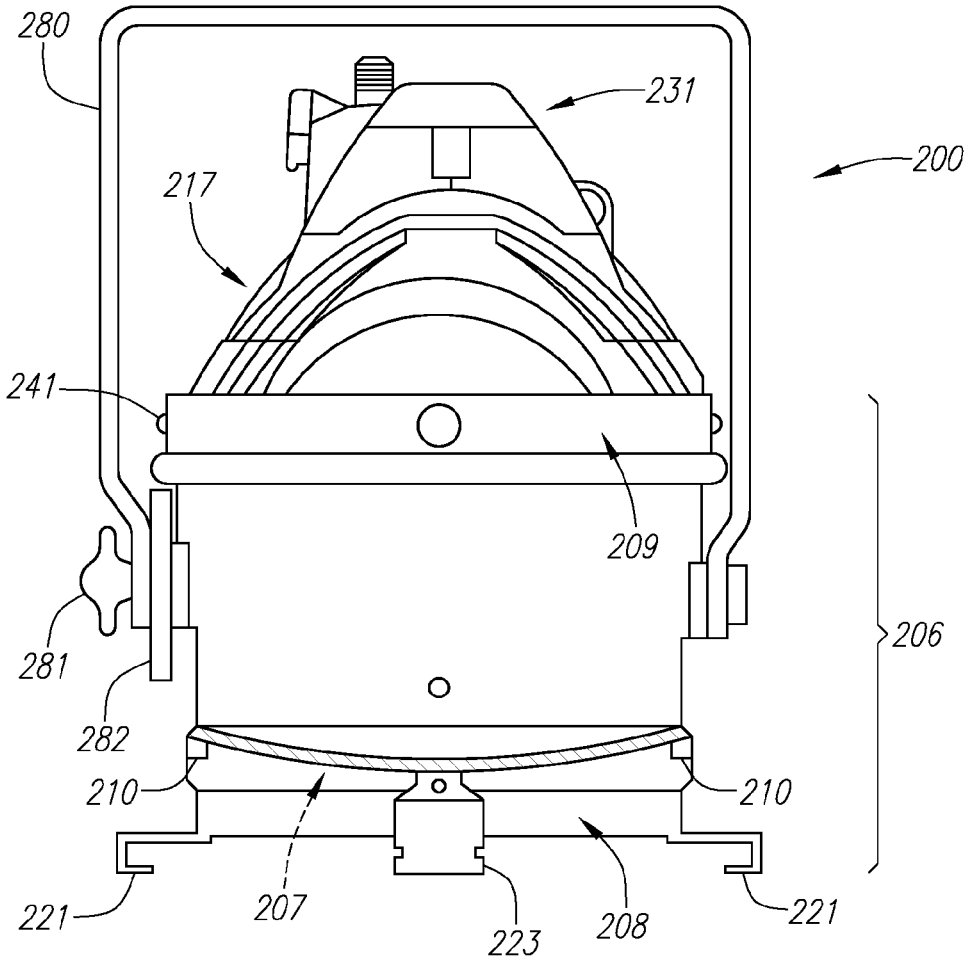
FIG. 2C is another partial cut-away side view of the par-type lamp of FIG. 2A, showing positioning of a lens retained therein.
Figure 7A:
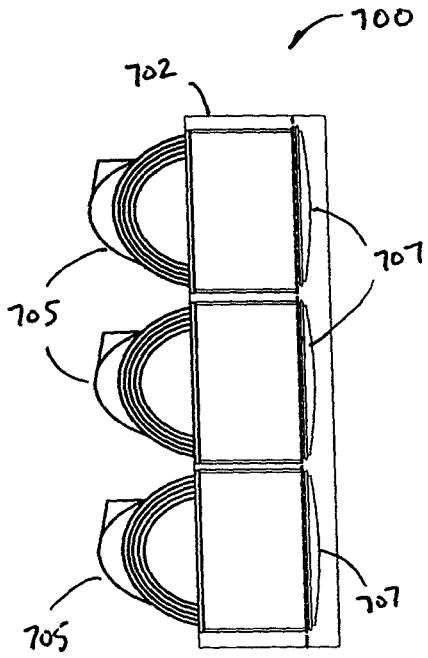
FIGS. 7A, 7B and 7C are different views of a multi-lamp lighting pod in accordance with one embodiment as disclosed herein.
Figure 7B:
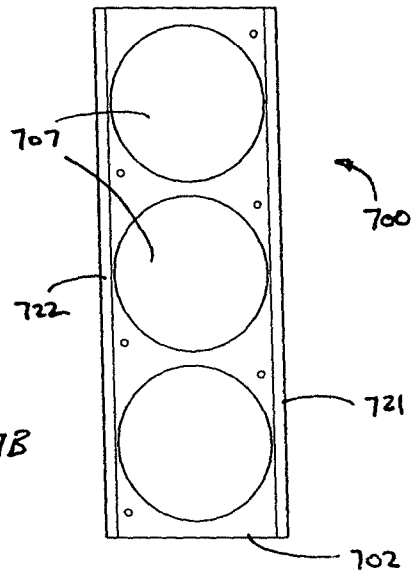
Figure 7C:
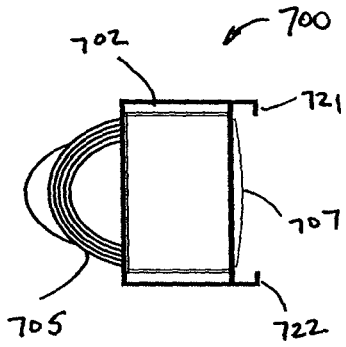

FIGS. 7A, 7B and 7C are different views of a multi-lamp lighting pod 700 in accordance with one embodiment as disclosed herein, as may be used, for example, in the lighting unit 500 of FIGS. 5A-5B as pods 526, 527. The multi-lamp lighting pod 700 in this example includes multiple lamps 705 arranged in a linear pattern. Although three lamps 705 are shown in FIGS. 7A-7C, any number of lamps can be used, and in any arrangement but preferably one that allows the lamps 705 to be maneuvered together. The lamps 705 are affixed to a pod frame 702 with grooved extensions 721, 722 for, e.g., protecting the lamps 705 and preventing inadvertent manual contact with the lenses 707 of the lamps when hot. The multi-lamp pod 700 may be maneuvered as a unit, allowing convenient redirection of the illumination output from the multiple lamps 705. In a preferred embodiment, the lamps 705 are high-efficiency par-type lamps such as described with respect to FIGS. 2A-2C and/or FIG. 8 herein.

Figure 8:
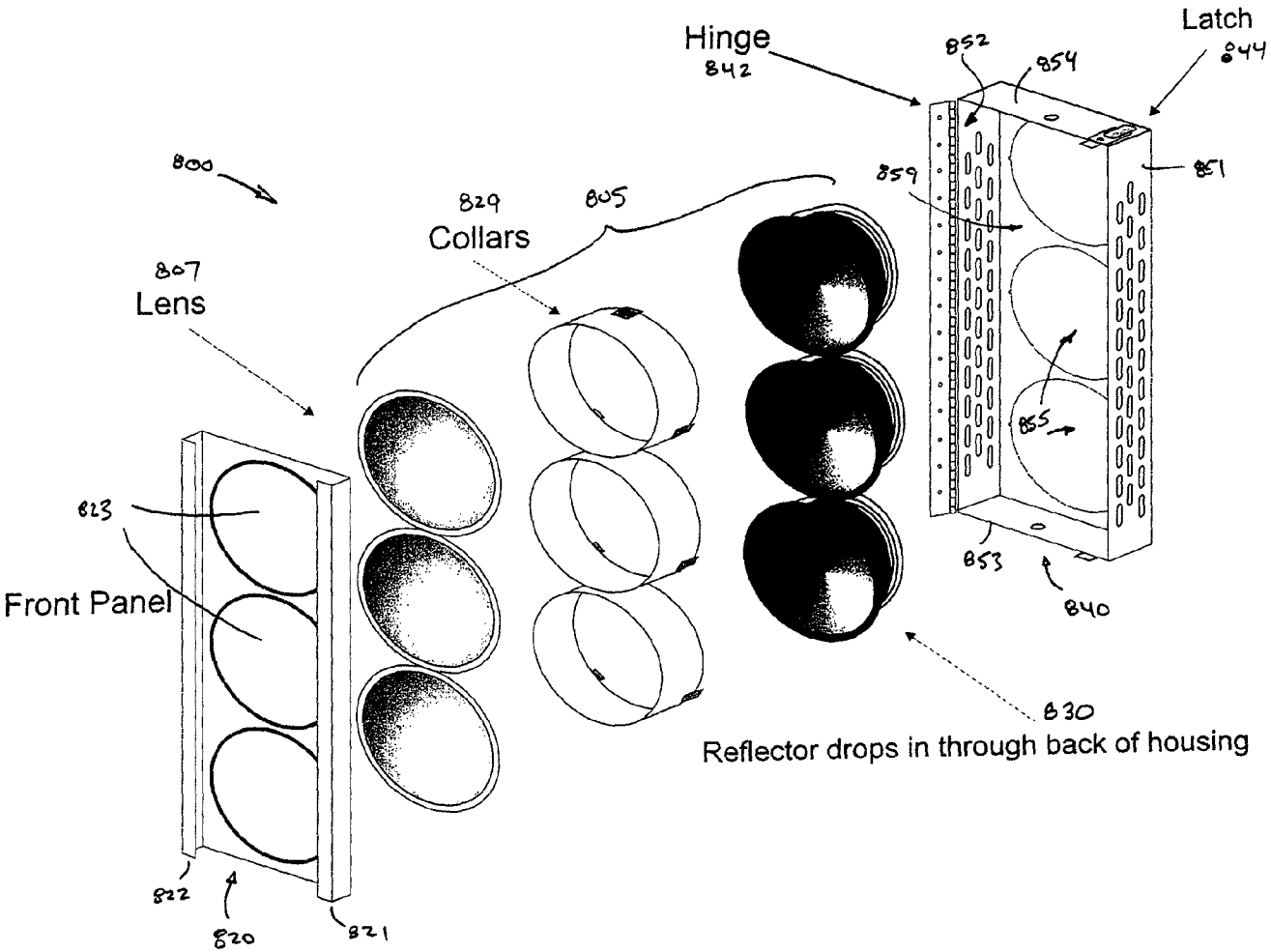
FIG. 8 is an exploded view assembly diagram showing different components as may be used in the multi-lamp lighting pod of FIGS. 7A-7C.

The multi-lamp pod 700 may be constructed in a variety of different manners, but is preferably lightweight, easy to assemble, and capable of utilizing low-cost but high-efficiency par-type lamps. The multi-lamp pod 700 also preferably provides ready access to the lamp burners to allow rapid replacement of globes, whether because of burn outs or to control output, and also preferably provides a convenient mechanism for allowing rapid replacement of the lenses 707 to allow different effects. FIG. 8 is an exploded view of an assembly diagram showing different components as may be utilized in a preferred configuration of the multi-lamp lighting pod of FIGS. 7A-7C. In FIG. 8, a multi-lamp lighting pod (such as 700 shown in FIGS. 7A-7C) may be constructed with a pod frame 840 and pod front panel 820 collectively forming a pod housing. The pod frame 840 may be generally box-shaped, with sidewalls 851, 852 connecting to a top frame panel 854 and bottom frame panel 853. The pod frame 840 may further include a back wall 850 having circular holes or cutouts 855 generally with "keys" (thus matching the shape of the reflector so it can be oriented properly) in which lamps 805 may be placed. The sidewalls 851, 852 may be ventilated with perforations to assist in cooling the lamps 805 placed within the pod housing.

The lamps 805 may each be constructed of several components in general accordance with the high-efficiency par-type lamp described with respect to FIG. 2A. Each lamp 805 may include a reflector 830 which preferably can be dropped into and held in position by some means (such as a collar as described, optionally perforated, or another retaining type structure to secure it within the pod). The reflector 830 is preferably a par-type reflector of the type described previously herein with respect to FIG. 2A. Individual collars 829, if utilized, are mounted on or otherwise attached to, or sandwiched between, the reflectors 830, and individual lenses 807 provided for each collar 829, thereby forming individual lamps 805 for the multi-lamp lighting pod 800, contained by the front panel 820. The collars 829 are preferably also constructed in accordance with the principles described with respect to FIG. 2A, and are lightweight in construction, with means to allow attachment of the lenses 807 at preferably an optimal distance from the reflector and lamp burner (not shown in FIG. 8). The reflectors and lamp burners preferably comprise high-efficiency components of the type described with respect to FIG. 2A.

In certain embodiments, the lenses of the par lamps (such as, e.g., lens 807 shown in FIG. 8, or the lenses in other embodiments described herein) may be made in whole or part of a non-glass material. Conventionally, par lamp lenses are made from glass. However, a substantial improvement to weight reduction, portability, safety, and ruggedness of some lighting fixtures may be achieved by manufacturing the par lamp lenses from a high temperature optical plastic (such as thermoplastic, Lexan, or the like). The shape of these non-glass diffusing lenses may be flatter in some instances than traditional glass lenses. In other embodiments, the par lamp lenses may be made stackable, such that additional lenses (potentially with different degrees of light dispersion) may be added to quickly increase or decrease the beam spread.

The lamps 805 may be enclosed within the pod housing, with the pod front panel 820 connecting to the pod frame 840 in order to form an enclosure. The location of the lenses 807 is aligned with holes or cutouts 823 in the pod front panel 820. In a preferred embodiment, as described in more detail below, the pod front panel 820 is attached in a manner allowing rapid removal and replacement of the lenses 807 of lamps 805. For example, the pod front panel 820 may be connected by a hinged member 842 thereby allowing the entire pod front panel 820 to swivel open for removal and replacement of lenses 807. A latch 844 may be used to keep the pod front panel 820 securely in place when closed. Other mechanisms may also be used to achieve a similar result; for example, the pod front panel 820 may be formed of right and left panels which are each separately hinged so as to swing open; or the pod front panel 820 may be slidably engaged with the pod frame 840 so that the front panel 820 can be opened to allow access to the lenses 807; or the pod front panel 820 may simply be removable, such that after replacing the lenses 807 it is latched back into place, or otherwise secured.

In alternative embodiments, it is possible to make the collars 829 in the form of "spacers" that are perforated or else minimal in construction, as one of their purposes within the pod configuration is to maintain the proper distance between the reflectors 830 and the lenses 807, as well as to secure the components in conjunction with the front panel 820. The attribute of the collar 829 containing (and reflecting) the light between the reflector 830 and the lens 807, and acting as a housing, can be performed by an equivalent portion of the pod frame or "box" whereby the reflectors 830 and lenses 807 are attached to the front and back panels 820, 859 of the pod frame 840 itself, which then collectively act as the collar or similar spacer and housing while eliminating the need for a physical collar 829. In such a case, the lenses 807 and reflectors 830 could be attached to the front and back panels of the pod frame 840 may any suitable manner, such as simple clips or wires. In effect, the pod 800 thereby becomes a common collar/spacer or housing for all three lamps 805, making them operable as a unit or a single three-light source.

In alternative embodiments, the par lamps 805 may be constructed without a collar 829, which may be advantageous in certain situations. An example of one such par lamp was described previously with respect to FIG. 20, and a lighting pod utilizing several of this type of collarless par lamp is illustrated (by way of assembly diagram) in FIG. 21A, which is generally similar to the lighting pod shown in FIG. 8. The multi-lamp lighting pod 2100 shown in FIG. 21A comprises multiple par-type lamps 2105 arranged in a linear pattern. Although three lamps 2105 are shown, any number can be used. The lamps 2105 are supported by a pod frame 2140 and pod front panel 2120 collectively forming a pod housing. The pod frame 2140 may be generally box-shaped, with sidewalls connecting to a top frame panel and bottom frame panel as previously described, any or all of which may be ventilated with perforations to assist in cooling. The pod frame 2140 may further include a back wall 2151 which generally encloses the par-type lamps 2105 for protection and to prevent inadvertent manual contact with the reflector 2107 of the par-type lamps 2105 when hot, yet allows access to the backs of the par-type lamps 2105 for rapid removal of the lamp base 2132 (or portion thereof) to replace the globe 2132.

The multi-lamp pod 2100 may be constructed in a variety of different manners, but is preferably lightweight, easy to assemble, and capable of utilizing low-cost but high-efficiency par-type lamps. The multi-lamp pod 2100 also preferably provides ready access to the lamp burners to allow rapid replacement of globes, whether because of burn outs or to control output, and also preferably provides a convenient mechanism for allowing rapid replacement of the lenses 2107 to allow different effects.

The lamps 2105 may each be constructed of several components in general accordance with the high-efficiency par-type lamp described with respect to FIG. 20. Each par-type lamp 2105 may include a reflector 2130 which preferably can be dropped into the pod housing along with lenses 2107 and held in position by, e.g., closing and securing the hinged pod front panel 2120, thereby forming individual lamps 2105 for the multi-lamp lighting pod 2100. The par lamps 2105 preferably include a removable base 2131, which may be twist-locked or otherwise secured into place proximate to the back of the reflector 2130, allowing ready replacement of the globe 2132 as previously described with respect to FIG. 20.

Figure 21A:
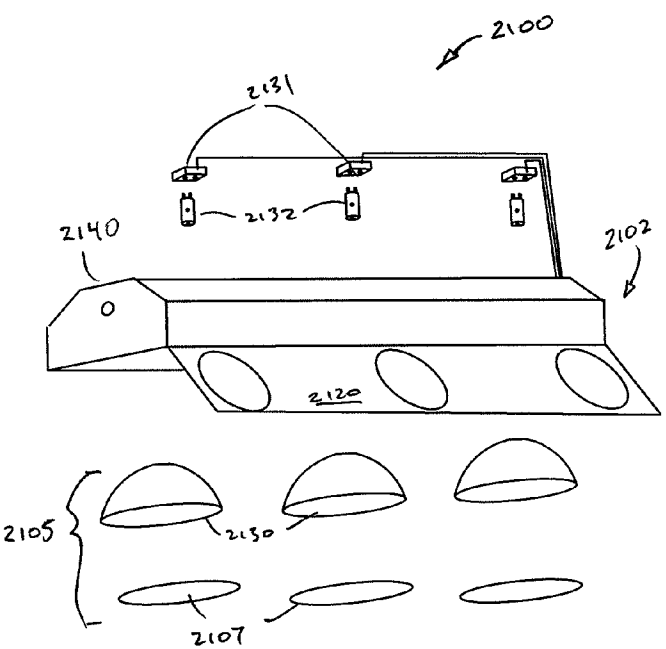
FIG. 21A is an assembly diagram of a multi-lamp lighting pod using the par lamp shown in FIG. 20.
Figure 21B:
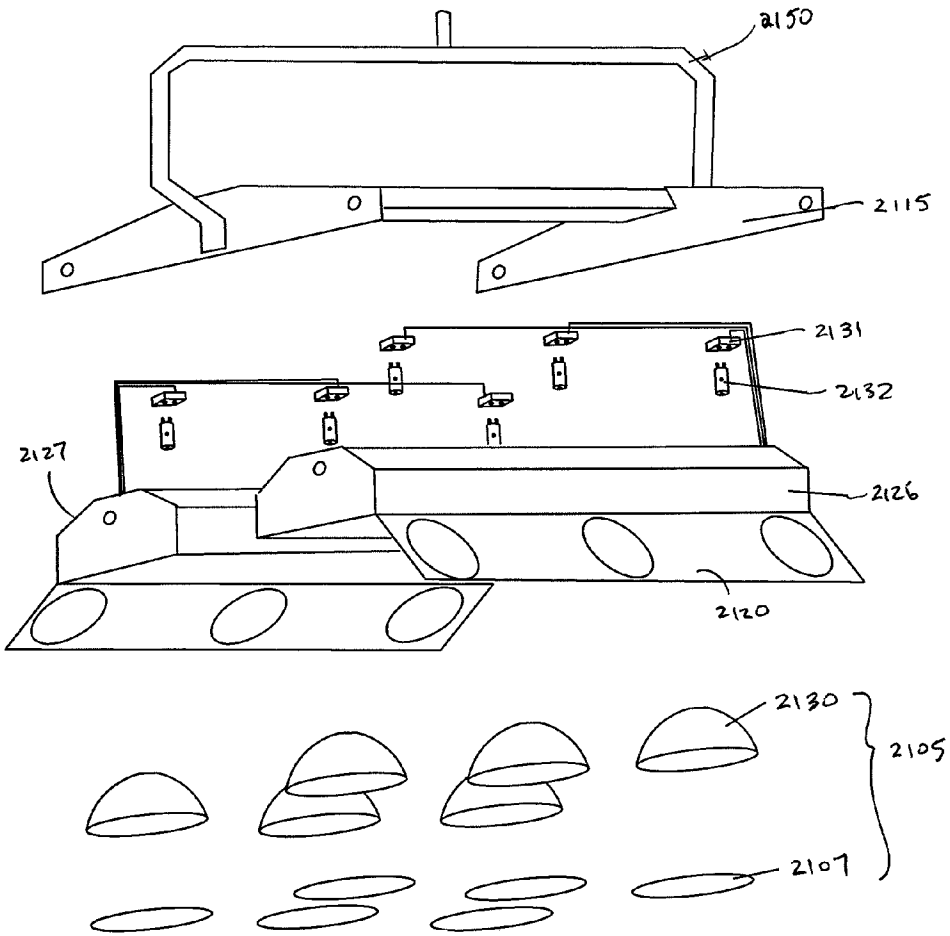
FIG. 21B is an assembly diagram of a lighting fixture utilizing a pair of multi-lamp lighting pods as shown in FIG. 21A.

FIG. 21B is an assembly diagram of a lighting fixture 2190 utilizing a pair of multi-lamp lighting pods 2126, 2127 of the type shown in FIG. 21A. Usage and operation of the lighting fixture 2190 in FIG. 21B is similar to the fixture illustrated in FIG. 12, described in more detail below, except for the removable lamp base 2131 of the FIGS. 20 and 21A design.

Where the lamps in any of the embodiments described herein are high-efficiency par-type lamps, they may be powered using a single Socopex™ type connector 538, as illustrated in FIG. 5B, and thus may be simpler and less expensive in terms of parts, as well as substantially more power efficient over traditional par lamps. For example, with 575 Watt globes, twenty-four lamps 505 can be powered with one standard Socopex™ type connector and controlled by one conventional 6-pack dimmer (having six individual 2.4 kW dimmers) which fully utilizes industry standard equipment and can save a significant amount of cable dimmers, manpower and electricity over other multi-lamp lighting systems, thus offering tremendous savings financially and environmentally. The lamps 505 may be controlled by individual on/off lamp switches 536, and holes 537 may be provided in the frame crossbeam 525 for provision of panel mount multi-pin connectors that can be joined with jumpers (a multiwire cable with connector ends) to a complimentary panel mount connector located on a pod.

Figure 9:
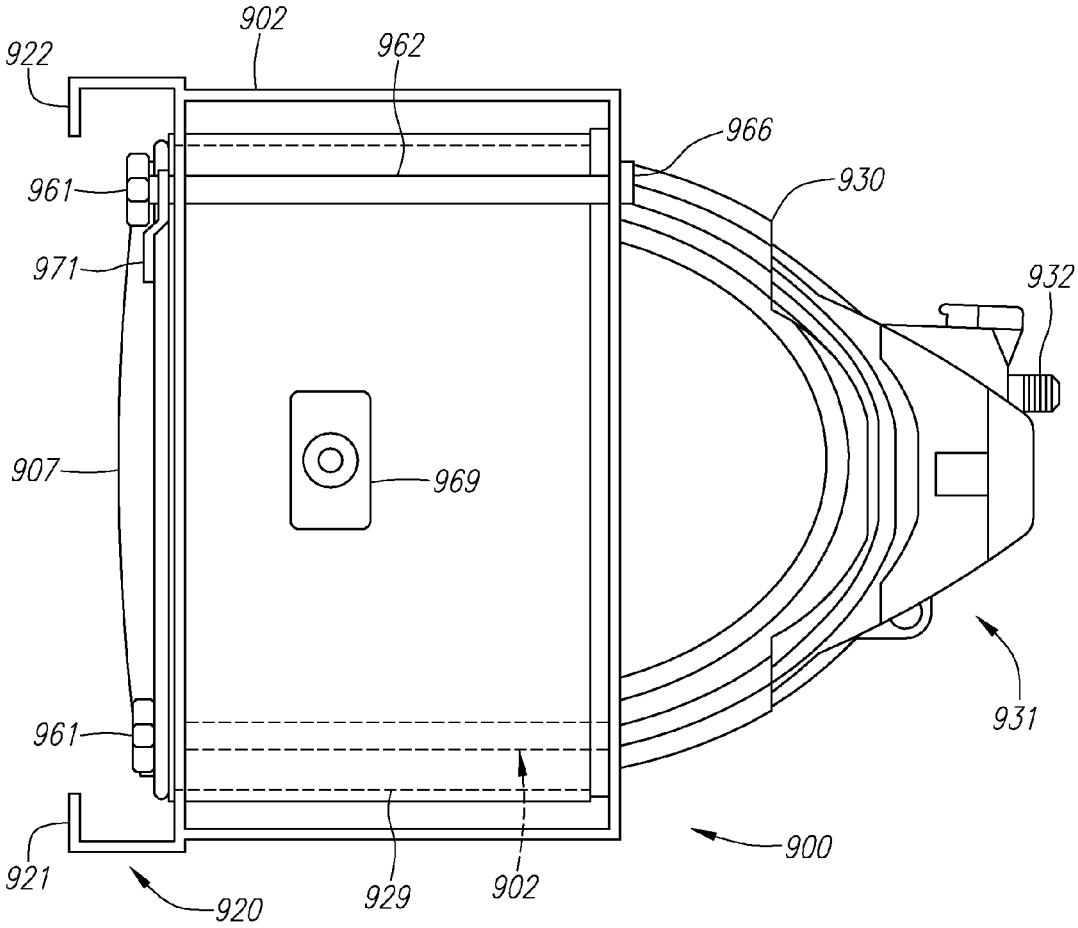
FIG. 9 is a top view diagram of an embodiment of a three-lamp lighting module constructed in accordance with certain principles reflected in FIGS. 7A-7C.
Figure 10:
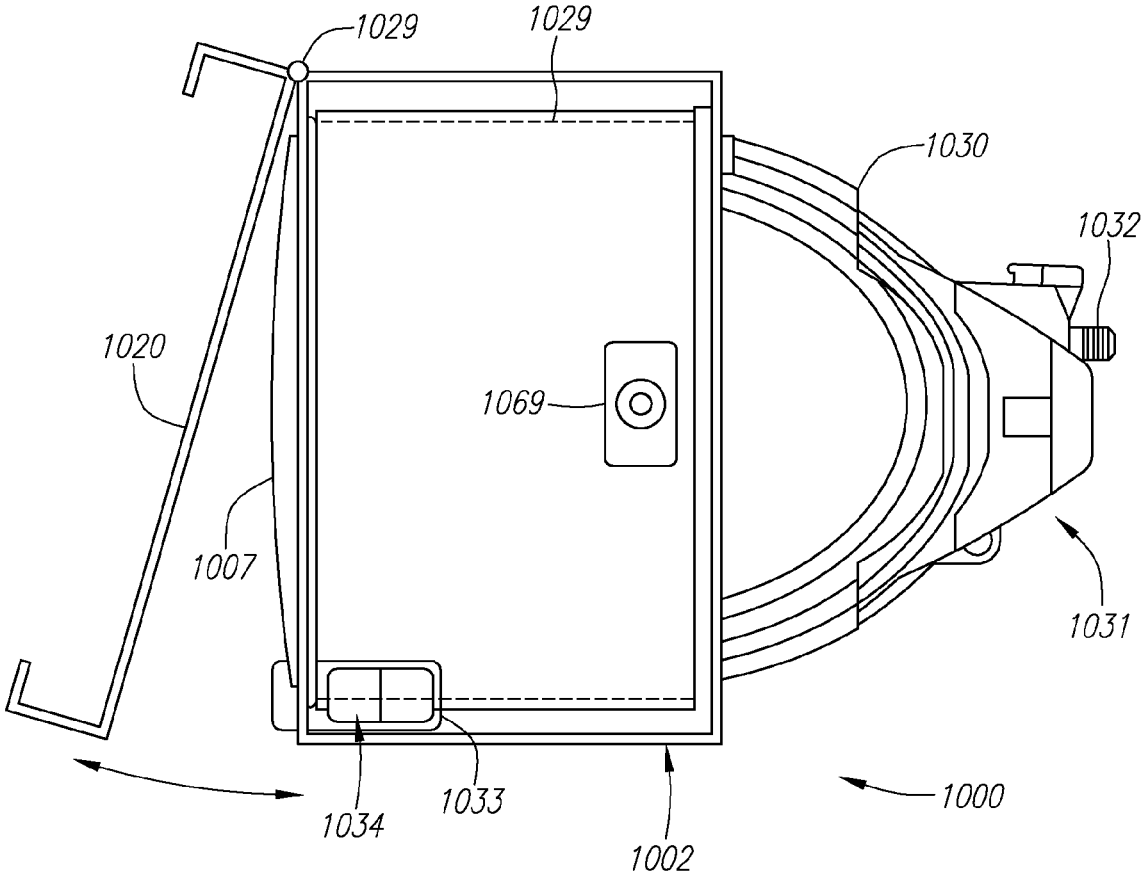
FIG. 10 is a diagram illustrating a swiveling front panel as may be used in the three-lamp lighting module embodiment of FIG. 9.

FIGS. 9 and 10 illustrate additional details of alternative lighting pod configurations 900, 1000 and associated lamp(s) as may represent embodiments, for example, of the various multi-lamp lighting pods 526, 527 (FIGS. 5A-5B), 700 (FIGS. 7A-7C) or 800 (FIG. 8) described herein. Both FIGS. 9 and 10 illustrate a top view of the alternative lighting pod configurations. In FIG. 9, the top of a lighting pod frame 902 and lighting pod front panel 920 are shown, collectively forming a pod housing, similar to the one illustrated in FIGS. 7A-7C and/or FIG. 8. As described with respect to FIG. 8, a par-type reflector 930, compatible with a high-efficiency par-type lamp, may be dropped into the lighting pod frame 902. A high-efficiency par-type burner 931 may be situated substantially in the center of the par-type reflector 930, in accordance with the conventional construction of high-efficiency par-type lamps. The high-efficiency par-type burner 931 is preferably removable, such that it may be detached (by, e.g., unscrewing a knurled knob 932 or other such mechanism) and slid out of the rear portion of the par-type reflector 930 to allow rapid replacement of the globe when needed. The par-type burner (or applicable portion thereof) 931 may also be attached by snaps or clips, or a threaded twist-lock mechanism, or shock-mounted to the back of the reflector 930 or pod rear cover or cap. A lightweight collar 929 (such as collar 829 shown in FIG. 8) may, if desired, be situated at the front of the par-type reflector 930, and may be capped at the other end with a suitable lens 907. Since FIG. 9 illustrates a top view of the lighting pod, additional reflectors, collars, and lenses not visible in FIG. 9 would be disposed also in the pod housing, in the same relative alignment with reflector 930, collar 929 and lens 907 illustrated in FIG. 9, and having the same general configuration thereas.

In the particular example shown in FIG. 9, the lens 907 may be held into place by one or more lens clips 971 which are, in turn, secured to the pod housing by thumb screws 961 that screw into threaded stand-offs 962. The threaded stand-offs may be fastened to the rear wall of the pod frame 902 by a rear fastener 966. With this configuration, the lens 907 may be rapidly removed and replaced by simply loosening the thumb screws 961, disengaging the lens clip(s) 971, sliding out the lens 907 and replacing it with a new one, then re-engaging the lens clip(s) 971 and tightening the thumb screws 961. Among other things, this quick-action replacement scheme allows the changing of lens types to create different lighting effects in a rapid and efficient manner. The combination of thumb screws 961, threaded stand-offs 962, and rear fasteners 966 may also be used to secure the pod front panel 920 to the pod frame 902, although in other embodiments different mechanisms may be used for securing the pod front panel 920 to the pod frame 902, for securing the lens 907 to the pod front panel 920, or securing the reflector 930 to the back side of the pod frame 902.

Figure 6A:
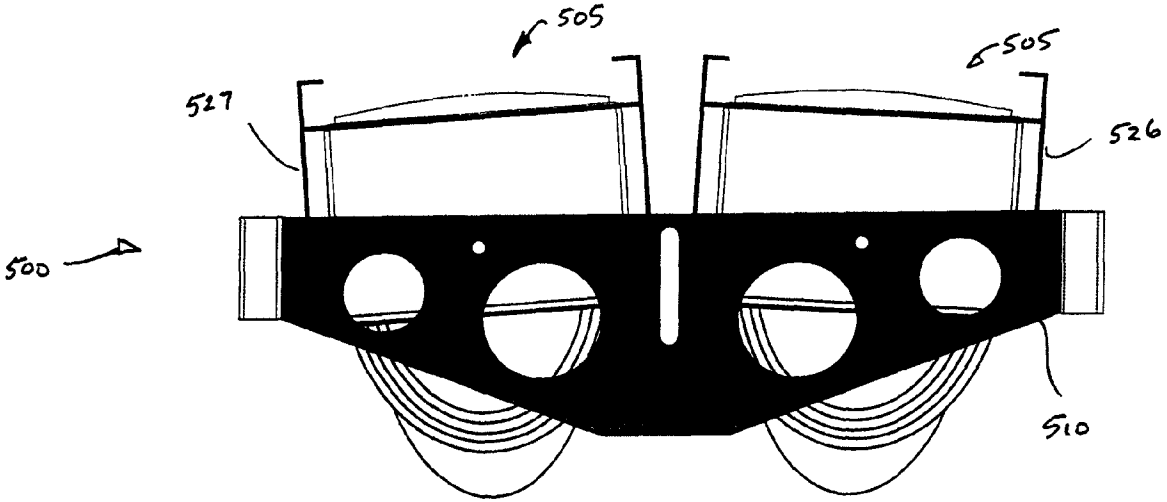
FIGS. 6A and 6B are diagrams illustrating tilting of the par-type lamps of the lighting unit shown in FIG. 5A.
Figure 6B:
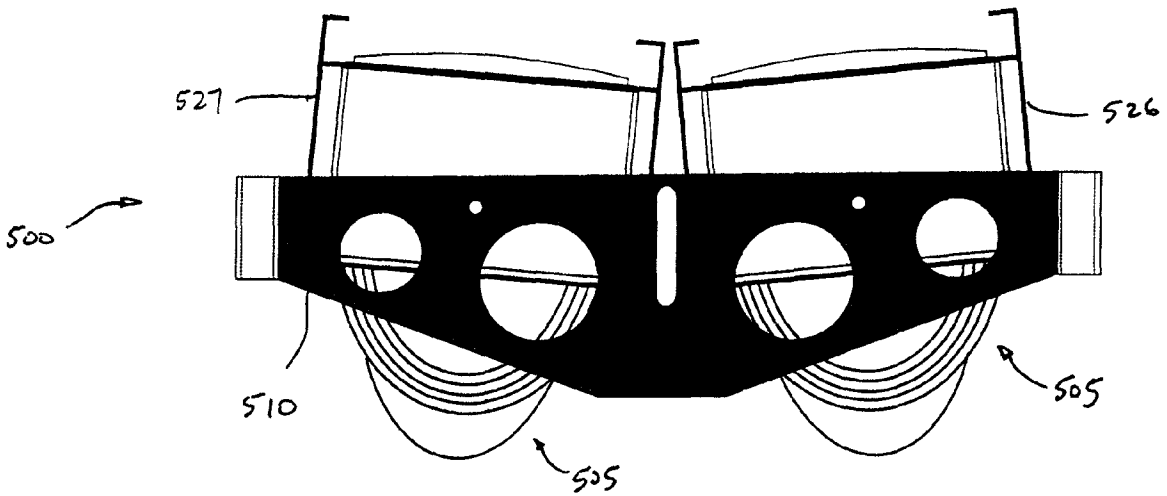

FIG. 9 also illustrates a mounting point 969 atop the pod frame 902 whereby the lighting pod 900 may be swivably attached (via, e.g., a compression nut, simple bolt, or threaded knob to allow for swiveling and locking into the desired position) to a lighting unit, as illustrated in FIGS. 5A and 6A-6B. The mounting point 969 may comprise, for example, a cylindrical hole, a threaded hole, receptor or socket configured to receive a complementary truncated swiveling rod of any type commonly used with stand-mounted lights or yokes; or alternatively, the mounting point 969 may comprise a truncated swiveling rod designed to engage with a complementary socket or receptor as may be located on the lighting unit frame. A similar mounting point (not shown) may be included on the bottom plate of the pod frame 902, such that the lighting pod 900 may be placed between top and bottom frame members (e.g., side plates) of a lighting unit (such as frame members 510, 520 illustrated in FIG. 5B), and thereby may be manually rotated or swiveled to direct the light of the group of lamps of the lighting pod 900.

FIG. 10 is a diagram illustrating a top view of another lighting pod configuration 1000, with a hinged front panel as may be used in various lighting units described herein. For lighting pod 1000 of FIG. 10, as with FIG. 9, the top of a lighting pod frame 1002 and lighting pod front panel 1020 are shown, collectively forming a pod housing, similar to the one illustrated in FIGS. 7A-7C and/or FIG. 8. As described with respect to FIGS. 8 and 9, a par-type reflector 1030, compatible with a high-efficiency par-type lamp, may be contained into the lighting pod frame 1002 A high-efficiency par-type burner 1031 may be situated substantially in the center of the par-type reflector 1030 as previously described, and a lightweight collar 1029 (similar to collar 829 shown in FIG. 8) may be situated at the front of the par-type reflector 1030. The high-efficiency par-type burner 931 is preferably removable, as described with respect to FIG. 9. The collar 1029 may be capped at the other end with a suitable lens 1007. As with FIG. 9, since FIG. 10 illustrates a top view of the lighting pod, additional reflectors, collars (if desired), and lenses not visible in FIG. 10 would be disposed also in the pod housing, in the same relative alignment with reflector 1030, collar 1029 and lens 1007 illustrated in FIG. 10, and having the same general configuration thereas.

The particular means for holding the lens(es) 1007 in place, and allowing access to the lens(es), differs over the embodiment illustrated in FIG. 9. In the particular example shown in FIG. 10, the pod front panel 1020 is connected by a hinged member 1042 to the pod frame 1002, thereby allowing the entire pod front panel 1020 to swivel open for removal and replacement of lens(es) 1007. A securing mechanism, such as a latch 1034, may be used to keep the pod front panel 1020 securely in place resting against pod frame 1002 when in a closed position. The latch 1034 may comprise, for example, a simple "lunch box" type flange and snapping clasp or wire loop which snaps and locks around a complementary feature on the pod front panel 1020. Other latching mechanisms, such as a hook-and-loop or hook-and-post, may also be used to secure the front panel 1020 into place. Similar to FIG. 9, the quick-action replacement scheme of lighting pod 1000 allows the changing of lens types to create different lighting effects rapidly and collectively (as opposed to individual mechanisms that have to be manipulated at each lens) thus allowing for more rapid lens changes.

Also similar to FIG. 9, the lighting pod 1000 of FIG. 10 also may include a mounting point 1069 atop the pod frame 1002 whereby the lighting pod 1000 may be swivably attached to a lighting unit, as illustrated in FIGS. 5A and 6A-6B. The mounting point 1069 may comprise, for example, a cylindrical hole, threaded hole, socket, or receptor, or a conventional pin or rod, as commonly used with stand-mounted lights or yokes, and as previously described with respect to FIG. 9. A similar mounting point (not shown) may be included on the bottom plate of the pod frame 1002, such that the lighting pod 1000 may be placed between top and bottom frame members (e.g., side plates) of a lighting unit, and thereby may be manually rotated or swiveled to direct the light of the group of lamps of the lighting pod 1000.

In addition to allowing rapid removal and replacement of reflectors and/or lenses, the ability of the lighting pods 900 and 1000 to be, in certain embodiments, swivabley mounted to a lighting unit may provide advantages such as the ability to light multiple targets from a single unit; to increase the light spread; to narrow the centerbeam of illumination provided by the lighting unit, and/or increase the total intensity of the illumination by combining the beams from multiple lighting pods towards a single target; and to achieve certain lighting effects by, for example, swiveling one or both lighting pods while a subject is being filmed or taped. While FIG. 5A illustrates a lighting unit 500 with two lighting pods 526, 527 (which may be embodied as pods 900 or 1000, for example) both facing directly forwards, FIGS. 6A-6B illustrate the lighting unit 500 showing the lighting pods 526, 527 rotated in different directions. For example, in FIG. 6A, the lighting pods 526, 527 have each been tilted or rotated slightly outwards, thereby increasing the spread of overall illumination and decreasing to some degree the illumination in the center-path. In FIG. 6B, on the other hand, the lighting pods have been tilted or rotated slightly inwards, thereby narrowing the centerbeam and increasing the illumination intensity on a central target. The lighting pods 526, 527 allow the set of individual lamps 505 to be collectively maneuvered as a unit, to make it easier to adjust the lighting and to allow a set of lights to, for example, follow the motion of a subject or create other combined lighting effects where it is desirable to have multiple individual lamps acting in unison.

Figure 11C:
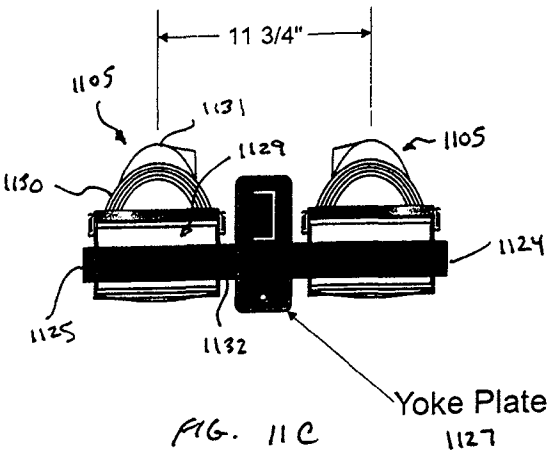
FIGS. 11A, 11B and 11C are different views of a four-lamp lighting unit in accordance with an embodiment as disclosed herein.
Figure 11A:
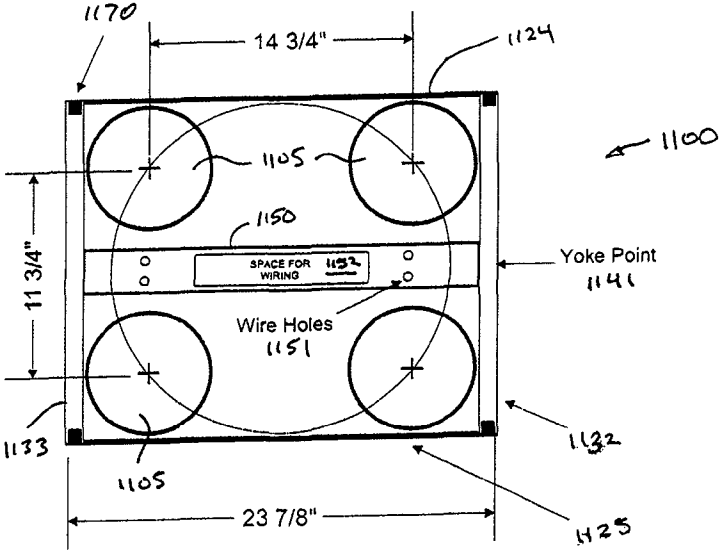
Figure 11B:
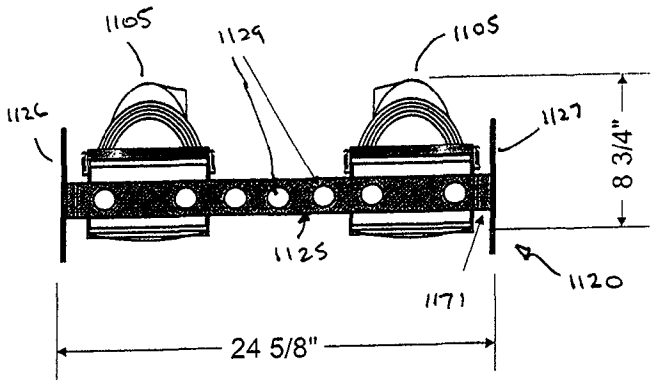

FIGS. 11A, 11B and 11C are diagrams showing various different views of a multi-lamp lighting unit 1100 in accordance with another embodiment as disclosed herein. In the particular example of FIGS. 11A-11C, the multi-lamp lighting unit 1100 includes four lamps; however, the lighting unit 1100 may be constructed with any number of lamps suitable for the particular lighting needs. The multi-lamp lighting unit 1100 may, as with the lighting unit 500 of FIGS. 5A-5B, may comprise multiple pods, but in this example includes four independently mounted lamps 1105, which are secured to a lighting frame comprising a top plate 1133, a bottom plate 1132, a crossbeam 1150 interconnecting the top and bottom plates 1133, 1132, and two side frame bars 1124, 1125. A yoke plate 1127 (FIGS. 11B, 11C) may be provided for, e.g., allowing the lighting unit 1100 to be mounted on a yoke (not shown) at a central yoke point 1141 (FIG. 11A). Optionally, a second yoke plate 1126 (FIG. 11B) may be provided to allow, e.g., the lighting unit 1100 to be mounted between forked arms of a yoke (not shown) in a conventional manner. The side frame bars 1124, 1125 may also have holes 1129 for allowing the lighting unit 1100 to be hung by hooks or mounted to other contraptions. The lighting unit 1100 may also have a gel frame slot or receiver 1170 (FIG. 11A) or a spaces 1171 (FIG. 11B) for a slot/receiver to be attached, for allowing a gel frame or complete housing/soft box including properly spaced, possibly changeable diffusion frame(s) and/or light emitting fabric with or without baffles for optimal dispersion (not shown) to be frontally attached to the lighting unit 1100 to achieve various lighting effects.

FIGS. 11A-11C also show example dimensions that may be particularly suitable where lamps 1105 are embodied as 7" par-type lamps; however, the lighting unit 1100 may be constructed to any desired dimensions. In this example, the center-to-center horizontal distance between adjacent lamps 1105 is 11¾" and the center-to-center vertical distance between adjacent lamps 1105 is 14¾". With such dimensions, the lamps 1105 would be ideally spaced so as to fill a standard-sized diffusion box of 24"×30" relatively evenly and uniformly.

The lamps 1105 of multi-lamp lighting unit 1100 are preferably embodied as high-efficiency par-type lamps such as, for example, described previously with respect to FIGS. 2A-2B. Thus, the lamps 1105 are preferably constructed of a par-type reflector 1130 in the rear portion of which is mounted a high-efficiency par burner 1131, as illustrated in FIG. 11C and similar to FIGS. 2A-2B. The lamps 1105 further may have a lightweight collar 1129 that may be secured to the lighting unit frame by, e.g., lightweight aluminum collar holding rings (as described with respect to FIGS. 1A-1B) or the like.

Figure 13:
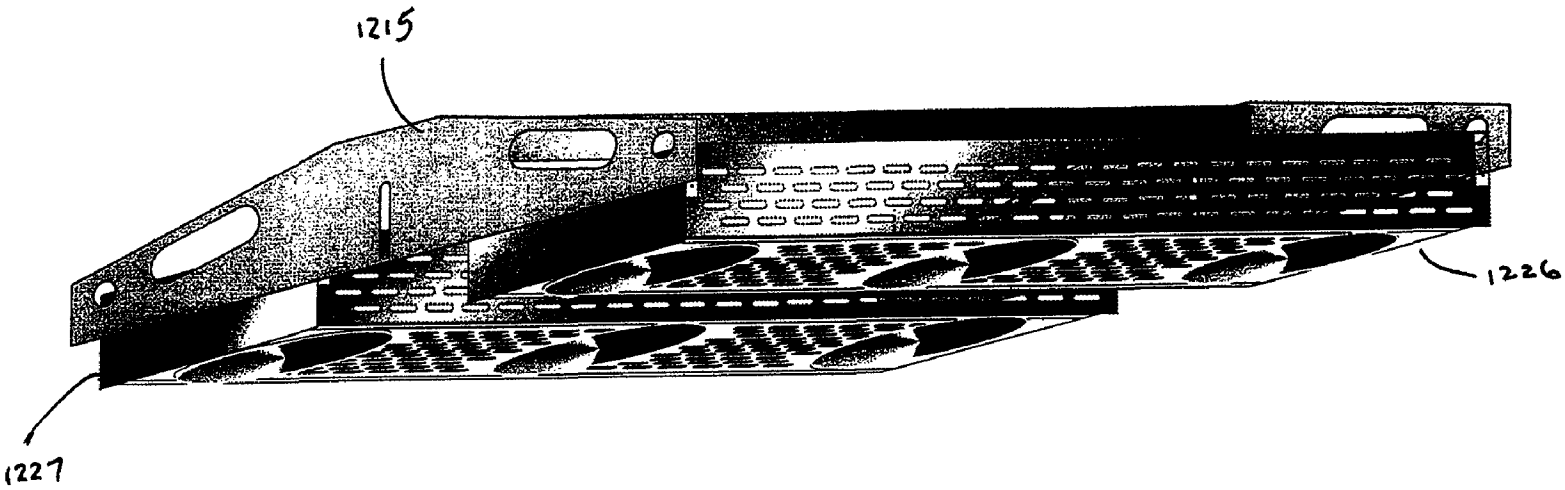
FIG. 13 is a diagram of two pods with an "H" frame as may be utilized in the multi-par light unit of FIG. 12 or otherwise.

One example of a lighting unit in the form of a versatile illumination system/lighting box 1200 is illustrated in FIG. 12, which is an assembly diagram illustrating various components of the lighting box 1200 which are also shown in more detail in FIGS. 13 through 16B. In this example, the lighting box 1200 includes a lighting frame 1215 with multiple pods 1226, 1227, constructed generally in accordance with the principles of FIGS. 5A-5B, 8 and 10, and shown with perforations for cooling/venting. Placement of the pods 1226, 1227 in the lighting frame 1215 is illustrated in FIG. 13. In each pod 1226, 1227 may be mounted a set of high-efficiency par-type lamps 1205. In this example, there are three par-type lamps 1205 per pod 1226, 1227, for a total of six par-type lamps 1205, but there may be more or fewer lamps depending on particular needs. The arrangement of the lamps 1205 and dimensions of the frame 1206 are preferably configured in accordance with the principles described below for FIG. 1; that is, the dimensions are selected so as to provide general evenness of lighting and minimum of spotting or shadows. The constituent high-efficiency par-type reflectors (such as ETC Source Four par type HPL reflectors or a lighter weight non cast aluminum substitute 1230, optional lightweight barrel collars 1229, and lenses 1207 for the par-type lamps 1205, along with the burners 1231 in which the high-efficiency par globes (such as HPL or other globes as previously described) are intended to be placed. The burners 1231 have wiring 1251 which may be aggregated into one or two connector cables 1252, given the greater power efficiency of the high-efficiency par-type globes. The lighting box 1200 may also be connectable to a yoke 1250 or other stand, thereby allowing the unit to be hung and/or tilted at various angles.

Figure 14A:
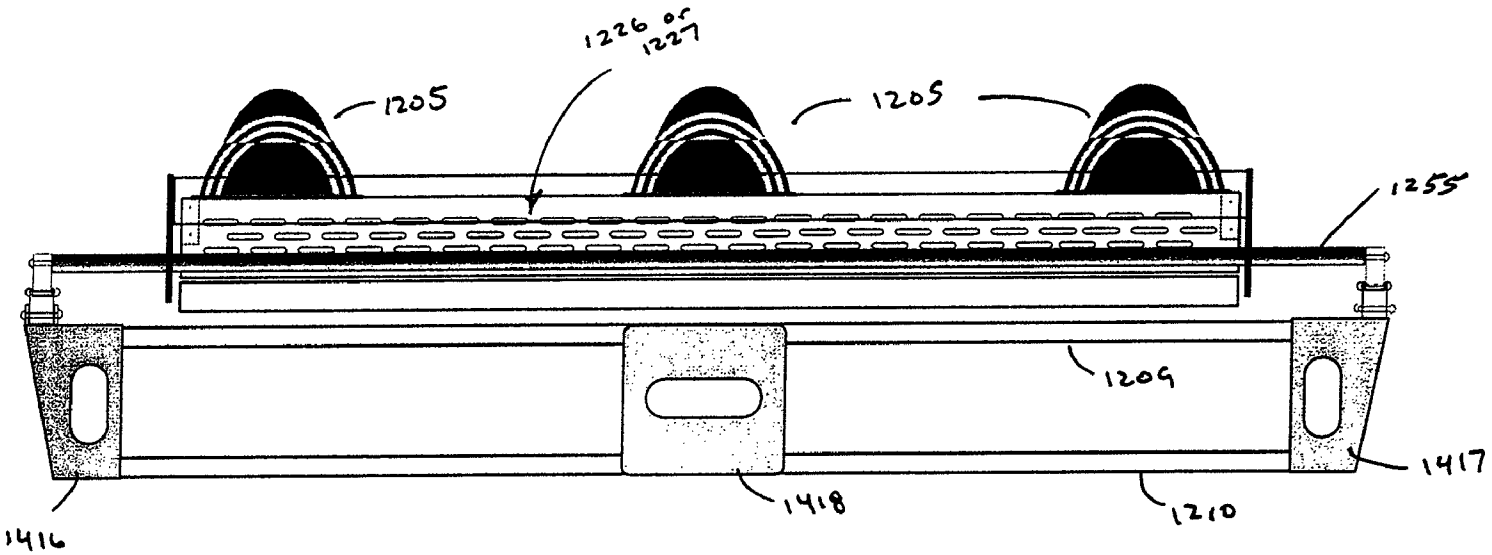
FIGS. 14A and 14B are diagrams of two different views of the multi-par light unit of FIG. 12, showing the folding arms in a retracted position.
Figure 14B:
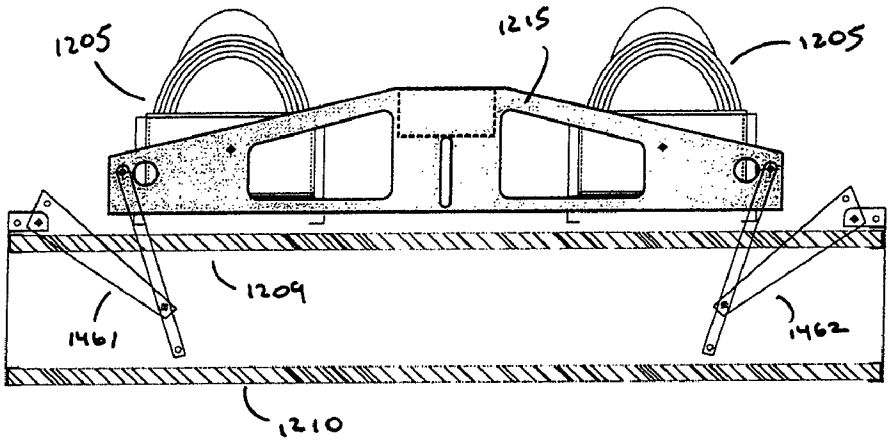

In this particular example, a skeletal collapsible box-like frame 1207 may be formed by a combination of gel frames 1209, 1210 in conjunction with tubes 1455 retractable arms 1461, 1462, as shown in detail in FIGS. 14A-14B, 15A-15B, and 16A-16B. Gel frames 1209, 1210 are generally designed to receive diffusion elements, color gels, filters, or other lighting accessories, illustrated as lighting components 1289 and 1290 in FIG. 12. The gel frames 1209, 1210, tubes 1455, and retractable arms 1461, 1462 may be made of any suitable lightweight and sturdy material. For example, the gel frames 1209, 1210 may be square or C-shaped tubing made out of aluminum, carbon fiber, plastic, fiberglass, or other materials, and tubes 1455 may be cylindrical tubing made from any of those same listed materials. The retractable arms 1461, 1462 may be retracted for storage or moving, or when a diffusion element is not used, for example. FIGS. 14A and 14B show a top view and side view, respectively, of the lighting unit 1200 with the retractable arms 1461, 1462 shown in their retracted position. In this configuration, gel frames 1209, 1210 lie close to the pods 1226, 1227. In addition, also illustrated in FIGS. 14A and 14B are gel frame supports 1416, 1417, and 1418, which serve to provide additional support and structure and also dictate the distance between the gel frames 1209, 1210.

Figure 15A:
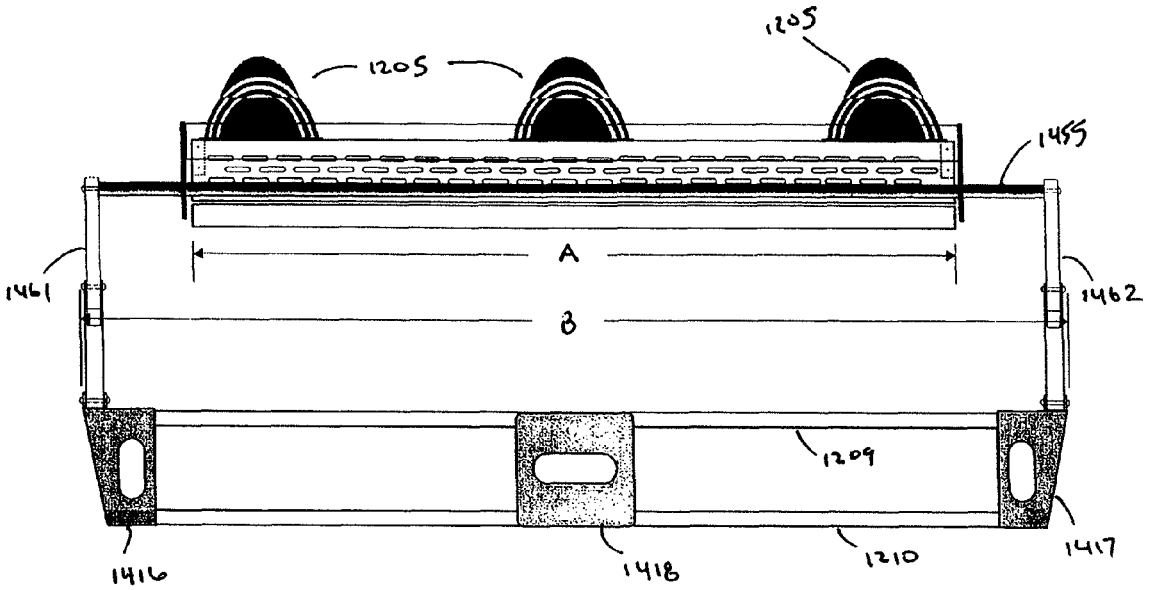
FIGS. 15A and 15B are diagrams of the same two views of the multi-par light unit of FIGS. 12 and 14A-14B, showing the folding arms in an extended position.
Figure 15B:
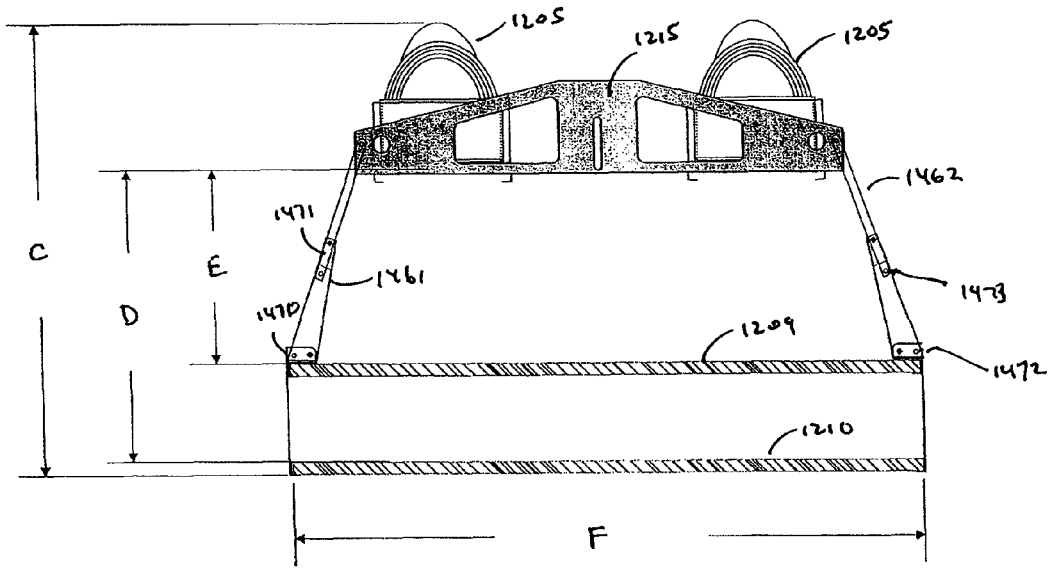
Figure 16A:
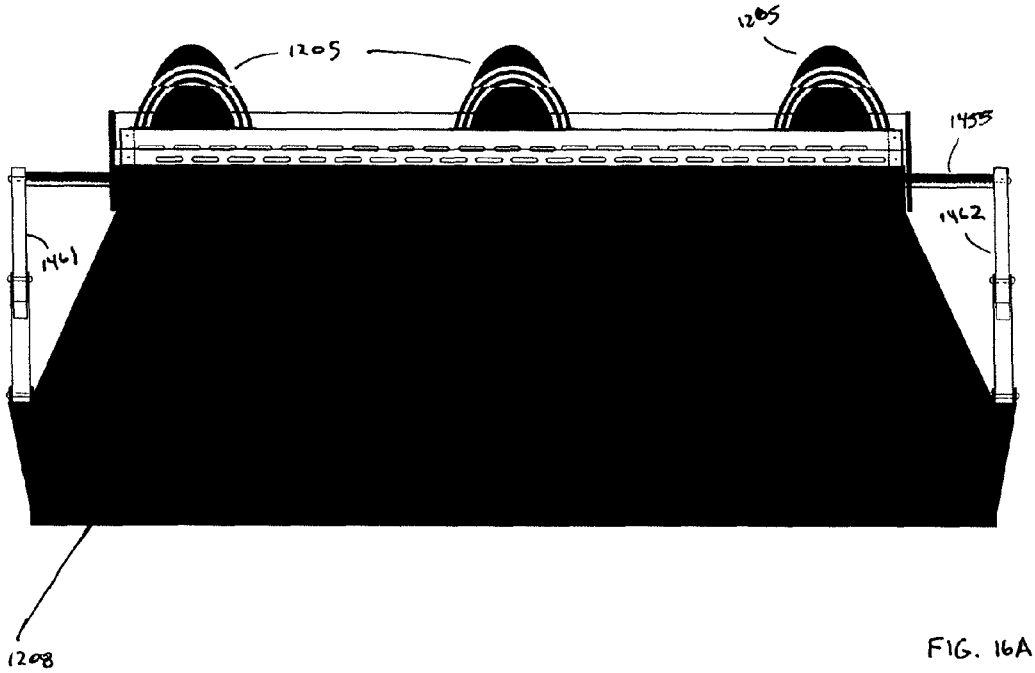
FIGS. 16A and 16B are diagrams of the same two views of the multi-par light unit of FIGS. 12 and 14A-14B, showing the folding arms in an extended position along with a diffusion cover.
Figure 16B:
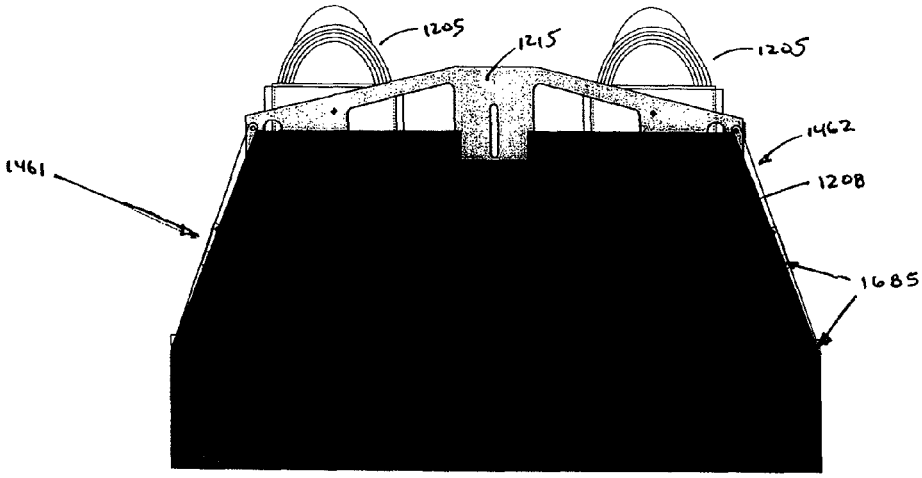

FIGS. 15A and 15B show the same views of the versatile lighting box 1200 of FIGS. 14A-14B, but showing the retractable arms 1461, 1462 in an extended position. In this particular embodiment, the retractable arms 1461, 1462 are each formed of hingeably attached members connected by hinges 1471, 1473, and connected to the nearer gel frame 1209 of the gel frame assembly by any suitable fastening means such as bracket assemblies 1470, 1472. As further illustrated in FIGS. 16A and 16B, a lightweight opaque fabric cover 1208 may be placed surrounded the skeletal box frame to prevent light spillage. The fabric cover 1208 may be pulled back or otherwise retracted, allowing placement of diffusion elements, color gels, filters, or other lighting accessories 1289, 1290 in gel frame 1209, 1210. As noted, the gel frames 1209, 1210 may comprise square or C-shaped tubing to allow sliding in and out of various such lighting accessories.

While two gel frame 1209, 1210 are illustrated in FIGS. 12 through 16B, the lighting box 1200 may have only a single gel frame, or may have additional gel frames. Alternatively, or in addition, the fabric cover 1208 may have an integrated diffusion section which is matched in general size, shape and location to the outer gel frame 1209. An alternate embodiment could have the fabric cover 1208 be a translucent or made of a light emitting "silk" type material allowing for more of a "lantern type" pattern of projected softlight. Various internal diffusion baffles could also be utilized to customize the lighting effects.

The dimensions of the lighting box 1200, including placement of the high-efficiency par-type lamps 1205, may be advantageously selected to provide optimal and beneficial illumination and, in particular, evenness of light output and, where a diffusion cover is utilized, evenness of fill of the diffusion element. As one example, with reference to FIGS. 15A and 15B, and where par-56 (seven inch) high-efficiency par-type lamps 1205 are utilized, dimension "A" in FIG. 15A corresponding to the length of the frame 1215 may be approximately 44"; dimension "B" corresponding to the length of the diffusion cover or element may be approximately 57"; dimension "A" in FIG. 15A corresponding to the length of the frame 1215 may be approximately 44"; dimension "C" corresponding to the distance of the rear of the par-type lamps 1205 to the front of the further gel frame 1210 may be approximately 25⅝"; dimension "D" corresponding to the distance from the lens(es) 1207 of the par-type lamps 1205 to the front of the further gel frame 1210 may be approximately 16½"; dimension "E" corresponding the distance from the lens(es) 1207 of the par-type lamps 1205 to the front of the nearer gel frame 1209 may be approximately 11"; and the spacing of the par-type lamps 1205 on the frame may be as generally described with respect to FIG. 1B and/or as described with respect to FIG. 17, described later herein.

An advantage of the lighting box 1200 is that globes can be changed replaced quickly and conveniently from the back of the lighting box 1200, and in some cases even without changing the focus or orientation of the lighting unit, as it may be set for filming. In some cases it may be possible to actually replace a globe during filming while the other globe(s) are illuminated, thus not stopping filming for a globe change. Likewise, lenses 1207 can also be changed or replaced quickly (three at a time) simply by swinging open the hinged pod door and dropping them out. The same is true of the reflectors 1230 and the collars 1229. The lamps 1205 (with attached socket or "burner" and globe) may be connected to a Socopex™ connector or equivalent, by wires as illustrated in FIG. 12, to supply power to the lamps 1205. Instead of, or along with, a Socopex™ connector, toggle switches for each lamp 1205 may be placed on the side of the shell, along with a standard 3-pin connector for supplying power to each lamp 1205.

Figure 17:
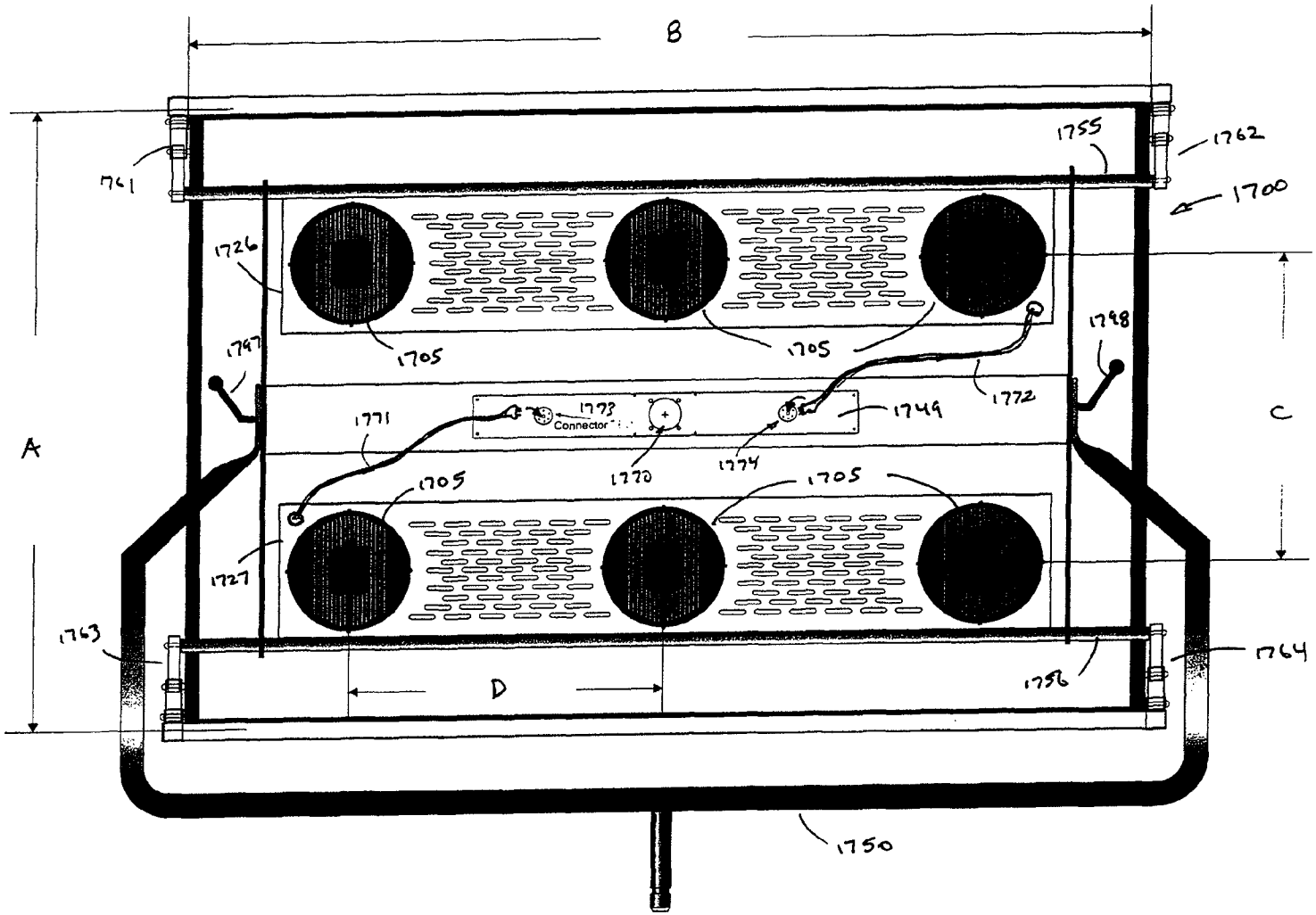
FIG. 17 is a rear view diagram of a multi-par lamp unit similar to FIG. 12, shown mounted on a yoke.

FIG. 17 is a rear view (or top view, if the unit is hung) diagram of a multi-par lighting unit similar to FIG. 12, shown mounted on a yoke. As shown in FIG. 17, the multi-par lighting unit 1700 comprises two pods 1726, 1727 which, in this example, as with FIG. 12, each have three high-efficiency par-type lamps 1705 mounted therein. The construction of a collapsible box-like diffusion frame is similar to as described with respect to FIGS. 12 through 16B. In FIG. 17, the unit is shown mounted to a fork-armed yoke 1750, and may be adjusted in terms of tilt angle by knobs or levers 1797, 1798. As noted above, the spacing of par-type lamps 1705 may advantageously be selected to provide optimal lighting quality and evenness. For example, assuming the same dimensions as described above for FIGS. 15A and 15B, dimension "A" shown in FIG. 17 corresponding to the widthwise distance between the outermost ends of retractable arms 1461, 1462 when fully extended (and hence, the outer edges of the diffusion cover across its width) may be approximately 36⅜"; dimension "B" in FIG. 17 corresponding to the lengthwise interior distance between the outermost ends of retractable arms 1461, 1462 when fully extended (and hence, the outer edges of the diffusion cover across its length) may be approximately 55"; and the dimensions "C" and "D" in FIG. 17 corresponding to the center-to-center distances between adjacent par-type lamps 1705 may be approximately 18". In other words, the layout of par-type lamps 1705 may be in a "square" pattern, as described previously with respect to FIG. 1B.

Also illustrated in FIG. 17 is a main electrical panel 1749 which allows easy and rapid connection of the wires needed to power the lamps 1705. A single Socopex or other similar connector 1770 provides a supply of electrical power to the lamps 1705 from an external source, which can be a wall source if the wattages of the lamps 1705 are appropriate therefor. Each pod 1726, 1727 is connected to the main electrical panel 1749 via a multi-wire jumper cable 1771, 1772 which inserts into sockets 1773, 1774, respectively (and may also be detachable from the pods 1726, 1727 if desired). Although not shown in FIG. 17, the main electrical panel 1749 may also include toggle switches and/or dimmers for each lamp 1205 or combinations thereof. Such control panel may be advantageous to be separated from the fixture via a multi-pin cable and wiring.

Figure 18:
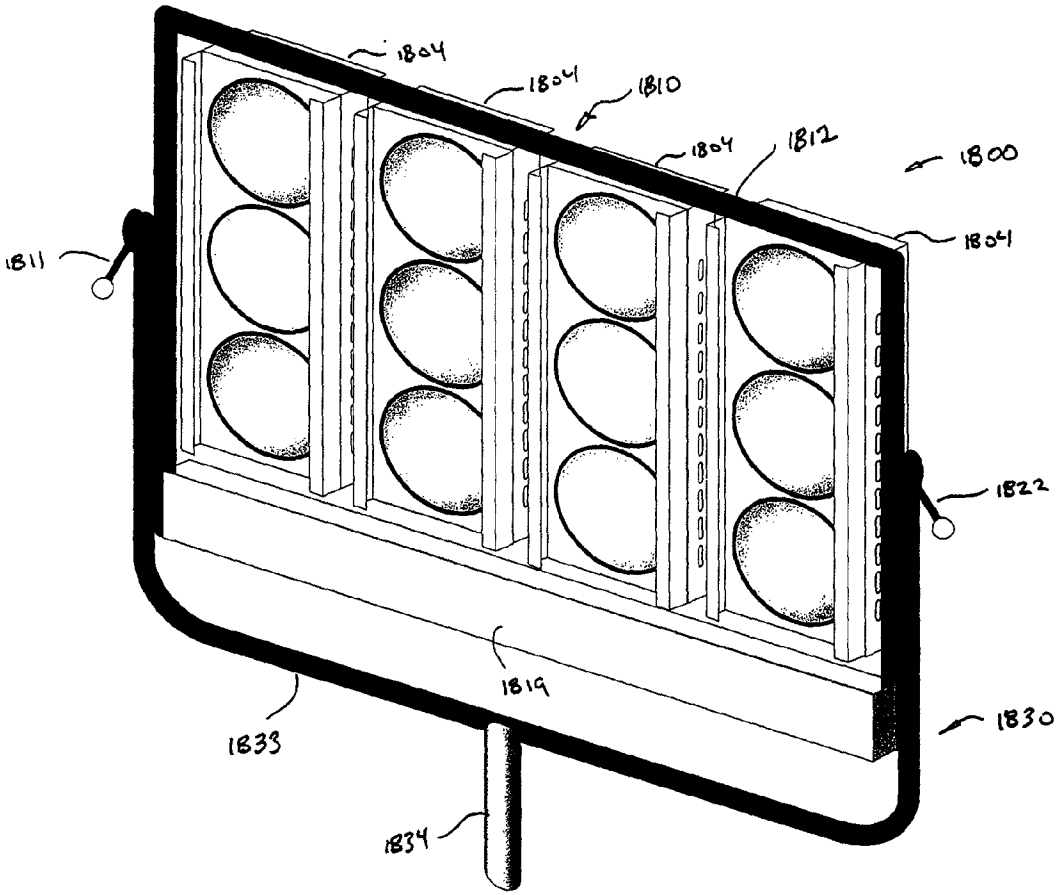
FIG. 18 is an oblique view diagram of another multi-par lamp unit shown mounted on a yoke.

FIG. 18 is a diagram of another multi-par lighting unit 1800 similar to FIG. 17, but showing four pods 1804 (instead of two), arranged side by side in a lighting frame 1819. The multi-par lighting unit 1800 may be attached to a yoke 1830, including, e.g., a pair of forked arms 1833 and stand pole 1834. Adjustable knobs or levers 1811, 1822 may be used to allow adjustment and/or tilting of the lighting unit 1800 within the yoke 1830.

Figure 19B:
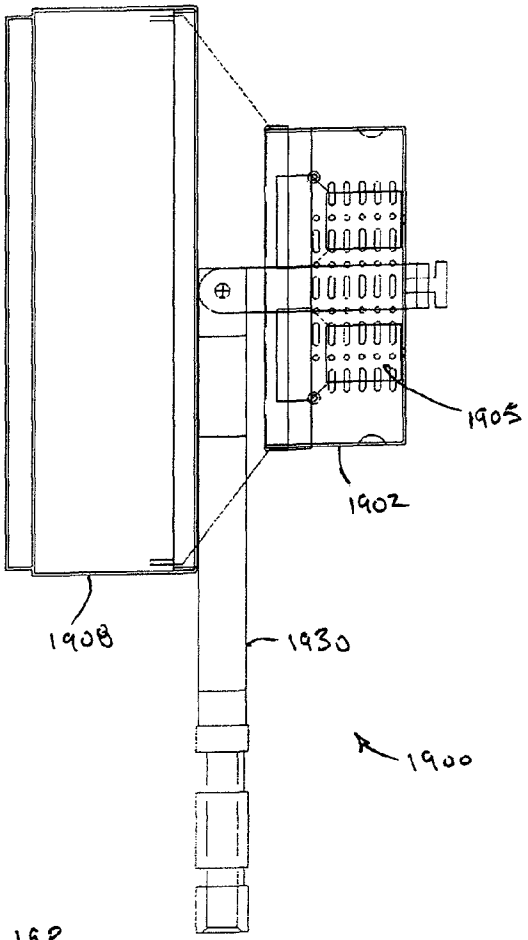
FIGS. 19A-19B and 20A-20B are diagrams of other embodiments of a multi-par light unit with an optional diffusion cover, using miniature par lights as the light source.
Figure 19A:
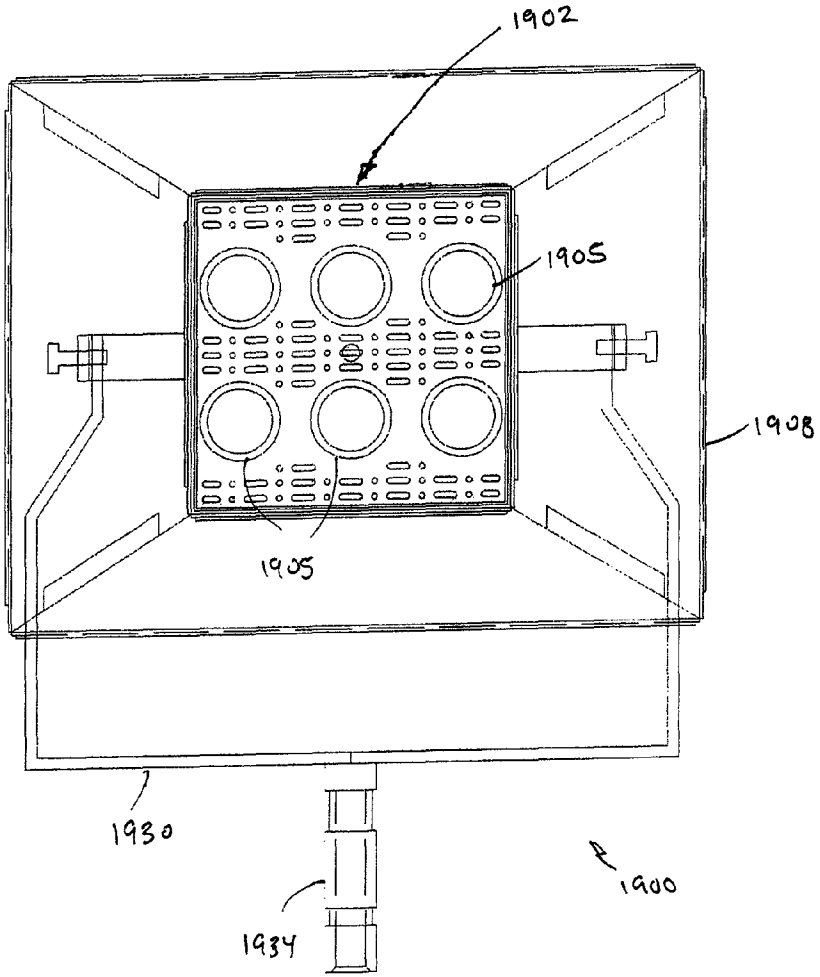

Certain techniques as described herein may be used in configurations with sealed beam or other conventional par type lamps. FIGS. 19A-19B and 20A-20B, for example, are diagrams of other embodiments of multi-par lighting systems, but using miniature par lights as the light source. FIG. 19A shows a front view of a lighting system 1900, while FIG. 19B shows a side view of the lighting system 1900. The lighting system 1900 includes a multi-par lighting unit 1902, which in this example includes a frame housing 1904 and a set of sealed beam mini-par lamps 1905 attached thereto. The frame housing 1904 is preferably lightweight and may be formed of, e.g., aluminum or other lightweight and heat-resistant materials mentioned previously. The mini-par lamps 1905 may comprise smaller sealed-beam versions of Par 56 and Par 64 lamps. For example, a particularly useful embodiment may include Par 16 (2") sealed beam lamps. Using mini-par lamps 1905 along with a lightweight frame housing 1904 may result in a very lightweight but powerful light source, that may be combined with a diffusion box or frame 1908 similar to FIGS. 12, 16A-16B, etc., or else an attached Chimera™ fabric hood of suitably small size (e.g., XXS or XS). The diffusion box or frame 1908 may be collapsible and expandable as described, for example, with respect to FIGS. 14A-B, 15A-B, and 16A-B, or otherwise. The fabric hood may have four support rods and removable or permanent gel frame holder(s), and gel frames as generally utilized in the Maxilight 4*k* design by FinnLight. There may also be access flaps cut into 2 opposing sides of the hood that peel open for quick lamp or diffusion changes and seal back in place to contain the light. The lighting unit 1902 may be mounted to a yoke 1930 and stand 1934 as previously described with respect to other lighting units.

Preferably, the mini-par lamps 1905 are spaced in a manner to substantially evenly and uniformly fill the fabric of the diffusion box or frame 1908. In the embodiment illustrated, the lamps 1905 in the four corners are spaced so they are at the approximate centers of four quadrants of the diffusion box or frame 1908, as previously described for FIG. 1B. The two center lamps 1905 may be separately turned on for additional power when needed, with or without the diffusion element present.

Figure 20B:
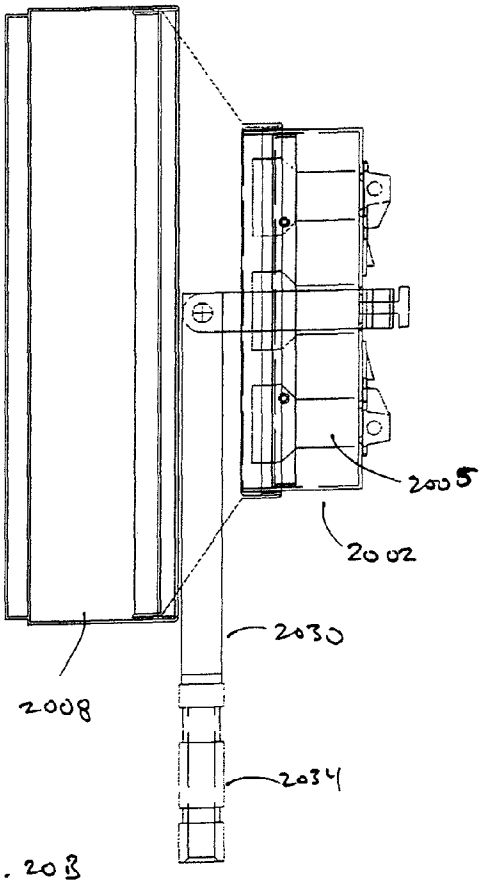
Figure 20A:
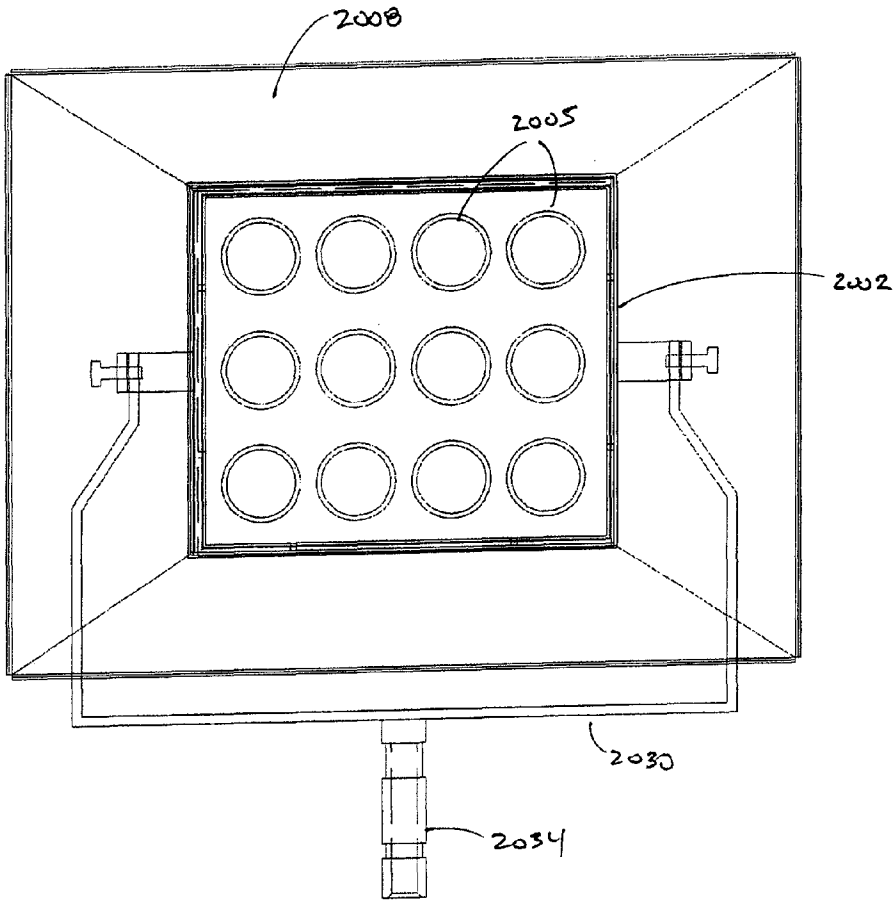

FIGS. 20A-20B show another embodiment of a lighting system 2000 similar to that of FIGS. 19A-19B, but with twelve lamps 2005 instead of six. In FIGS. 20A-20B, components corresponding to those in FIGS. 19A-19B are denoted with series "20xx" which correspond to like-numbered series "19xx." Construction and operation of the lighting system 2000 is similar to as described for FIGS. 19A-19B.

In one aspect, an extremely lightweight, integrated, compact, versatile and powerful lighting unit is provided, which can be conveniently powered from a wall source, accept standard off-the-shelf par lamps (which can be readily swapped for different wattages/types or for replacement), and can be combined with an optional diffusion element to provide many different lighting effect. These smaller lighting units may be configured to accept "household" sized Par globes available in different currents according to location internationally allow for light intensity control without change in color temperature by simple switching individual lamps on or off within the unit.

Various lighting units as described herein may be configured to be outfitted with a fabric hood of suitable size, for creating a diffusion effect, and/or may also be configured to accept commercially available fabric hoods such as those made by Chimera™. An expandable/collapsible rigid (possibly aluminum) hood can also be utilized in many of the described embodiments to create a totally integrated projected soft light device that is substantially all metal and highly durable while being able to be compacted for storage and expanded for use quickly. Such a hood or housing may be constructed of multiple (generally three or more) interlocking, and preferably rectangular, sections that can slide into each other and surround the fixture in its closed configuration. The sections accordian out, much like a collapsible drinking cup, to form a rigid housing complete with diffusion frames and slots shaped similar to the conventional Maxilight™. With individually switchable lamps, such lighting units can be made of relatively small dimensions, and may, for example, accept "household" sized par globes available in different amperages according to geographic location (U.S. or international), or desired effect/size, to allow for light intensity control without changing the color temperature, by simple switching individual lamps on or off within the lighting unit.

In certain embodiments as disclosed herein, a very lightweight, modular multiple par lamp unit is provided that can produce area lighting and/or soft projected light in lighter, more compact, and more easily rigged forms than ever before. Such modular lighting units may be configured to be expandable (e.g., side by side), thereby providing the ability to meet the needs of modern film and television studios, due to the larger scale of sets being used. As an example of this functionality and flexibility, a "double" 12-lamp unit (i.e., 24-lamp unit), itself constructed from two 6-light modular lighting units, may be constructed from two 12-lamp lighting units (as shown in FIG. 4—which may further be made up of "pods" as described in more detailed embodiments) each of 6'×4½' in size which, when placed or joined together, become a 6'×9' (24-light "dino" size). This quadruple-module unit can further be combined with another like unit to create a 12'×9' lighting unit; or when placed next to or joined with a lighting unit of similar configuration side-by-side can become a 12'×18' lighting source, with a total of three 24-light units side by each. Each of these may be configured to provide area lighting, or else may be configured with diffusion elements to provide soft projected lighting. Various modular lighting units as disclosed herein are designed to be ultra lightweight and connectable, with corresponding diffusion frames, so that the they can be assembled and dis-assembled quickly and efficiently, are highly efficient, provide easy and convenient access to lenses, reflectors and burners (and hence rapid lens replacement and globe replacement as necessary), and are overall lighter, safer, more efficient, and easier to use than other lighting apparatus presently available in the industry.

A lighting unit constructed in accordance with certain embodiments as disclosed herein may provide further advantages in terms of weight and placement of the sources, so that they are evenly distributed within an optional housing or outer diffusion shell. A versatile lighting unit of this type may further be made with the ability to add a detachable yoke and ears, to be used on a stand, hung vertically, etc. A modular lighting unit with, e.g., six lamps, can be constructed so sparingly that multiple units can be stacked, as previously described with respect to FIGS. 3A-3C, to double, triple, or quadruple the number of sources without increasing the overall size by much. A 24-light unit so constructed may well be the lightest, most compact "Dino" type lights ever made, and could further include a detachable lightweight fabric front, soft Box, housing, and other features as generally described in U.S. Pat. Nos. 6,106,125, 6,588,912, 6,719,434. and 7,204,617, all of which were previously incorporated by reference as if set forth fully herein. The stackable modular units of FIGS. 3A-3C could also be joined side by side to permit even larger and more powerful options. Dimensions and weight of lighting units in general can be a major concern, especially when being used in a Condor where wind is a factor, and the modular lighting units described herein provide a simple, cost effective, and elegant solution to the needs of the industry.

A desirable embodiment of a multi-lamp lighting unit includes a high-efficiency par burner and reflector, as previously described, possibly in conjunction with a simple lightweight barrel collar or can. Such a lamp may retain many of the standard par-can lamp qualities while adding versatility and performance with interchangeable lenses, smoother field of illumination, and multiple lamp wattage choices, as well as the significant improved output of the HPL type par globe and reflector combination, which produces light output comparable to a traditionally manufactured glass par-64 lamp using approximately 42.5% less energy. A 6-light modular unit so constructed may deliver comparable output to the well known TOPLIGHT™ light box which has been recognized for its power efficiency, producing five times the output of a conventional spacelight (50 fc@25 versus 10fc@25'). The incorporation of high-efficiency HPL type or other high performance or compact filament globes, sockets/burners and reflectors (either 7" or 8") could almost double the efficiency of the unit as used with conventional par lamps in the TOPLIGHT™ lighting fixture, thus allowing for almost half the cable, electronics, and dimmers, while the use of the lightweight components as disclosed herein may reduce the overall weight of the unit. As an example, a 24-light "Dino" configuration of the light box, lamped with 575 Watt high-efficiency HPL par globes and reflectors, could be run with one Socopex™ feed and require only six 2.4 kW-rated dimmers. Such a lighting system, powered as described, also may provide advantages in terms of adjustability of the configurations of lamps and lenses. Lower wattage lamps could be used in situations where the even spread of more instruments or larger banks is required and the output of the lower lamps is sufficient. Higher wattage lamps could be used for those situations in which output is more important than cable and dimmer usage. Using a 750 Watt high-efficiency HPL par globes, in place of the 575 Watt version, increases output of the light box significantly while still consuming 25% less power than the 1000 Watt traditional par lamp. Using HPL par globes and reflectors therefore may provide increased light output and range for the TOPLIGHT™ light box, yet, with the lightweight components pod and associated system, allow the unit to be even more lightweight versatile and possible compact.

As an example of the flexibility, versatility, and efficiency of the modular lighting units described herein, a production company carrying eight 6-light modular lighting units as described in FIG. 1A, 4, or 12, or else sixteen 3-light pods as described in FIGS. 7A-7C or elsewhere herein, could configure these parts (as well as using the either or sixteen units individually) as any of the following: (i) four "doubles" (12 kW units) of 4½'×6' to be hung or else mounted on stands, (ii) a pair of 6'×9' 24-light banks, (iii) a 12'×9' light bank, or (iv) a pair of 24-light "Dino" size lighting units—all using the same modular lighting units and a small number of supporting parts, such as removable yokes, aluminized nomex shells, diffusion screens/rags, and lightweight frame pieces to contain or connect the pods/frames. The lighting units can also be used either to provide area light or, with added diffusion elements, to provide soft projected light. This modular versatility is very advantageous in the motion picture and television industry where one equipment package can be carried for many months to light many different sets with different requirements all with the same package. Worldwide locations, equipment availability problems, off hours shooting requirements and constantly changing requirements create a need for a more flexible, efficient, higher output, lighter, adaptable, convenient to use light system that can be used in many forms. In addition, the lighting pods described herein could be carried loose and assembled into different frame configurations as needed, and may be combined with different switch boxes/power sources.

As noted in connection with various embodiments described herein, a particularly useful par-type lamp design includes a lightweight collar (which can be a separate barrel-shaped band or part of a lamp housing) or protective reflector cover or pod that readily accepts and holds in place the reflector (and burner assembly) on the rearward end and accepts lenses on the forward end, with an optimal distance if needed maintained between the reflector and the lens (as in the Source Four par lamp, approximately 3½). Such a collar or protective reflector cover or pod can be made lightweight and simple in construction, and can be readily welded or fastened to a lightweight frame to make multiple par lamp lighting units as described elsewhere herein. An additional advantage in certain embodiments heretofore described is that the reflectors can be quickly replaced without taking the whole fixture apart as is generally necessary with convention high-efficiency par-type lamp fixtures. The combination of lightweight collar if desired as previously described, high-efficiency par-type globes, burners, reflectors, and associated lenses, may be configured close together in rotatable and/or orientable banks of multiple lamps vertically stacked (e.g., in triplets), with the banks also stacked in multiple rows. For instance, four banks of triplets could be stacked to create a 12-light unit, or else six banks of four lights (quads) could be stacked vertically in rotatable frames to make a very lightweight, compact, and power efficient "Dino" type light. Such lighting units could have mounting receptacles to use fabric fronts for diffusion, or to accept any commercially available fabric diffusion boxes. These lighting units could also be used without a diffusion housing or element as floodlights or area lights.

Various other embodiments of the multiple-lamp lighting units described herein may include interchangeable housings, which may include soft fabric "bags" constructed with various translucent fabrics thereby allowing the actual housing or a portion thereof to transmit and soften light. A baffled fabric housing may advantageously include more than one diffusion element to increase the evenness and softness of the light. In a round form, designed for a multiple par configuration that could be substantially circular in shape with possible slight outwardly as well as downwardly facing par-type globes, a cylindrical housing (much like a traditional spacelight) could be outfitted with an internal conical baffle, shaped much like an inverted ice cream cone. Such a baffle could transform the unusual spotty downward light pattern of a round spacelight type multiple par-type lighting unit into more of a lantern light, with a softer more omni-directional deeply projected result. Such baffled fabric "bags" or housings could also be built for lighting units having the shape of a conventional Toplight™ light box by shaping the internal mid-baffle much like a trapezoid, or step pyramid. It is also possible to orient these baffles in a triangular or "A-frame" fashion (picture the toplight with the housing being of light emitting fabric with the front diffusion in place and two diffusion elements forming an A-shape towards the lamps. Such a design could be adjustable to send various amounts of light out the sides of the housing as needed. Such versatility, possibly combined with a non light emitting adjustable cover, could allow for a conventional Toplight with such a modified housing to illuminate a set wall or cyc at close vertical range while also illuminating in a downward fashion. It is also possible to construct these housings in a semi-circular, bisected fashion similar an "inverted covered wagon" and added to a Toplight or other multi-par lighting fixture as disclosed herein. Such an accessory could allow for greater dispersion of light vertically and improved photometrics for use where a more lantern like pattern is desirable or in situations where lower ceiling or stage heights are encountered.

Figure 22C:
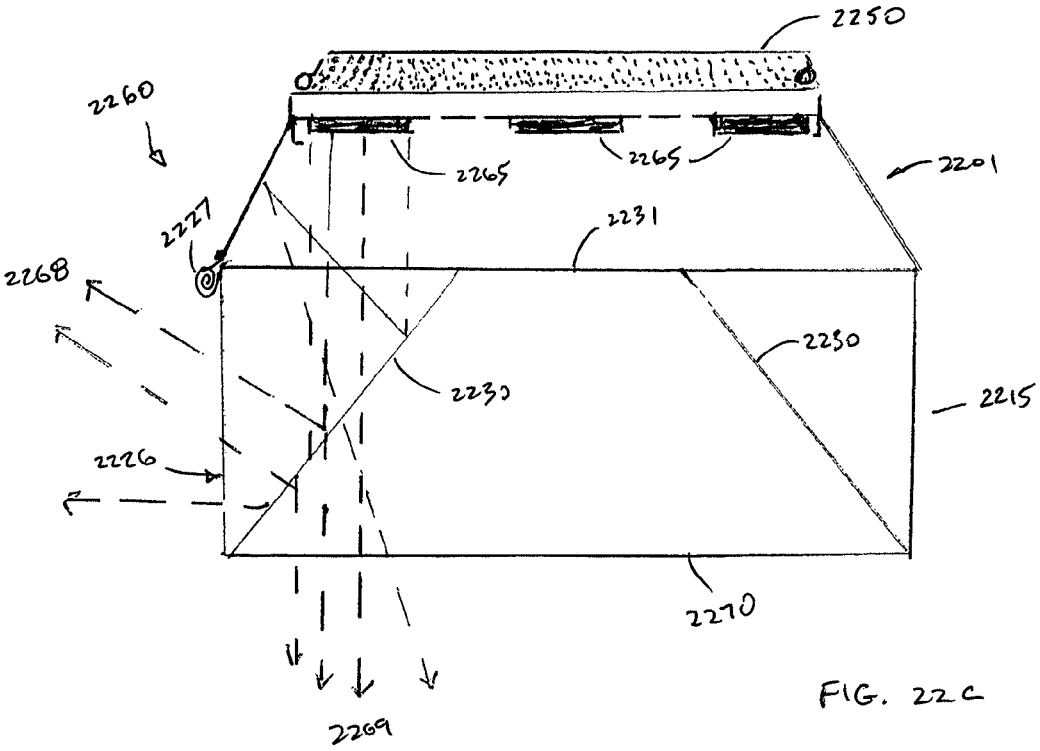
Figure 22D:
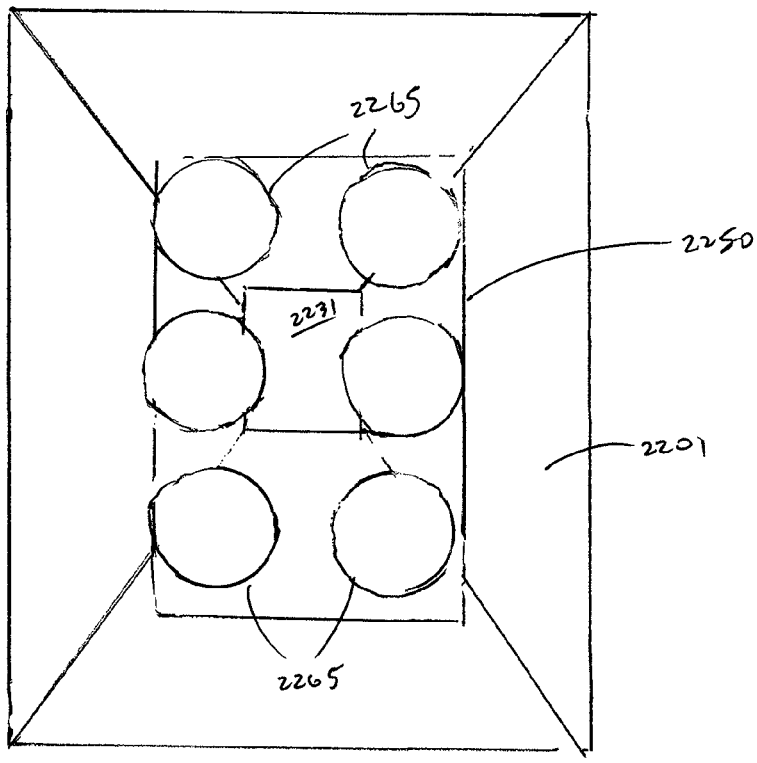

FIGS. 22A through 22D are diagrams showing an embodiment of a multi-par lighting unit with an optional removable diffusion frame and fabric cover, having a controllable side-projected light diffusion feature using, in this example, a fabric structure resembling an inverted step pyramid. In this particular embodiment, the diffusion frame is conveniently assembled from two parts illustrated in FIGS. 22A and 22B, respectively, which are shown in side view in FIG. 22C and in top view in FIG. 22D. FIG. 22A shows a top diffusion frame and cover section 2201 and FIG. 22B shows a bottom diffusion frame and cover section 2215 which collectively provide a unique and advantageous multi-angle soft light projection capability. The top diffusion frame and cover section 2201 may be constructed of a skeletal, trapezoidal frame of lightweight rigid material (aluminum, plastic, carbon fiber, etc.) as previously described, surrounded by an opaque fabric housing 2206 with reflective interior. The bottom diffusion frame and cover section 2215 in FIG. 22B may likewise be constructed of a skeletal frame 2221 of similar lightweight rigid material, generally rectangular in nature, with a collapsible rectangular-shaped top and bottom frame sections. The bottom diffusion frame and cover section 2215 is preferably surrounded by a dual-fabric covering 2226, which includes an outer opaque fabric covering that can be pulled up in "flaps" on any side, and an inner semi-translucent fabric that is both reflective and transmissive such as poly-silk type material commonly used in traditional spacelites. In addition, the bottom diffusion frame and cover section 2215 further includes a semi-translucent fabric baffle 2230 in the form of a three-dimensional trapezoid, or inverted step pyramid, for the purpose of diffusing and controllably spreading soft projected light as will be further described. The fabric baffle 2230 has a flat section 2231 at the top (which provides diffusion), over which the par-type lamps 2265 of a multi-lamp fixture are placed (overlapping the boundary of the flat section 2231 as illustrated in FIGS. 22C and 22D). The fabric baffle 2230 may be supported in part by thin nylon cords 2227 or other similar fabric members attached from the corners of the flat section 2231 to the corners of the top of the bottom diffusion frame and cover section 2215. Adjusting the tension of the cords 2227 may allow some adjustment of the height of the top of the fabric baffle 2230, and thus the angle of light projection as further described below.

FIGS. 22C and 22D illustrate the effect of the two-part assembled diffusion frame 2201, 2215 (collectively 2260) when placed in position beneath a multi-lamp lighting fixture 2250 which, in this example, has six par-type lamps 2265 which may be any of the types described previously herein. As illustrated particularly in FIG. 22C, the light from the par-type lamps 2265 is directed downwards towards the fabric baffle 2230, which allows some portion of the light to transmit through towards an optional second diffusion element 2270 at the base of the bottom diffusion frame and cover section 2215, thereby providing double diffusion to light 2269 projected towards the bottom of the assembly 2260 in a manner analogous to the other prior diffusion boxes described above. At the same time, a portion of the light from the par-type lamps 2265 is reflected from the fabric baffle 2230 and towards the sidewall outer fabric cover 2226 of the bottom diffusion frame and cover section 2215, which diffuses the light and, assuming that the opaque fabric flap 2227 is retracted, provides controllable projected diffused light 2268 towards the side of the assembly 2260. In addition, light reflected from the fabric baffle 2230 may also reflect from the interior portion of the top diffusion frame and cover section 2215, and then redirected downwards in a manner similar to the light projected from the par-type lamps 2265 but with some angular variations that serve to spread the light more fully.

By selectively raising the opaque flaps on the outer fabric cover portion of the dual-fabric covering 2226, the operator may control the direction of projected soft light to emanate from any or all of the four sides of the assembly 2260, or none of them. By virtue of the slanted interior walls of fabric baffle 2230, a larger area may be controllably illuminated with projected soft light. Such versatility, particularly when used with the dual-fabric opaque adjustable cover, could allow for a multi-par lighting fixture to illuminate a set wall or cyc at close vertical range while also illuminating in a downward fashion. It is also be possible to construct similar fabric housings in a semi circular bisected fashion, resembling an "inverted covered wagon," which may allow for greater dispersion of light vertically and improved photometrics for use where a more lantern like pattern is desirable or in situations where lower ceiling/stage heights are encountered. It is also possible to orient these baffles in a triangular or "A-frame" fashion, i.e., having a triangular wedge-shaped baffle that has only two slanted walls, which may likewise be adjustable to send various amounts of light out the sides of the housing as needed.

Figure 23:
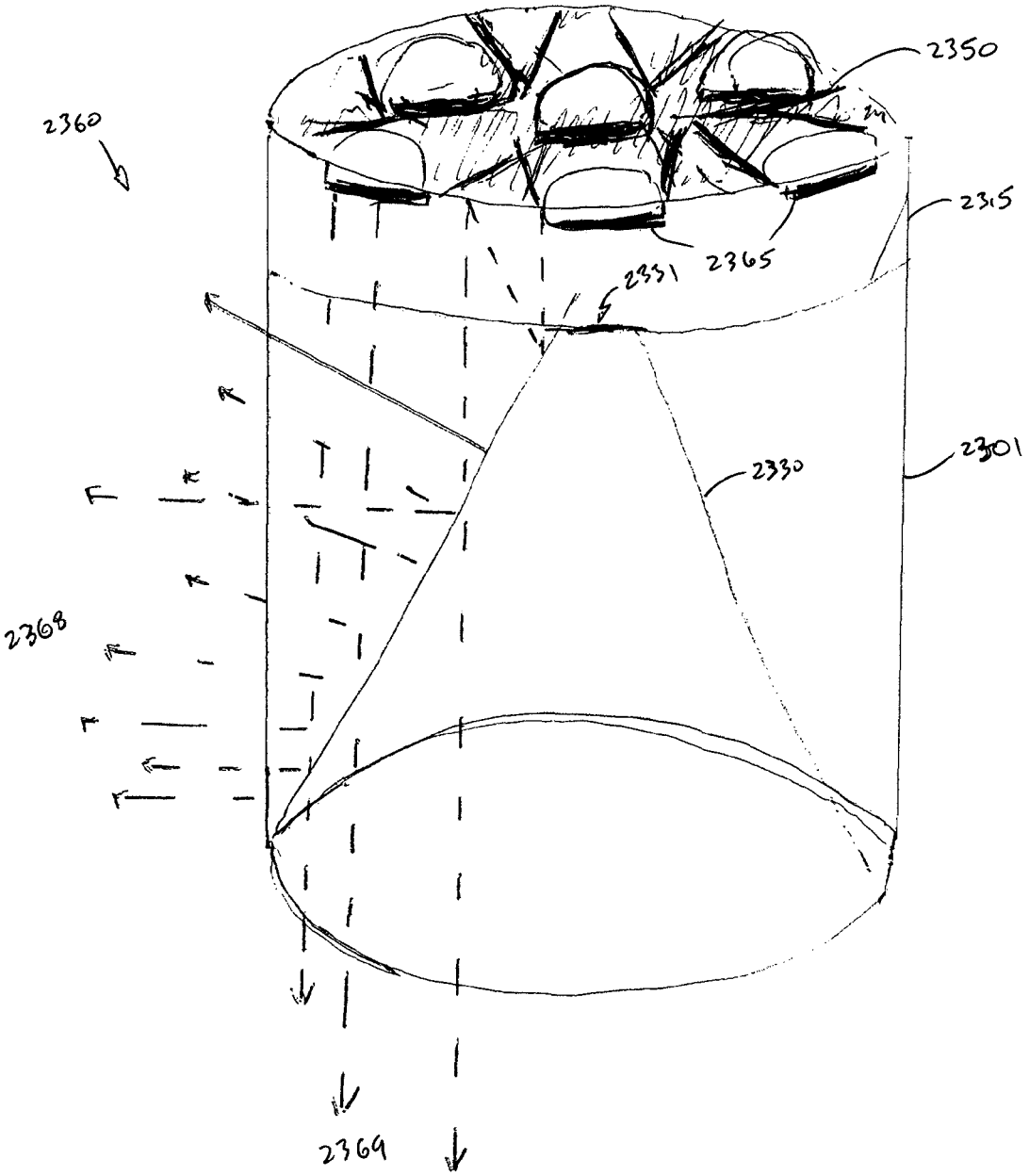
FIG. 23 is a diagram of another embodiment of a multi-par lighting unit with an optional removable collapsible diffusion frame and fabric cover, having a conical interior member (baffle) for both reflecting, diffusing and transmitting light in a substantially equal and omni-directional lantern, space or heart-shaped pattern.

Another diffusion light fixture embodiment using a similar approach is illustrated in FIG. 23, which shows a circular multi-par lighting fixture 2350 with a collapsible diffusion frame and fabric cover 2301, having a conical interior member 2330 for expanding the projection of diffused light. Similar to the embodiment of FIG. 22C, the diffusion light fixture of FIG. 23 has a two-part design with a top diffusion frame and cover section 2315 and a bottom diffusion frame and cover section 2301. The inverted conical baffle 2330 provides a similar effect to the trapezoidal interior baffle 2230 described with respect to FIG. 22C. In this round form, the unit may be suspended such that the par lamps 2365 therein are facing downwards towards the diffusion frame assembly 2360. The par lamps 2365 may be mounted to permit tilting or partial rotation, or else permanently mounted, in either case such that some or all of the lamps 2365 may be splayed or angled in a convex plane to create a wider beam spread. Similar to the inverted step pyramid shape of the fabric baffle 2230 in FIG. 22C, the inverted conical baffle 2330 in FIG. 23 may have the pointed end "flattened" to allow better light transmission in the area closest to the par-type lamps 2365 while still maintaining optimum reflection or "bounce" of the light from the outer walls of the conical baffle 2330 and also optimal transmission and diffusion through the conical baffle 2330. Such a design could, for example, transform the unusual spotty downward light pattern of a round spacelight type multiple par-type lighting unit into more of a lantern light, with a softer more even deeply projected result.

Although certain embodiments are described in terms of using independent components such high efficiency globes (HPL, HPR, HX 600, etc.), reflectors, lenses and/or burners, combined with lightweight collars or into pods, it may also possible to utilize traditional sealed-beam par globes in certain configurations (with slight modifications), which may be preferable in some applications and nonetheless still retain greatly improved versatility over traditional lighting fixtures, even though the benefits of output versus amperage drawn and size would be lower than with other embodiments utilizing high efficiency components.

Various lighting units constructed in accordance with the principles described herein may be well suited for worldwide broadcast use, including the lighting of sets for shooting television news and for programming that is intended for high definition television or display, as well as large scale motion picture and television applications. As compared to conventional lighting units with Fresnel units with a fabric hood, for example, the lighting units with an integrated fabric front are a substantial improvement in terms of compactness, output, depth of projected light, softness, customization, balance, evenness of illumination, and convenience of replacing parts. Rigid or semi-rigid construction of the lighting housings or soft box hoods may also allow, for example, for the use of honeycomb metal grids, without sagging.

Embodiments as disclosed herein, whereby deeply projected and controlled soft light may be provided, may be useful for television, motion picture, entertainment, and photography environments, and especially in the less forgiving environment of high definition digital capture and broadcast. Illumination provided by the various lighting apparatus disclosed herein may provide softer, more deeply projected light than available before, in a modular unit that is versatile, flexible and efficient. Such lighting apparatuses may provide a wide variety of light levels, create a mood, enhance special lighting and generally work for daylight, sunset, night shots and more.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

The invention claimed is:

1. A compact, versatile light projection device, comprising:

a plurality of par lamps of at least four in number, said par lamps capable of operating in a universal burn position;

a lighting frame configured to directly or indirectly support said plurality of par lamps therefrom, said lighting frame adapted to be mounted on a stand or suspended;

a diffusion frame attachable to said lighting frame for channeling and controlling the light from the par lamps, the diffusion frame having a back end and a front end and being attachable to said lighting frame such that said par lamps project light from the back end towards the front end of the diffusion frame; and a primary filter holding element disposed at or near the front end of said diffusion frame, whereby when a filter element comprising a light-diffusing material is mounted in said primary filter holding element, light produced by said par lamps is directed through the filter element;

wherein said par lamps have a back section, and each comprise a high efficiency bulb, a reflector, a burner, and a lens;

wherein said lighting frame provides rearward access to said par lamps;

wherein one or more of said burners is removable from the back section of said par lamps to facilitate rapid replacement of the bulb; and wherein said diffusion frame comprises at least one sidewall comprising a translucent material, and an interior semi-translucent baffle which allows some portion of light from one or more of the par lamps to be directed toward the front of the diffusion frame while simultaneously reflecting light from the one or more par lamps towards the sidewall whereby projected soft light is created through the sidewall.

2. The lighting projection device of claim 1, wherein said lightweight reflector and lens are Par 56 size.

3. The lighting projection device of claim 2, wherein said par lamps have a nominal power rating of at least 375 Watts.

4. The lighting projection device of claim 2, wherein said lightweight reflector is metallic and has facets or grooves matched to said high efficiency bulb to increase light output.

5. The lighting projection device of claim 4, wherein said high efficiency bulb has a compact filament structure.

6. The lighting projection device of claim 1, wherein said par lamps are at least six in number.

7. The lighting projection device of claim 6, wherein said par lamps are arranged in at least two rows.

8. The lighting projection device of claim 7, wherein said par lamps are arranged in a plurality of pods, each of said pods comprising at least two of said par lamps and being independently movable relative to said lighting frame.

9. The lighting projection device of claim 8, wherein said pods are configured to independently swivel within said lighting frame.

10. The lighting projection device of claim 8, wherein at least one of said pods comprises a pod frame and a movable front face member, whereby when said front face member is moved to a first position it secures the lenses of the par lamps in the pod, and when said front face member is moved to a second position it provides access to all of the lenses of the par lamps in the pod simultaneously.

11. The lighting projection device of claim 10, wherein said movable front face member is hingably attached to said pod frame.

12. The lighting projection device of claim 6, wherein said par lamps are substantially evenly spaced across each of said rows.

13. The lighting projection device of claim 1, wherein said lightweight reflector is substantially formed of spun or pressed aluminum.

14. The lighting projection device of claim 1, wherein said par lamps are of sufficient size and intensity, and sufficiently spaced apart relative to the size of the filter element, to create a deeply projected soft light when directed through the filter element.

15. A compact, versatile lighting projection device comprising:

a plurality of par lamps of at least four in number, said par lamps capable of operating in a universal burn position;

a lighting frame configured to directly or indirectly support said plurality of par lamps therefrom, said lighting frame adapted to be mounted on a stand or suspended;

a diffusion frame attachable to said lighting frame for channeling and controlling the light from the par lamps, the diffusion frame having a back end and a front end and being attachable to said lighting frame such that said par lamps project light from the back end towards the front end of the diffusion frame; and a primary filter holding element disposed at or near the front end of said diffusion frame, whereby when a filter element comprising a light-diffusing material is mounted in said primary filter holding element, light produced by said par lamps is directed through the filter element;

wherein said par lamps have a back section, and each comprise a high efficiency bulb, a reflector, a burner, and a lens;

wherein said lighting frame provides rearward access to said par lamps;

wherein one or more of said burners is removable from the back section of said par lamps to facilitate rapid replacement of the bulb;

wherein said diffusion frame comprises at least one sidewall comprising a translucent material, and an interior semi-translucent baffle which allows some portion of light from one or more of the par lamps to be directed toward the front of the diffusion frame while simultaneously reflecting light from the one or more par lamps towards the sidewall whereby projected soft light is created through the sidewall; and wherein said interior semi-translucent baffle is substantially in the shape of an inverted three-dimensional trapezoid, with the narrow side of the inverted trapezoid proximate to said par lamps.

16. A versatile light projection device, comprising:

a light mounting frame;

a plurality of par lamps of at least four in number attached to said light mounting frame and capable of operating in a universal burn position;

a detachable diffusion frame readily attachable to and detachable from said light mounting frame for modifying the light from the par lamps, the diffusion frame having a back end and a front end and a filter holding element at said front end for receiving a light filter comprising a light-diffusing material;

an outer diffusion cover surrounding the diffusion frame and forming a sidewall thereof; and an interior semi-translucent baffle angled from the back end of the diffusion frame to the front end thereof, said interior semi-translucent baffle allowing some portion of light from one or more of the par lamps to pass through and reach the front end of the diffusion frame while simultaneously reflecting light from the one or more par lamps through the outer diffusion cover.

17. The versatile light projection device of claim 16, wherein:

said light mounting frame has an upper support member, a lower support member, and a crossbeam connecting said upper support member and lower support member;

said par lamps are arranged in a plurality of pods; and said pods are arranged in parallel and swivably mounted to said upper support member and said lower support member of said light mounting frame, each of said pods comprising two or more par lamps.

18. The versatile light projection device of claim 16, wherein said interior baffle is in the shape of an inverted trapezoid.

19. The versatile light projection device of claim 16, wherein said diffusion frame is cylindrical, and wherein said interior baffle is in the shape of an inverted cone.

20. A versatile light projection device, comprising:

a circular lighting frame;

a plurality of par lamps of at least four in number mounted on said circular lighting frame, said par lamps capable of operating in a universal burn position;

a detachable cylindrical diffusion frame attachable to and detachable from said circular lighting frame at a first end, said cylindrical diffusion frame having an outer end opposite from said first end;

a diffuse fabric cover surrounding said cylindrical diffusion frame; and an inverted conical baffle of semi-translucent material inside said cylindrical diffusion frame, said inverted conical baffle widening from said first end of said cylindrical diffusion frame to the outer end of said cylindrical diffusion frame.

21. The versatile light projection device of claim 20, wherein said plurality of par lamps individually swivel or rotate.

22. The versatile light projection device of claim 20, wherein a first portion of light from said par lamps reflects from the inverted conical baffle and is emitted through the diffuse fabric cover surrounding said cylindrical diffusion frame, and wherein a second portion of light from said par lamps passes through the inverted conical baffle and is emitted through the outer end of said cylindrical diffusion frame.

* * * * *